US010433681B2

(12) United States Patent
Ophardt et al.

(10) Patent No.: US 10,433,681 B2
(45) Date of Patent: Oct. 8, 2019

(54) CARTRIDGE FOR PUMP ASSEMBLY CARRYING RASP

(71) Applicant: OP-Hygiene IP GmbH, Niederbipp (CH)

(72) Inventors: Heiner Ophardt, Arisdorf (CH); Andrew Jones, St. Anns (CA); Zhenchun Shi, Hamilton (CA)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 16/188,536

(22) Filed: Nov. 13, 2018

(65) Prior Publication Data

US 2019/0075978 A1 Mar. 14, 2019

Related U.S. Application Data

(63) Continuation of application No. 15/787,852, filed on Oct. 19, 2017, now Pat. No. 10,154,763, which is a (Continued)

(30) Foreign Application Priority Data

Aug. 29, 2014 (CA) ..... 2861544

(51) Int. Cl.
*A47K 5/12* (2006.01)
*A47K 5/09* (2006.01)
(Continued)

(52) U.S. Cl.
CPC ..... *A47K 5/12* (2013.01); *A47K 5/09* (2013.01); *A47K 5/1207* (2013.01); (Continued)

(58) Field of Classification Search
CPC ... A47K 5/12; A47K 5/09; A47K 5/14; A47K 5/1214; A47K 5/1027; A47K 5/1028; (Continued)

(56) References Cited

U.S. PATENT DOCUMENTS 3,018,969 A 1/1962 Gentry
3,777,982 A 12/1973 Britton
(Continued)

FOREIGN PATENT DOCUMENTS

CH 432758 3/1967
DE 182630 4/1907
(Continued)

*Primary Examiner* — Lien M Ngo
(74) *Attorney, Agent, or Firm* — Thorpe North & Western, LLP

(57) ABSTRACT

A pump assembly for generating and dispensing of particles of a solid material with or without dispensing of a fluid. The pump assembly preferably includes a fluid pump which in a cycle of operation draws the fluid through a fluid inlet and dispenses the fluid out a fluid outlet. The pump assembly carries a block of the solid material coalesced together and a rasp member, which during the cycle of operation, moves relative the rasp in engagement with the block whereby the rasp member disengages particles of the solid material from the block which particles drop under gravity downwardly adjacent the fluid outlet, for example, onto a user's hand as in the case that the fluid is a hand cleaning fluid and the solid is a solid soap.

20 Claims, 39 Drawing Sheets

Related U.S. Application Data continuation of application No. 14/839,672, filed on Aug. 28, 2015, now Pat. No. 9,826,862.

(51) Int. Cl.

| | |
|---|---|
| ***B05B 11/00*** | (2006.01) |
| ***A47K 5/14*** | (2006.01) |
| ***F04B 9/14*** | (2006.01) |
| ***F04B 19/22*** | (2006.01) |
| ***F04B 23/02*** | (2006.01) |
| ***F04B 43/02*** | (2006.01) |
| ***C11D 17/00*** | (2006.01) |

(52) U.S. Cl.

CPC ..... *A47K 5/1208* (2013.01); *A47K 5/14* (2013.01); *B05B 11/0078* (2013.01); *C11D 17/00* (2013.01); *F04B 9/14* (2013.01); *F04B 19/22* (2013.01); *F04B 23/028* (2013.01); *F04B 43/02* (2013.01)

(58) Field of Classification Search

CPC .... B05B 11/0083; B05B 11/0078; F04B 9/14; F04B 19/22; F04B 32/028; F04B 43/02; C11D 17/00

USPC ..... 222/135–142, 190, 185.1, 181.1, 183, 222/321.1, 321.7, 321.9, 145.3, 181.3

See application file for complete search history.

(56) References Cited

U.S. PATENT DOCUMENTS

| | | | | |
|---|---|---|---|---|
| 4,004,716 | A | | 1/1977 | Steels |
| 4,357,861 | A | | 11/1982 | Di Girolamo |
| 4,426,362 | A | * | 1/1984 | Copeland ..... A47L 15/44 422/263 |
| 4,687,121 | A | * | 8/1987 | Copeland ..... A47L 15/4436 134/93 |
| 5,431,309 | A | | 7/1995 | Ophardt |
| 5,489,044 | A | | 2/1996 | Ophardt |
| 5,975,360 | A | | 11/1999 | Ophardt |
| 6,409,050 | B1 | | 6/2002 | Ophardt et al. |
| 7,225,948 | B2 | | 6/2007 | Ophardt et al. |
| 7,267,251 | B2 | | 9/2007 | Ophardt |
| 7,303,099 | B2 | | 12/2007 | Ophardt |
| 7,661,561 | B2 | | 2/2010 | Ophardt et al. |
| 7,823,751 | B2 | | 11/2010 | Ophardt et al. |
| 7,980,421 | B2 | | 7/2011 | Ophardt et al. |
| 7,993,579 | B2 | * | 8/2011 | Williams ..... C04B 41/009 134/22.1 |
| 8,091,739 | B2 | | 1/2012 | Ophardt et al. |
| 8,113,388 | B2 | | 2/2012 | Ophardt et al. |
| 8,206,973 | B2 | | 6/2012 | Ophardt |
| 8,272,540 | B2 | | 9/2012 | Ophardt et al. |
| 8,360,286 | B2 | | 1/2013 | Shi et al. |
| 8,365,965 | B2 | | 2/2013 | Ophardt et al. |
| 8,474,664 | B2 | | 7/2013 | Ophardt et al. |
| 8,944,294 | B2 | | 2/2015 | Ophardt et al. |
| 9,220,377 | B2 | | 12/2015 | Fitzpatrick et al. |

FOREIGN PATENT DOCUMENTS

| | | | | |
|---|---|---|---|---|
| GB | 8512 | A | * | 4/1902 |
| GB | 22900 | A | * | 10/1910 |
| GB | 207269 | | * | 11/1923 |
| GB | 425273 | A | * | 3/1935 |
| GB | 499119 | A | * | 1/1939 |
| JP | 517251 | | | 1/1976 |
| JP | 05317200 | | | 12/1993 |

* cited by examiner

CARTRIDGE FOR PUMP ASSEMBLY CARRYING RASP

RELATED APPLICATION

This application is a continuation of co-pending U.S. patent application Ser. No. 15/787,852 filed Oct. 19, 2017 which is a continuation of U.S. patent application Ser. No. 14/839,672 filed Aug. 28, 2015 which issued to U.S. Pat. No. 9,826,862 and claims the benefit of 35 U.S.C. 120.

SCOPE OF THE INVENTION

This invention relates generally to dispensers and, more particularly, to a pump assembly adapted to generate and dispense particulate solid material preferably concurrently with a liquid such as, for example, solid soap particles and a liquid cleaner.

BACKGROUND OF THE INVENTION

Many of today's products sold in liquid form, such as liquid hand soap, are contained in disposable containers or reservoir cartridges which incorporate a pump assembly. Typically, the pump assembly includes a movable element which when moved dispenses a quantity of liquid soap from the container. The reservoir cartridges are generally fitted within a permanent housing which includes a movable actuator assembly which engages and moves the movable element to dispense the fluid. This has been found to be both a convenient and economical means of fluid supply and dispensation. Since the reservoir cartridges are replaced once the fluid supply is exhausted, it is desirable to manufacture the reservoir cartridges and their pump assemblies so as to make their manufacture and replacement as easy as possible.

Known pump assemblies typically suffer the disadvantage in that they are not adapted to generate or dispense solid particulate material.

SUMMARY OF THE INVENTION

To at least partially overcome these disadvantages of known fluid dispensers, the present invention provides a pump assembly in which, with movement of a pump member relative a body, a rasp moves relative a block of solid material to disengage particles of the solid material.

The present invention provides a pump assembly for generating and dispensing of particles of a solid material with or without dispensing of a fluid. The pump assembly preferably includes a fluid pump which in a cycle of operation draws the fluid through a fluid inlet and dispenses the fluid out a fluid outlet. The pump assembly carries a block of the solid material coalesced together and a rasp member, which during the cycle of operation, moves relative the rasp in engagement with the block whereby the rasp member disengages particles of the solid material from the block which particles drop under gravity downwardly adjacent the fluid outlet, for example, onto a user's hand as in the case that the fluid is a hand cleaning fluid and the solid is a solid soap.

Preferably, the pump assembly includes a pump housing body and the fluid pump includes a pump member mounted to the body for movement relative the body in the cycle of operation to draw and dispense the fluid. Preferably, the rasp member is mounted to the body for movement relative the body in the cycle of operation to disengage the particles.

Preferably, the block is biased into engaging contact with the rasp member to assist in the rasp member disengaging the particles from the block.

The pump member and the rasp member may be mechanically linked such that in a cycle of operation with movement of the pump member relative the body to dispense the fluid, the rasp member moves relative the body to disengage the particles.

The pump member and the rasp member can be mechanically linked by a linkage mechanism which is selectable to be in a coupled condition in which in a cycle of operation with movement of the pump member relative the body to dispense the fluid there is movement of the rasp member relative the body to disengage the particles or an uncoupled condition in which in a cycle of operation with movement of the pump member relative the body dispense the fluid there is not movement of the rasp member relative the body to disengage the particles.

The body can carry a collar for securing the pump assembly to an opening to a container comprising a reservoir for the fluid, preferably with the fluid inlet in communication through the collar with the fluid in the reservoir.

The fluid pump may comprise many different types of pumps without limitation, however, is preferably selected from a piston pump, a diaphragm pump, and a rotary pump.

The pump member is mounted to the body for movement relative the body to draw and dispense fluid and this relative movement includes reciprocal movement parallel to an axis and rotary movement about an axis.

The rasp member and the pump member may be carried on the body for movement in unison together or for independent movement. The rasp member can be carried on the pump member for movement with the pump member relative the block with the rasp member, for example, axial movement or rotary movement with the pump member or, for example, with axial movement of the pump member moving rasping portions of the rasp member radially.

The rasp member preferably comprises a rasp surface directed radially relative the pump member with the block having a radially directed surface biased radially into engagement with the rasp surface and with the rasp member coupled to the pump member for movement of the rasp surface axially with the piston relative the block while in engagement with the radially directed surface of the block.

The block may comprise a plurality of segments arranged circumferentially spaced about the axis in a circle about the rasp member with a circumferential band of resilient material encircling the segments and biasing each segment to move radially into engaging contact with the rasp member and, preferably, with the body engaging each segment to guide each segment in sliding radially into engaging contact with the rasp member.

Preferably, the body carries a solid material cage enclosing the block separated from the fluid. The cage preferably includes a solid material discharge tube guiding the particles discharged from the block by the rasp member to a solid material discharge outlet proximate the fluid outlet while maintaining the particles separated from the fluid until exiting from the solid material discharge outlet.

In a preferred embodiment, the fluid pump is a piston pump and the body carries a piston chamber disposed coaxially about a pump axis with the chamber having a closed axially inner end and an open outer end. The pump member comprises a piston coaxially slidable received in the chamber with an outer end of the piston extending outwardly of the open outer end of the chamber to a discharge outlet at the outer end of the piston. The piston is coaxially slidable along the axis within the piston between an extended position and a retracted position and movable in the cycle of operation between the extended position and the retracted position to draw the fluid in the inlet and to discharge the fluid out the discharge outlet.

In another embodiment, the fluid pump is a diaphragm pump and the pump member comprises a plunger member reciprocally slidable along the axis in the cycle of operation. The diaphragm pump includes a resilient diaphragm member defining a variable volume diaphragm chamber. Reciprocal movement of the plunger member along the axis deflects the diaphragm to changing the volume of the diaphragm chamber thereby drawing fluid into the fluid pump and discharging the fluid from the fluid pump.

A pump assembly in accordance with the invention is advantageously provided in combination with a container containing the fluid and in which the body is secured to an opening to the container providing for communication of the fluid in the container to the fluid pump. The present invention also provides a dispenser for dispensing of a fluid and particles of a solid material. Such dispenser comprises:

(1) a reservoir containing the fluid;
(2) a pump which in a cycle of operation draws the fluid from the reservoir into the chamber and dispenses the fluid out an outlet;
(3) a block of the solid material coalesced together,
(4) a rasp, which during the cycle of operation of the pump, moves relative the block in engagement with the block whereby the rasp erodes the block by disengaging the particles from the block, and
(5) a particle discharge chute receiving the particles disengaged from the block and directing the particles under gravity downwardly to a particle exitway adjacent the outlet.

Preferably, such dispenser includes:

a dispenser housing;

a pump actuator movable relative the housing in the cycle of operation to activate the pump to draw and dispense the fluid, a rasp actuator movable relative the housing in the cycle of operation to move the rasp member relative the housing to disengage the particles, a driven member for movement relative the housing in the cycle of operation either manually or by a motor, with the driven member mechanically coupled to the pump actuator and the rasp actuator whereby movement of the driven member in the cycle of operation moves the pump actuator relative the housing to displace the fluid and moves the rasp actuator relative the housing to move the rasp member relative the body to disengage the particles.

Preferably, the dispenser includes an advance mechanism to urge the rasp and the block into engagement, for example, radially or axially relative the direction of movement of the pump actuator.

The advance mechanism can include a resilient spring member biasing the rasp and the block into engagement. When the pump is a piston pump with a piston member movable relative the body, the rasp may be disposed between the body and the piston member and be coupled to either the body or the piston member whereby with axial sliding movement of the rasp, the rasp is rotated about the axis.

The present invention also provides a cartridge carrying a solid material to be eroded by a rasp member. The cartridge comprises a plurality of segments of the solid material arranged circumferentially spaced about an axis in a circle. Each segment extends radially inwardly relative the axis from a radially outwardly directed outer surface to a radially inwardly directed for engagement with a rasp member centered within the segments. A guide mechanism engages each segment to guide each segment for radial movement of the segment towards the axis as the inner surface is eroded by a rasp member without interference between adjacent of the segments. A circumferential band of resilient material encircles the segments, engaging the outer surface of each and biasing each segment to move radially toward the axis. Preferably, the guide mechanism includes a guide plate with a plurality of radially extending guide tongues circumferentially spaced in a circle about the axis. Each segment has a radially extending guide slot. Each guide tongue engages one of the guide slot in respective one of the segments to guide each segment in sliding radially inwardly from a forts position in which the outer surfaces are spaced a first distance from the axis to a second position in which the outer surfaces are spaced a second distance from the axis less than the first distance. Preferably, an axially extending space is provided circumferentially between each adjacent of the segments. The space is sufficient to permit each segment to move radially toward the axis as its inner surface is abraded by the rasp without engaging adjacent segments.

The present invention also provides a diaphragm pump comprising a resilient diaphragm member defining at least a portion of the periphery of a variable volume diaphragm chamber, and a plunger member movable relative to the diaphragm member. Movement of the plunger member deflects the diaphragm changing the volume of the diaphragm chamber. The pump includes a tubular valve casing elongate along a casing axis and defining a value chamber therein. The valve chamber has an inner wall circular in cross-section along the axis, a first end and a second end. The valve chamber is closed at the first end. The valve chamber is closed at the second end. A valve member is coaxially located within the valve chamber. The valve member comprises a stem extending axially within the valve chamber. An inlet disc extends radially outwardly from the stem to a distal end in engagement with wall. The inlet disc engages the wall to prevent fluid flow axially therepast in a direction from the first end towards the second end. The inlet disc is resiliently deflectable to be deflected from engaging the wall to permit fluid flow axially therepast in a direction from the second end towards the first end. An outlet disc extends radially outwardly from the stem to a distal end in engagement with wall. The outlet disc engages the wall to prevent fluid flow axially therepast in a direction from the first end towards the second end. The outlet disc is resiliently deflectable to be deflected from engaging the wall to permit fluid flow axially therepast in a direction from the second end towards the first end. The inlet disc is spaced axially away from the first end from the outlet disc. The outlet disc is spaced axially away from the second end from the inlet disc. An inlet is provided into the valve chamber between the second end and the inlet disc. An outlet is provided from the valve chamber between the first end and the outlet disc. A fluid transfer port is provided in communication with the diaphragm chamber and open into the valve chamber in between the inlet disc and the outlet disc.

Preferably, movement of the plunger member deflects the diaphragm changing the volume of the diaphragm chamber thereby drawing the fluid into the diaphragm chamber via the transfer port from the valve chamber in an inlet stroke and discharging the fluid from the diaphragm chamber via the transfer port into the valve chamber in a discharge stroke. On drawing the fluid into the diaphragm chamber via the transfer port from the valve chamber a vacuum is created within the valve chamber between the inner disc and the outer disc which acts on the inner disc to deflect the inner disc from engaging the wall permitting the fluid to be drawn inwardly from the inlet opening past the inner disc. On discharging the fluid from the diaphragm chamber via the transfer port into the valve chamber pressure is created within the valve chamber between the inner disc and the outer disc which acts on the outer disc to deflect the outer disc from engaging the wall permitting the fluid to be discharged outwardly past the outer disc to the outlet opening.

Preferably, the valve casing is open at the first end, the valve stem carries a first sealing disc which engages the valve casing to close the first end of valve chamber. Preferably, the valve casing is open at the second end, and the valve stem carries a sealing disc which engages the valve casing to close the second end of valve chamber. The valve casing may be closed at the second end by an end wall with the valve stem having a second end which engages the end wall of the valve casing to assist in axially locating the valve stem relative the valve casing.

Preferably, the valve member is injection molded as a unitary element from resilient material. Also preferably, the valve casing is injection molded as a unitary element. The valve member and the valve casing interact to provide a one-way inlet valve and a one-way outlet valve yet may be conveniently made from but two injection molded unitary elements.

In one aspect, the present invention provides a pump assembly for dispensing of a fluid and of particles of a solid material comprising:

a fluid pump which in a cycle of operation draws the fluid through a fluid inlet and dispenses the fluid out a fluid outlet, a block of the solid material coalesced together, a rasp member, which during the cycle of operation, moves relative the rasp in engagement with the block whereby the rasp member disengages particles of the solid material from the block which particles drop under gravity downwardly adjacent the fluid outlet.

In another aspect, the present invention provides a dispenser for simultaneous dispensing of a fluid and particles of a solid material comprising:

a reservoir containing the fluid, a piston pump having a piston chamber-forming body forming a chamber therein and a piston-forming element reciprocally coaxially slidable in the chamber for movement between a retracted position and an extended position relative the piston chamber-forming body, the piston element and the piston chamber-forming element are coaxially reciprocally slidable about an axis, wherein in a cycle of operation the pump draws the fluid from the reservoir into the chamber and dispenses the fluid out an outlet carried on the piston-forming element extending out an open end of the chamber, a block of the solid material coalesced together, the block carried by the piston chamber-forming body, a rasp carried by the piston forming member, the rasp and the piston-forming element mechanically linked whereby coaxial sliding movement of the piston-forming element relative the piston chamber-forming body moves of the rasp relative the block whereby the rasp erodes the block by disengaging the particles from the block, a particle discharge chute receiving the particles disengaged from the block and directing the particles under gravity downwardly to a particle exitway adjacent the outlet.

In another aspect, the present invention provides a dispenser comprising:

a piston assembly having a piston chamber-forming body and a piston-forming element reciprocally coaxially slidable relative the piston chamber-forming body for movement between a retracted position and an extended position, the piston element and the piston chamber-forming element are coaxially reciprocally slidable about an axis, a block of the solid material coalesced together, the block carried by the piston chamber-forming body, a rasp carried by the piston-forming member, the rasp and the piston-forming element mechanically linked whereby coaxial sliding movement of the piston-forming element relative the piston chamber-forming body moves of the rasp relative the block whereby the rasp erodes the block by disengaging the particles from the block, a particle discharge chute receiving the particles disengaged from the block and directing the particles under gravity downwardly to a particle exitway.

In a $1^{st}$ feature, the present invention provides a pump assembly for dispensing of a fluid and of particles of a solid material comprising:

a fluid pump which in a cycle of operation draws the fluid through a fluid inlet and dispenses the fluid out a fluid outlet, a block of the solid material, a pump housing body, the fluid pump including a movable member mounted to the body for reciprocal movement relative the body parallel to an axis in the cycle of operation to draw and dispense the fluid, the block received axially between the body and the movable member presenting a first axially directed surface directed toward the movable member, a rasp member comprising a resilient finger member having a first end and a distal end, the first end of the finger member coupled to the movable member to move axially relative the axis with the movable member, the finger member extending from the first end axially away from the first end and radially outwardly from the axis to the distal end which carries an axially directed rasp surface directed axially toward the first axially directed surface of the block in opposition to the first axially directed surface of the block, the axially directed rasp surface and the first axially directed surface of the block biased axially into engagement with each other, in the cycle of operation, when the body and the movable member move axially toward each other, the finger member is axially compressed between the first axially directed surface of the block and the movable member and the finger member resiliently deflects between the first end and the distal end against an inherent bias of the finger member reducing the axial length between the first end and the distal end and moving the distal end radially outwardly, in the cycle of operation, when the body and the movable member move axially away each other, under the inherent bias of the finger member, the finger member deflects between the first end and the distal end increasing the axial length between the first end and the distal end and moving the distal end radially inwardly, wherein during the cycle of operation the rasp surface in engagement with the first axially directed surface of the block moves radially relative the first axially directed surface of the block disengaging particles of the solid material from the block at a location that the particles drop under gravity downwardly adjacent the fluid outlet.

In a $2^{nd}$ feature, the present invention provides a pump assembly as in the $1^{st}$ feature wherein the body carries a collar for securing the pump assembly to an opening to a container comprising a reservoir for the fluid.

In a $3^{rd}$ feature, the present invention provides a pump assembly as in the $2^{nd}$ feature wherein a fluid inlet of the fluid pump is in communication through the collar with the fluid in the reservoir.

In a $4^{th}$ feature, the present invention provides a pump assembly as in the $3^{rd}$ feature wherein the fluid pump is selected from a piston pump and a diaphragm pump.

In a $5^{th}$ feature, the present invention provides a pump assembly as in the $1^{st}$ feature wherein the body carrying a solid material cage enclosing the block separated from the fluid, the cage including a solid material discharge tube guiding the particles discharged from the block by the rasp member to a solid material discharge outlet proximate the fluid outlet while maintaining the particles separated from the fluid until exiting from the solid material discharge outlet.

In a $6^{th}$ feature, the present invention provides a pump assembly as in the $1^{st}$ feature wherein the fluid pump is a piston pump, the body carries a chamber-forming center tube coaxially about the axis defining a fluid chamber therein, the fluid chamber having a closed axially inner end and an open outer end, the movable member comprising a piston coaxially slidable received in the fluid chamber with an outer end of the piston extending outwardly of the open outer end of the fluid chamber to the discharge outlet at the outer end of the piston, the piston coaxially slidable along the axis within the fluid chamber between an extended position and a retracted position and movable in the cycle of operation between the extended position and the retracted position to draw the fluid into the fluid chamber and to discharge the fluid out the discharge outlet.

In a $7^{th}$ feature, the present invention provides a pump assembly as in the $6^{th}$ feature wherein:

the block is an annular member with a central opening therethrough, the block disposed coaxially about the axis annularly and radially outwardly about the chamber-forming tube with the first axially directed surface of the block directed axially outwardly, the first end of the finger member fixedly coupled to the piston proximate the outer end of the piston with the finger member extending from the first end axially away from the first end and radially outwardly of the chamber-forming tube to the distal end placing the axially directed rasp surface in engagement with the first axially directed surface of the block.

In an $8^{th}$ feature, the present invention provides a pump assembly as in the $7^{th}$ feature wherein:

the body has an annular end wall coaxial about the axis that carries a chamber-forming center tube, the end wall extending radially outwardly from the center tube, the block disposed axially outwardly of the end wall.

In a $9^{th}$ feature, the present invention provides a pump assembly as in the $8^{th}$ feature wherein:

the block having a second axially directed surface directed axially inwardly, a spring member disposed between the end wall and the second axially directed surface of the block biasing the block axially outwardly into engagement with the axially directed rasp surface on the distal end of the finger member.

In a $10^{th}$ feature, the present invention provides a pump assembly as in the $8^{th}$ feature wherein:

the annular end wall extending radially outwardly from the center tube to a circumferential outer end of the annular end wall, a chute tube extending coaxially from the circumferential outer end of the annular end wall axially outwardly to an open annular particle discharge outlet coaxially about the discharge outlet at the outer end of the piston, an annular compartment defined radially between the chute tube and the chamber-forming center tube within which the annular block is coaxially received.

In an $11^{th}$ feature, the present invention provides a pump assembly as in the $10^{th}$ feature wherein:

the axially directed rasp surface is directed axially inwardly in engagement with the first axially directed surface of the block, openings through the finger member over the distal end of the finger member sized to permit particles of the of the solid material disengaged by the rasp surface to pass through the finger member into the annular compartment radially outwardly of the finger member, the chute tube guiding particles of the solid material in the annular compartment radially outwardly of the finger member to pass under gravity outwardly in the chute tube to the annular particle discharge outlet annularly outwardly of the finger member and the piston.

In a $12^{th}$ feature, the present invention provides a pump assembly as in the $7^{th}$ feature including a plurality of said finger members secured spaced from each circumferentially about the piston.

In a $13^{th}$ feature, the present invention provides a pump assembly as in the $11^{th}$ feature including a plurality of said finger members secured spaced from each circumferentially about the piston, each finger member providing the rasp surface over a partial circumferential segment of the first axially directed surface of the block.

In a $14^{th}$ feature, the present invention provides a pump assembly as in the $1^{st}$ feature in combination with a container containing the fluid, wherein the body is secured to an opening to the container providing for communication of the fluid in the container to the fluid pump.

In a $15^{th}$ feature, the present invention provides a pump assembly as in the $1^{st}$ feature including a particle discharge chute receiving the particles disengaged from the block and directing the particles under gravity downwardly to a particle exitway adjacent the discharge outlet.

In a $16^{th}$ feature, the present invention provides a pump assembly as in the $1^{st}$ feature including a biasing mechanism to urge the rasp and the block axially into engagement.

In a $17^{th}$ feature, the present invention provides a pump assembly as in the $16^{th}$ feature wherein the biasing mechanism comprises a resilient spring member disposed between the body and the block engaging a second axially directed surface of the block opposite to the first axially directed surface of the block to urge the block axially toward the rasp.

In an $18^{th}$ feature, the present invention provides a dispenser for dispensing of a fluid and particles of a solid material comprising a pump assembly as in the $1^{st}$ feature in combination with:

a reservoir containing the fluid in which the fluid pump in the cycle of operation draws the fluid from the reservoir and dispenses the fluid out the discharge outlet.

In a $19^{th}$ feature, the present invention provides a dispenser as in the $18^{th}$ feature including:

a dispenser housing;

a pump actuator movable relative the housing in the cycle of operation to activate the pump to draw and dispense the fluid, a driven member for movement relative the housing in the cycle of operation either manually or by a motor, the driven member mechanically coupled to the pump actuator whereby movement of the driven member in the cycle of operation moves the pump actuator relative the housing to displace the fluid and to move the rasp member relative the body to disengage the particles.

In a 20$^{th}$ feature, the present invention provides an assembly for dispensing particles of a solid material comprising:

a body, a movable member mounted to the body for reciprocal movement relative the body parallel to an axis in a cycle of operation, a block of the solid material coalesced together, the block received axially between the body and the movable member presenting a first axially directed surface directed toward the movable member, a rasp member mounted to the movable member body for movement with the movable member relative the body in the cycle of operation, the rasp member comprising a resilient finger member having a first end and a distal end, the first end of the finger member coupled to the movable member to move axially relative the axis with the movable member, the finger member extending from the first end axially away from the first end and radially outwardly from the axis to the distal end which carries an axially directed rasp surface directed axially toward the first axially directed surface of the block in opposition to the axially directed surface of the block, the axially directed rasp surface and the axially directed surface of the block biased axially into engagement with each other, in the cycle of operation, when the body and the movable member move axially toward each other, the finger member is axially compressed between the axially directed surface of the block and movable member and the finger member resiliently deflects between the first end and the distal end against an inherent bias of the finger member reducing the axial length between the first end and the distal end and moving the distal end radially outwardly, in the cycle of operation, when the body and the movable member move axially away each other, under the inherent bias of the finger member the finger member deflects between the first end and the distal end increasing the axial length between the first end and the distal end and moving the distal end radially inwardly, wherein during the cycle of operation the rasp surface in engagement with the axially directed surface of the block moves radially relative the axially directed surface of the block disengaging particles of the solid material from the block.

In a 21$^{st}$ feature, the present invention provides an assembly as in the 20$^{th}$ feature including:

a solid material discharge tube including a solid material discharge outlet, the solid material discharge tube located below the block to receive particles discharged from the block and guide the particles discharged from the block by the rasp member through the solid material discharge tube to the solid material discharge outlet.

In a 22$^{nd}$ feature, the present invention provides an assembly as in the 21$^{st}$ feature including:

a fluid pump which in a cycle of operation draws fluid through a fluid inlet and dispenses the fluid out a fluid outlet adjacent the solid material discharge outlet.

In a 23$^{rd}$ feature, the present invention provides an assembly as in the 1$^{st}$ feature wherein the block comprise the particles of the solid material coalesced together.

BRIEF DESCRIPTION OF THE DRAWINGS

Further objects and advantages of the invention will appear from the following description taken together with the accompanying drawings in which.

DETAILED DESCRIPTION OF THE DRAWINGS

Figure 1:
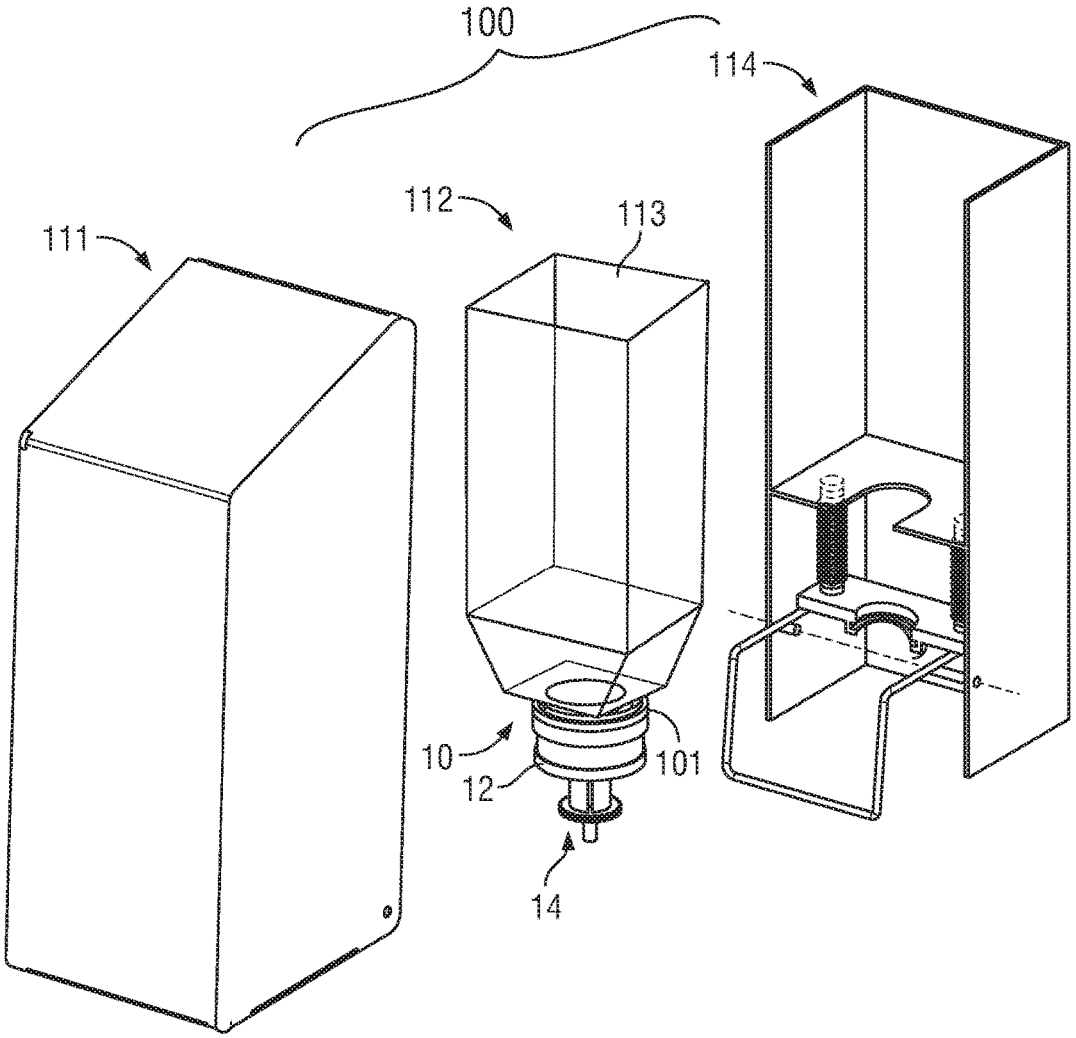
FIG. 1 is a perspective view of a first preferred embodiment of a dispenser in accordance with the invention.

Reference is made first to FIG. 1 which shows a dispenser 100 in accordance with a preferred embodiment of the invention. The dispenser 100 comprises a cover 111, a reservoir cartridge 112, and a housing 114. The cover 111 is coupled to the housing 114 preferably for pivoting movement between an open position and closed position to permit the reservoir cartridge 112 to be removably coupled to the housing 114 in a compartment defined between the cover 111 and the housing 114 as, for example, in a manner similar to that disclosed in U.S. Pat. No. 8,272,540 to Ophardt et al, issued Sep. 25, 2012, the disclosure of which is incorporated herein by reference.

The reservoir cartridge 112 comprises a bottle 113 and a piston assembly 10. The bottle 113 has a chamber 116 for holding fluid 118 as, for example, liquid soap which is to be dispensed. An outlet 120 is provided through a 119 neck of the bottle 113 carried on a lowermost wall of the chamber 116, across which is located the piston assembly 10 which, amongst other things, dispenses the fluid 118 outwardly therethrough. Preferably, the reservoir cartridge 112 is disposable once the supply of fluid 118 is exhausted. The piston assembly 10 includes a piston chamber-forming member or body 12 and a piston-forming element or piston 14. The piston 14 is coupled to the body 12 for coaxially reciprocal sliding between an extended position and a retracted position to dispense material. The body 12 has an annular collar 39 for sealed engagement with the neck 119 of the bottle 113. A radially inwardly extending annular support slotway 101 is provided circumferentially about the collar 39.

FIG. 1 shows the housing 114 in an open configuration ready for insertion of the reservoir cartridge 112. The housing 114 includes a backplate 121 typically adapted for permanent attachment to a wall. A pair of side walls 123 extends vertically forwardly from each side of the backplate 121. A support flange 124 is provided extending horizontally between the side walls 123 so as to define a cavity 125 above the flange 124 between the side walls 123 and the backplate 121 to receive the reservoir cartridge 112.

The flange 124 has an opening 126 vertically therethrough in the form of a U-shaped slot 127 closed at a rear blind end 128 and open forwardly to the front edge 129 of the flange 124.

An actuator assembly 130 is provided on the housing 114 movable relative to the housing. The actuator assembly 130 includes notably a pivoting lever 131 and an actuator plate 132 mounted to the housing 114 to be vertically slidable. Pivoting of the lever 131 moves the vertically slidable actuator plate 132 linearly on a pair of vertically extending guide rods 133 against the bias of springs 134 disposed about the guide rods 133. The actuator plate 132 has a U-shaped slot opening 137 vertically therethrough closed at a rear blind end 139 and open forwardly to the front edge 140 of the actuator plate 132. A circumferentially extending catch channelway 138 is provided around a side wall of the opening 137 with the channelway 138 extending from a radially inwardly directed opening radially inwardly to a blind end. The channelway 138 is adapted to engage a radially outwardly extending engagement flange 17 on the piston 14.

The two parallel spaced locating rods 133 are fixedly secured at their upper ends 141 to flange 124 and extend downwardly to their lower ends 142 to which respective retaining ferrules 143 are secured. The actuator plate 132 has a pair of cylindrical bores through which the rods 133 pass. The actuator plate 132 is disposed on the rods 133 above the ferrules 143.

Springs 134 are provided about each of the locating rods 133. The springs 134 have an upper end which engage the flange 124 and a lower end which engage an upper surface of actuator plate 132 to resiliently bias the actuator plate 132 away from the flange 124 downwardly toward a fully extended position shown in FIGS. 1 to 3.

The actuator assembly 130 includes the lever 131 which is pivotally connected to the housing 114 for pivoting about a horizontal axis 146. The lever 130 is U-shaped having a pair of side arms 147 connected at their front by a horizontal connecting bight 148. A pair of horizontal stub axles 149 extend laterally outwardly from the side arms 147 and are received in holes 150 through the side walls 123 to journal the lever 131 to the housing 114 for pivoting about the axis 146.

A rear end 151 of the lever 131 engages a lower surface of the actuator plate 132. Manual urging of the bight 148 of the lever 131 rearwardly by a user moves the actuator plate 132 upwardly against the bias of the springs 133 from the extended position shown in FIG. 2 to a retracted position not shown. On release of the lever 131, the force of the springs 133 returns the actuator plate 132 to the extended position.

As seen in FIGS. 3 to 7, the piston assembly 10 includes the piston chamber-forming member or body 12 and the piston-forming element or piston 14. The reciprocally movable piston-forming element 14 is slidably received within the piston chamber-forming member 12. The piston-forming element 14 has an axially extending stem 15 which extends outwardly from the piston chamber-forming member 12 to a fluid discharge outlet 16.

The piston-forming element 14 has on the stem 15 proximate its outermost end the generally circular and radially outwardly extending engagement flange 17.

The opening 126 of the flange 124 is positioned to permit the reservoir cartridge 112 to be slid rearwardly inward into the housing 114 in the manner illustrated in FIG. 1 with the piston-forming element 14 in an extended position as shown. When the reservoir cartridge 112 is slid into the housing 114, the flange 124 engages in the support slotway 101 on the collar 39 of the piston chamber-forming member 12 and the engagement flange 17 of the piston-forming element 14 engages in the channelway 138 of the actuator plate 132. The flange 124 engages the support slotway 101 on the collar 39 of the body 12 to support the body 12 and the bottle 113 of the reservoir cartridge 112 in a fluid dispensing position with the flange 124 preventing axial sliding movement of the piston chamber-forming member 12 and the bottle 113 as the dispenser 100 is used. The U-shape of the opening 126 of the flange 124 assists in guiding the reservoir cartridge 112 as it is inserted into and removed horizontally from the housing 114.

Figure 3:
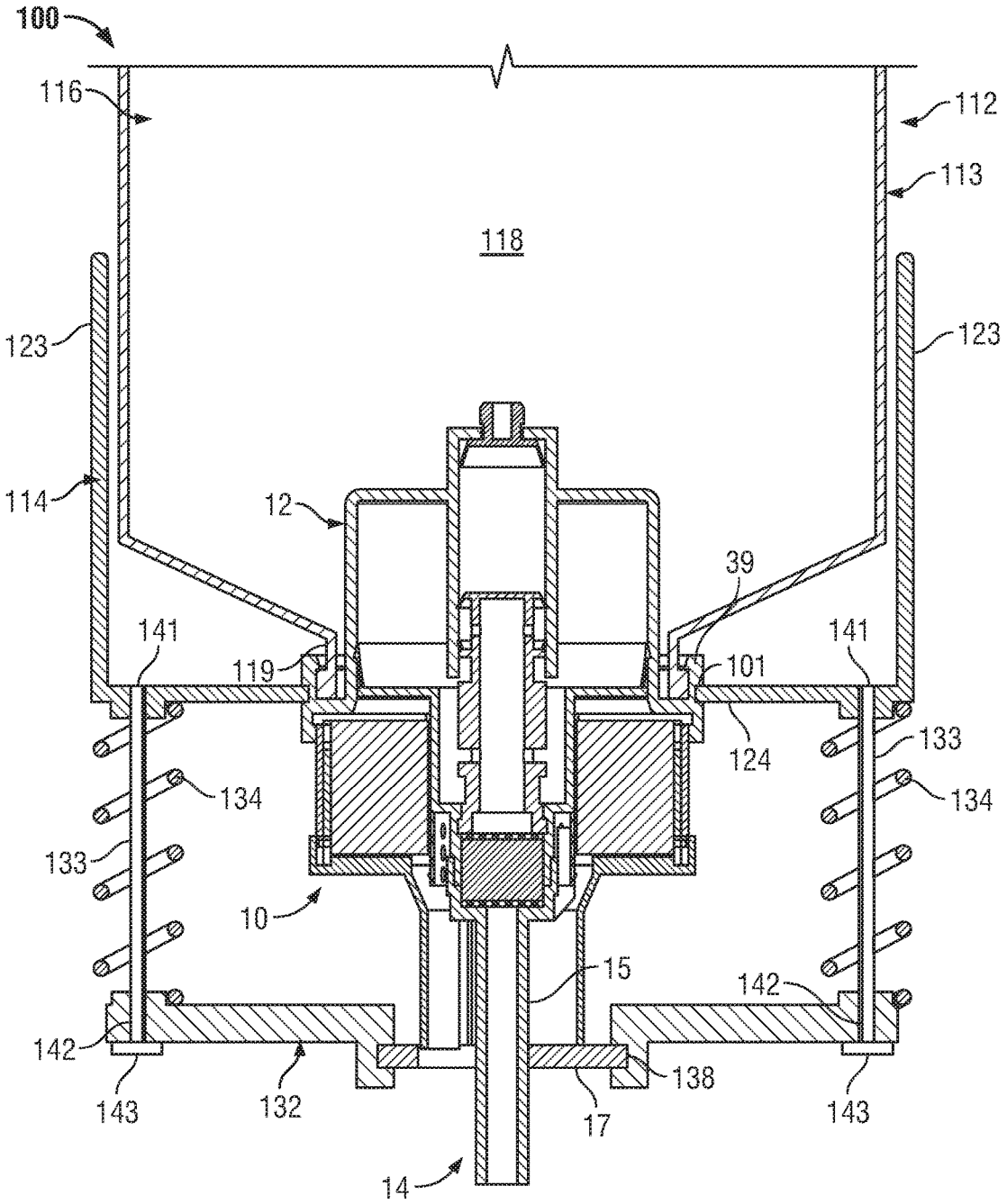
FIG. 3 is a partial cross-sectional front view of the housing and reservoir of FIG. 1 in a coupled orientation with an actuator assembly of the housing and a reciprocally movable piston element of the reservoir in a fully extended rest position.

As seen in a coupled orientation in FIG. 3 with the engagement member 17 on the piston-forming element 14 within the channelway 138 on the actuator 132, the piston-forming element 14 is engaged with the actuator plate 132 with the actuator plate 132 disposed about the stem 15 such that with reciprocal movement of the actuator plate 132 between the extended position and the retracted position results in corresponding movement of the piston-forming element 14 relative the piston chamber-forming member 12 to dispense material from the reservoir cartridge 112.

Figure 4:
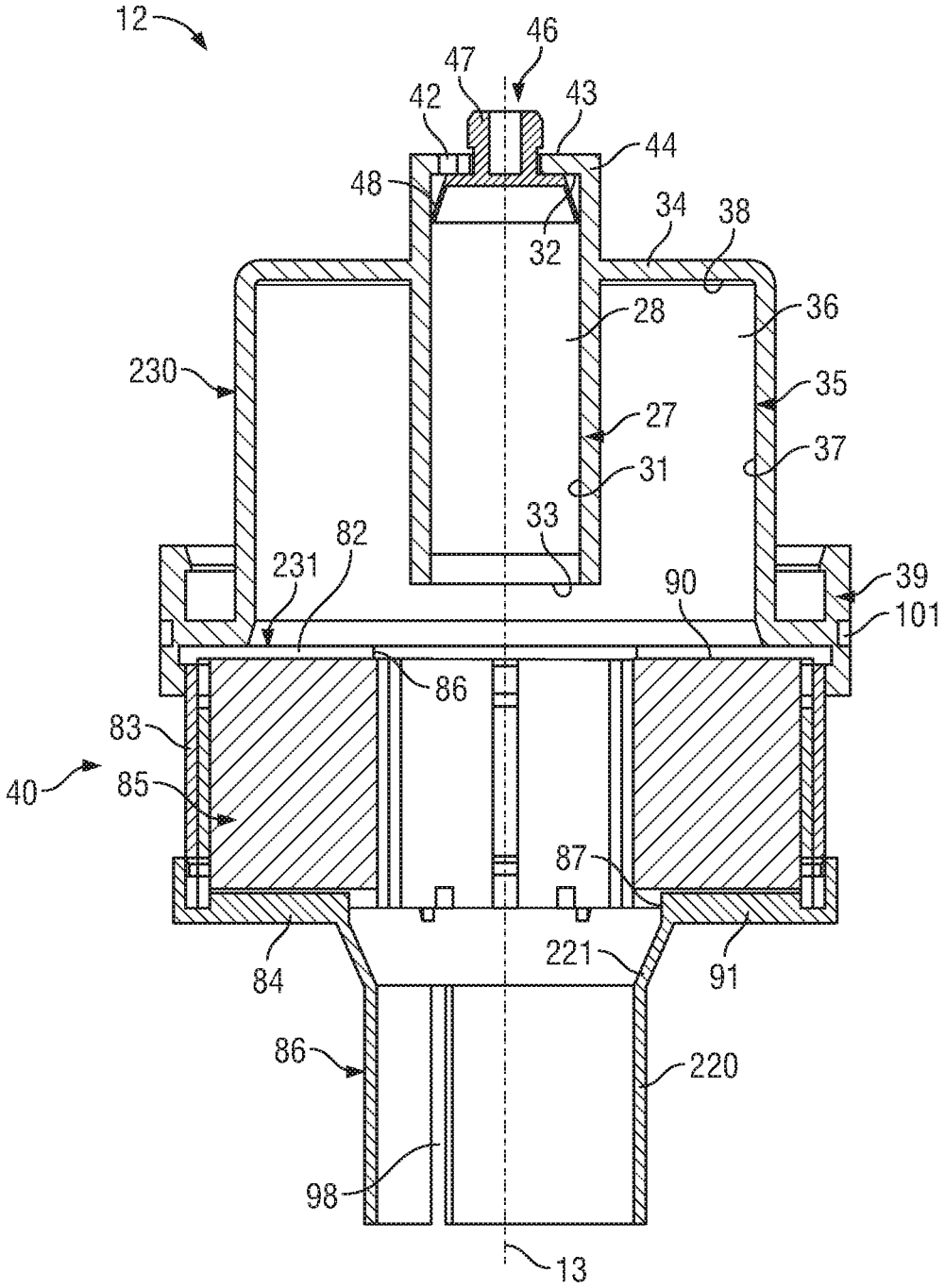
FIG. 4 is an enlarged cross-sectional view of the piston chamber-forming member of the pump assembly shown in FIG. 3.

As seen in FIG. 4, the piston chamber-forming member 12 includes an interior center tube 27 which provides a cylindrical liquid chamber 28 having a cylindrical inner chamber wall 31, an inner end 32 and an open outer end 33. An annular end wall 34 of the body 12 couples the center tube 27 with an exterior tube 35 which provides a cylindrical air chamber 36 annularly about the center tube 27. The exterior tube 35 has a cylindrical outer chamber wall 37, an inner end 38 closed by the annular end wall 34 and an open outer end.

The exterior tube 35 merges radially outwardly into the collar 39. The collar 39 supports a solid material cage 40 which opens axially outwardly into a solid material discharge chute 41.

An inlet opening 42 to the liquid chamber 28 is provided in the inner end 32 of the liquid chamber 28 in communication with the bottle 113. A flange 43 extends across the inner end 32 having a central opening 44 and the inlet 42 therethrough. A one-way valve 46 is disposed across the inlet opening 42. The inlet opening 42 provides communication through the flange 43 with fluid in the bottle 113. The one-way valve 46 permits fluid flow from the bottle 113 into the liquid chamber 28 but prevents fluid flow from the liquid chamber 28 to the bottle 113. The one-way valve 46 comprises a shouldered button 47 which is secured in snap-fit relation inside the central opening 44 in the inner end 32 with a circular resilient flexing disc 48 extending radially from the button 47. The flexing disc 48 is sized to circumferentially abut the cylindrical inner chamber wall 31 substantially preventing fluid flow there past from the liquid chamber 28 to the bottle 113. The flexing disc 48 is deflectable away from the inner chamber wall 31 to permit flow from the bottle 113 through the inlet opening 45 into the liquid chamber 28.

The piston 14 is axially slidably received in the body 12 for reciprocal sliding motion inward and outwardly therein coaxially along the central axis 13. The piston 14 is generally circular in cross-section. The piston 14 has the hollow stem 15 extending along the central axis 13.

A circular resilient flexing inner disc 50 is located at an inner end 51 of the piston 14 and extends radially therefrom. The inner disc 50 extends radially outwardly on the stem 15 to circumferentially engage the chamber wall 31 of the liquid chamber 28. The inner disc 50 is sized to circumferentially abut the chamber wall 31 to substantially prevent fluid flow therebetween inwardly. The inner disc 50 has a resilient distal annular end position is biased radially outwardly, however, is adapted to be deflected radially inwardly so as to permit fluid flow past the inner disc 50 outwardly.

An outer circular outer disc 52 is located on the stem 15 spaced axially outwardly from the inner disc 50. The outer disc 52 extends radially outwardly on the stem 15 to circumferentially engage the chamber wall 31 of the liquid chamber 28. The outer disc 52 is sized to circumferentially abut the chamber wall 31 to substantially prevent fluid flow therebetween outwardly. The outer disc 52 is biased radially outwardly, however, may optionally be adapted to be deflected radially inwardly so as to permit fluid flow past the outer disc 52 inwardly. Preferably, the outer disc 52 engages the chamber wall 31 to prevent flow there past both inwardly and outwardly.

A circular air disc 54 is located on the stem 15 spaced axially outwardly from the outer disc 52. The air disc 34 extends radially outwardly on the stem 15 to circumferentially engage the chamber wall 37 of the air chamber 36. The air disc 54 is sized to circumferentially abut the chamber wall 37 to substantially prevent fluid flow therebetween outwardly. The air disc 54 is biased radially outwardly, however, may optionally be adapted to be deflected radially inwardly so as to permit air flow past the air disc 54 inwardly. Preferably, the air disc 54 engages the chamber wall 37 to prevent flow there past both inwardly and outwardly.

The piston stem 15 has a hollow central outlet passageway 56 extending along the axis 13 of the piston 14 from a closed inner end 57 to the fluid discharge outlet 16 at an outer end 58 of the piston 14. A liquid port 59 extends radially from an inlet 60 located on the side of the stem 15 between the inner disc 50 and the outer disc 52 inwardly through the stem 15 into communication with the central passageway 56. The liquid port 59 and central passageway 56 permit fluid communication through the piston 14 past the outer disc 52 between the inlet 60 and the liquid discharge outlet 16.

An air port 61 extends radially from an inlet 62 located on the side of the stem 15 between the outer disc 52 and the air disc 54 inwardly through the stem 15 into communication with the central passageway 56. The air port 61 and central passageway 56 permit fluid communication through the piston 14 between the air chamber 36 and the liquid discharge outlet 16.

Within the central passageway 56 axially outwardly of the air port 54 and between the air port 54 and the liquid discharge outlet 16, a foam generator 63 is provided which provides small openings therethrough. In a known manner on simultaneous passage of air and liquid through the foam generator, the air and liquid are mixed to produce foam. The foam generator 63 may preferably comprise a pair of screens 64 and 65 with small openings and a porous plug 66 of foamed plastic with open pores therethrough supported between the screens 64 and 65.

Figure 6:
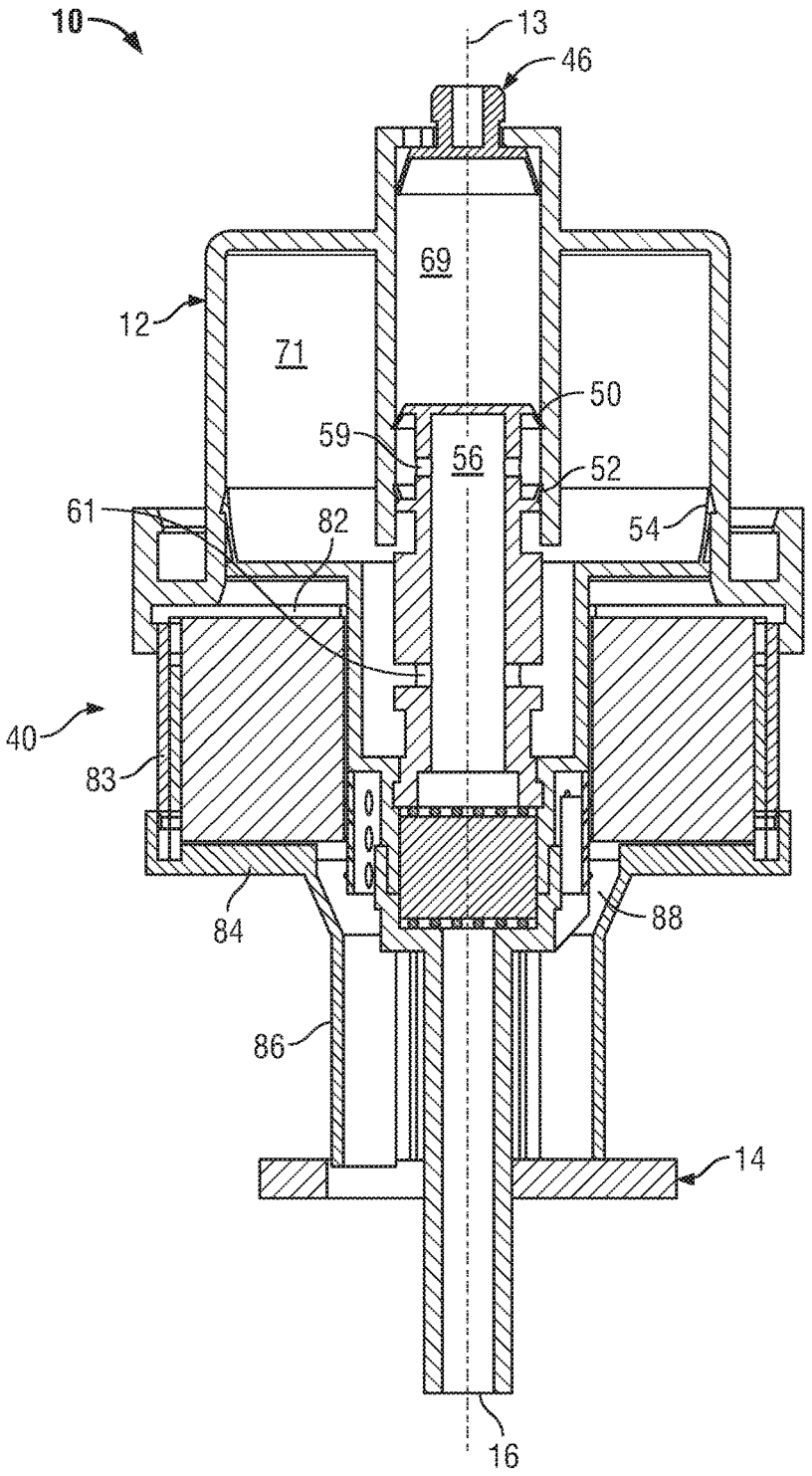
FIG. 6 is an enlarged view of the piston assembly of FIG. 3 in an extended position.
Figure 7:
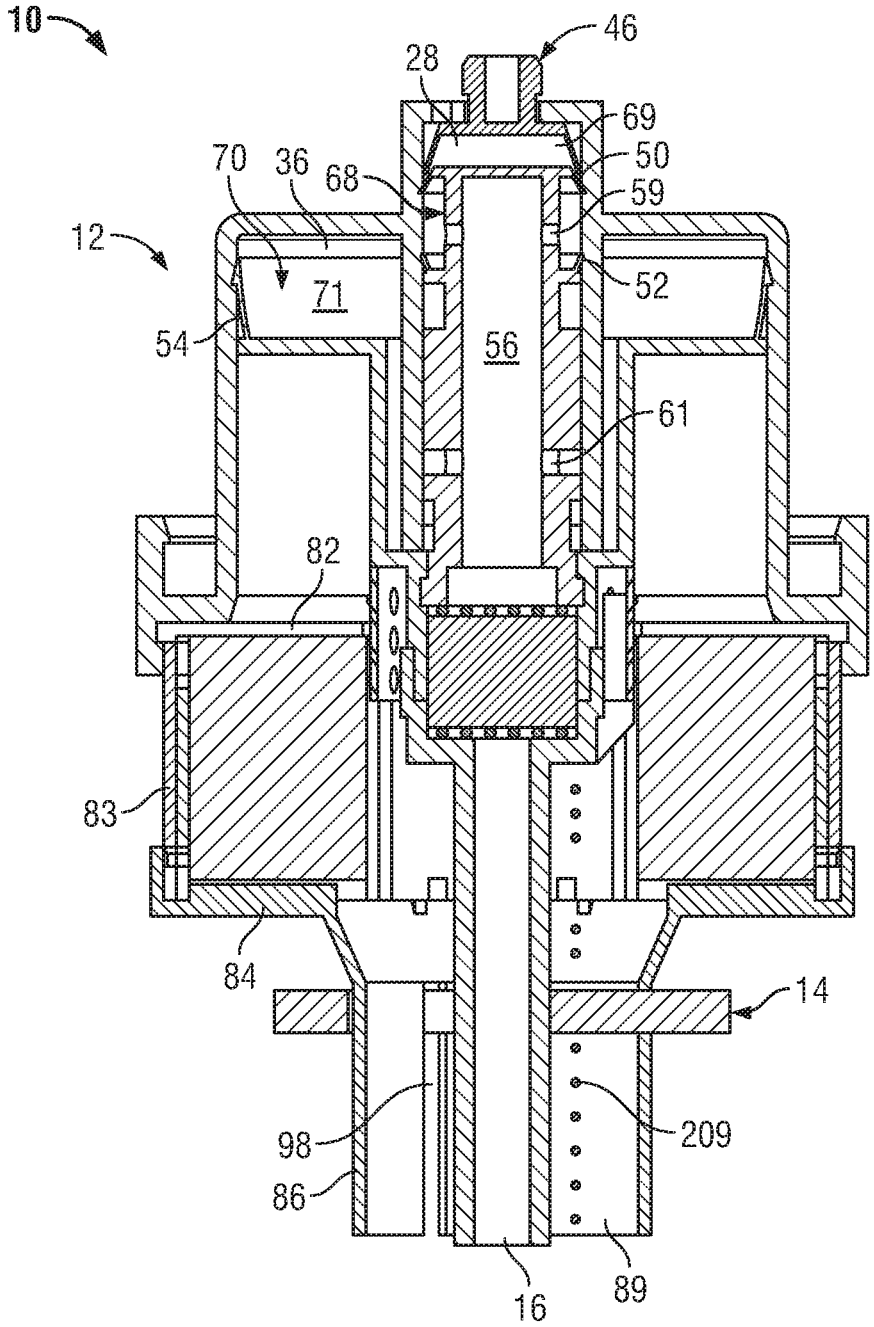
FIG. 7 is an enlarged cross-sectional view of the piston assembly of FIG. 6, however, in a retracted position.

The piston 14 is slidably received in the body 12 for reciprocal axial inward and outward movement therein in a stroke of movement between a fully extended position shown in FIG. 6 and the fully retracted position shown in FIG. 7.

The piston 14 is received in the body 12 with a liquid piston portion 67 of the stem 15 carrying the inner disc 50 and the outer disc 52 in the liquid chamber 28 of the center tube 27 forming therewith a liquid pump 68 and the air disc 54 in the air chamber 36 of the exterior tube 35 forming an air pump 70.

The liquid pump 68 provides a liquid compartment 69 defined within the liquid chamber 28 between the one way valve 46 and the outer disc 52 which liquid compartment 69 varies in volume with movement of the piston 14 relative the piston chamber-forming member 12. The air pump 70 provides an air compartment 71 defined within the air chamber 36 between the air chamber 36 and the air disc 54 which air compartment 71 varies in volume with movement of the piston 14 relative the body 12.

A cycle of operation is now described in which the piston 14 is moved from the extended position of FIG. 6 to the retracted position of FIG. 7 in a fluid discharging stroke and then from the retracted position of FIG. 7 to the extended position of FIG. 6 in a fluid charging stroke. The charging stroke and the discharge stroke together comprise a complete cycle of operation.

In the discharge stroke in moving from the extended position of FIG. 6 to the retracted position of FIG. 7, as the piston 14 moves inwardly, the volume of the liquid compartment 69 decreases and fluid within the liquid compartment 69 is compressed between the inner disc 50 and the one-way inlet valve 46. The one-way valve 46 closes under pressure and as pressure is developed within the liquid compartment 69, the inner disc 50 deflects to permit fluid to pass outwardly past the inner disc 50 to between the inner disc 50 and the outer disc 52 and, hence, via the liquid port 59 to the central passageway 56 and out the liquid discharge outlet 16. Thus, in the discharge stroke the inner disc 50 is deflected to permit fluid to pass outwardly past the inner disc 50 and hence out the liquid discharge outlet 16.

In the discharge stroke in moving from the extended position of FIG. 6 to the retracted position of FIG. 7, as the piston 14 moves inwardly, air within the air compartment 71 is compressed between the air chamber 36 and the air disc 54 and as pressure is developed within the air compartment 71 air flows pass outwardly via the air port 61 to the central passageway 56 and then to the liquid discharge outlet 16.

In the discharge stroke the liquid pump 68 and the air pump 70 operate in phase to simultaneously pass liquid and air outwardly through the foam generator 63 to produce foam.

In the charging stroke, as the piston 14 is moved from the retracted position of FIG. 7 outwardly to the extended position of FIG. 6, the air disc 54 engages the chamber wall 37 of the air chamber 36 so as to prevent fluid flow inwardly there past. As a result, the volume of the air compartment 71 increases, a vacuum is created within the air compartment 71 which vacuum draws fluid inwardly from through the central passageway 56 from the fluid discharge outlet 16.

In the charging stroke, as the piston 14 is moved from the retracted position of FIG. 7 outwardly to the extended position of FIG. 6, the outer disc 52 engages the chamber wall 31 so as to prevent fluid flow inwardly there past. As a result, the volume of the liquid compartment 69 increases, a vacuum is created within the liquid compartment 69 inwardly of the outer disc 52 between the outer disc 52 and the one-way valve 46 which vacuum draws fluid inwardly to open the one-way valve 46 and draw fluid from the bottle 113 into the liquid chamber 28.

Figure 5:
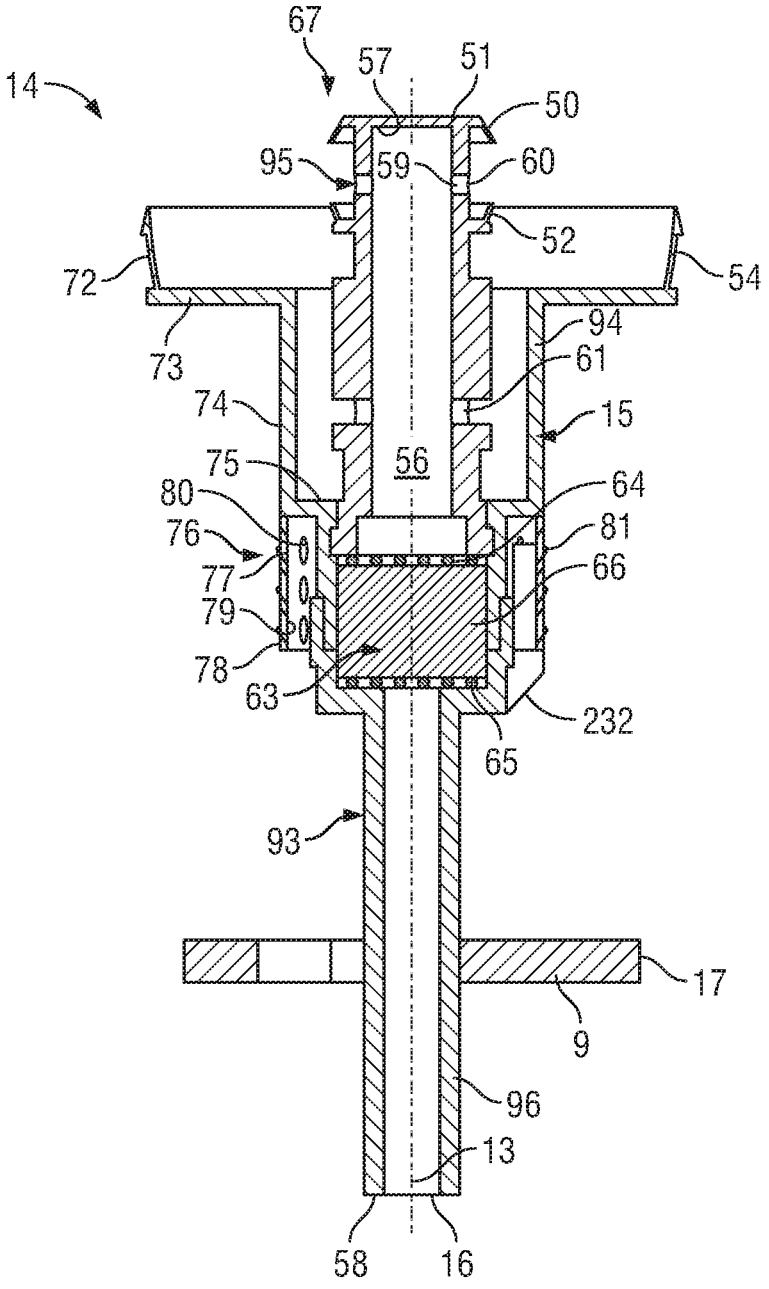
FIG. 5 is an enlarged cross-sectional view of the piston-forming element of the piston assembly shown in FIG. 3.

As seen in FIG. 5, the air disc 54 includes a distal end portion 72, an annular inner flange portion 73, a tubular portion 74 and an outer annular outer flange portion 75. The distal end portion 72 of the air disc 54 engages the chamber wall 37 and is supported at the radially outer end of the annular inner flange portion 73. The annular inner flange portion 73 is supported at its radially inner end by an axially inner end of the tubular portion 74. An axially outer end of the tubular portion 74 is connected to the stem 15 by the annular outer flange portion 75.

A cylindrical rasp member 76 is supported on the stem 15 axially outwardly of the annular inner flange portion 73 of the air disc 54. The rasp member 76 is in the form of a cylindrical rasp tube 77 with a radially outwardly directed outer surface 78 and a radially inwardly directed inner surface 79. An array of openings 80 are provided through the rasp tube 77 and a rasp prong 81 is carried by the rasp tube 77 adjacent each opening 80. The outer surface 78 is disposed in a cylindrical plane, however, with the rasp prongs 81 extending radially outwardly from the cylindrical plane. The outer surface 78 of the rasp tube 77 is preferably an axial extension of the tubular portion 74 of the air disc 54.

The body 12 carries a solid material cage 40 which has an axially inner annular roof member 82, a cylindrical side wall forming wall tube 83 and an axially outer annular floor member 84. The wall tube 83 fixedly secures the roof member 82 to the floor member 84 defining an annular cage cavity 85 therebetween coaxially about the piston 14. The roof member 82 has a central opening 86 therethrough of a diameter marginally greater than the tubular portion 74 of the air disc 54 and the rasp member 76. A tubular chute tube 86 extends downwardly from the floor member 84 with a central opening 87 through the floor member 84 opening into inside the chute tube 86. The central opening 87 through the floor member 84 has of a diameter greater than the tubular portion of the air disc 54 and the rasp member 76. An annular chute passage 88 is provided through the floor member 84 radially outwardly of the piston 14 from the annular cage cavity 85 to a lower open annular particle discharge outlet 89.

The roof member 82 carries an axially outwardly directed roof surface 90 disposed in a flat plane normal to the axis 13. The floor member 84 carries an axially inwardly directed floor surface 91 disposed in a flat plane normal to the axis 13 with six elongate radially extending floor guide tongues 92, best seen in FIG. 9, protruding axially inwardly from floor surface 91 equally spaced circumferentially about the axis 13.

Figure 8:
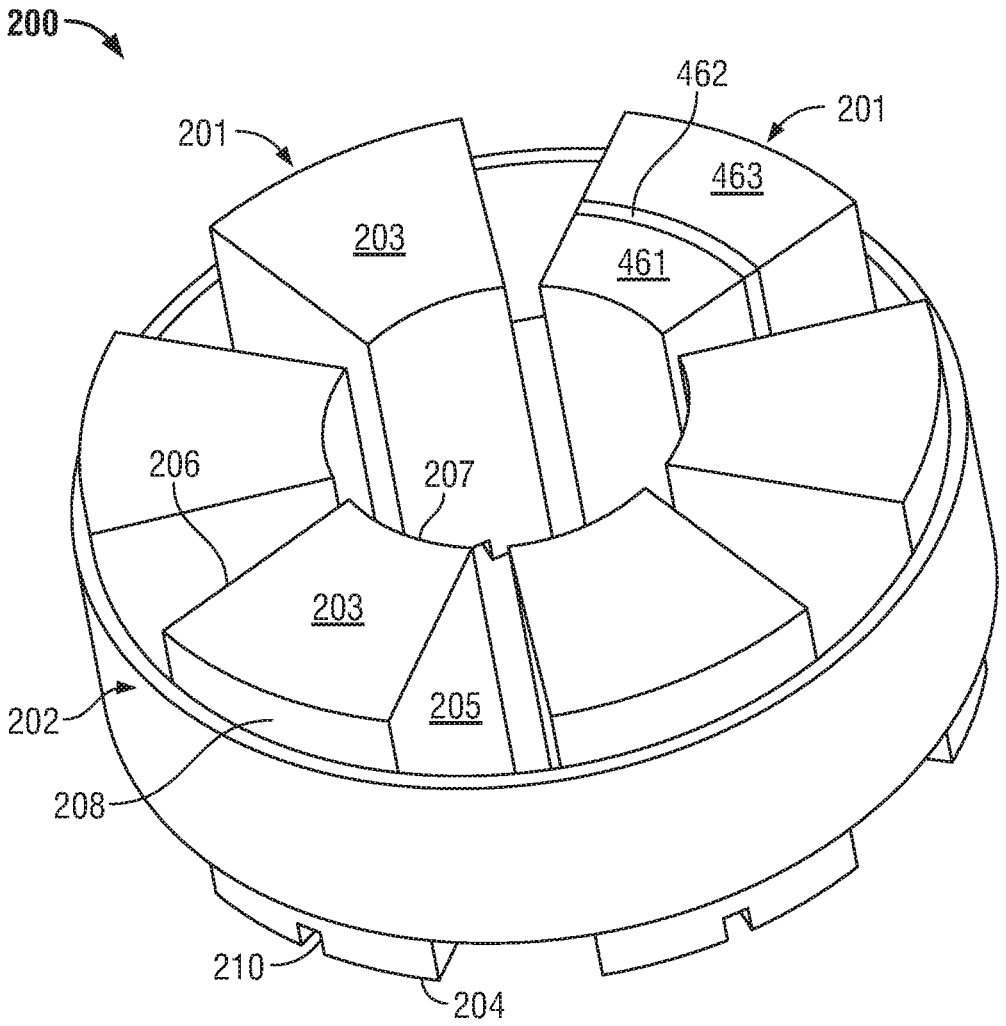
FIG. 8 is a pictorial view of a soap cartridge of the piston assembly shown in FIG. 3.

FIG. 8 shows a soap cartridge 200 to be received within the cage 40. The soap cartridge 200 comprises six segments 201 of solid soap disposed about the axis 13 and encircled by a circumferential elastic band 202. Each segment 201 is shown as an identical, modular frustoconical wedge with a roof face 203 normal the axis 13, a floor face 204 normal the axis 13, a first side face 205 in a first flat plane, a second side face 206 in a second flat plane, a frusto cylindrical radially inwardly directed inner end 207 and a frusto cylindrical radially outwardly directed outer end 208. A radially extending floor guide slot 210 is provided in the floor face 204 centered between the first and second side faces.

Each segment 201 is received in the cage cavity 85 between the roof member 82 and the floor member 84 with a floor guide tongue 92 received in the floor guide slot 210 of the floor face 204 of the segment 201. Each segment 201 is radially slidable in the cage cavity 86 guided on the floor guide tongue 92, preferably with sliding engagement between at least the floor surface 91 of the floor member 84 and the floor face 204 of the segment 201.

The band 202 extends circumferentially about the outer ends 208 of the segments 201. The band 202 is a resilient member which assumes an unbiased inherent shape of an unbiased inherent diameter. The band 202 can be stretched to expanded, biased conditions of larger diameter than its unbiased inherent diameter, and the band will under its inherent bias attempt to return to its unbiased inherent diameter. The band 202 is expanded to encircle the segments 201 circumferentially engaging the outer ends 208 of each segment 201 and biasing each segment 201 to slide radially inwardly on the floor guide tongue 92 toward the stem 15 of the piston 14 and into the rasp member 76 carried on the piston 14.

With six identical segments 201, each can have its inner end 207 extend circumferentially 60 degrees about the rasp tube 77, which sets the maximum distance that the side faces 205 and 206 may be spaced and permit the outer end 208 to become advanced into the rasp tube 77 without engagement of an adjacent segment 201.

During reciprocal axial inward and outward movement of the piston 14 is a cycle of operation the rasp member 76 is constantly radially directed into engagement with the inner end 207 of each segment 201 due to the bias to the band 202, and the rasp member 76 slides axially relative each inner end 207 of each segment 201 to abrade each inner end 207 to cut, dislodge and/or remove particles 209 of the solid material forming the segment 201. Particles 209 dislodged, schematically shown on FIG. 7, pass radially inwardly through the openings 80 in the rasp tube 77 into the inside of the rasp tube 77 and fall under gravity down into the chute tube 86 and through the chute passage 88 to fall out the annular particle discharge outlet 89 of the chute tube 86 about the piston 14.

In a cycle of operation with a user's hand disposed below the outer end of the piston 14, foamed liquid is discharged out the liquid discharge outlet 16 while particles 209 of solid soap are dispensed out the annular particle discharge outlet 89.

The rasp member 76 may be configured to cut, remove and/or dislodge particles merely in one of the discharge stroke and the return stroke, or in both. In one arrangement, the rasp prongs 81 extend radially outwardly and axially inwardly from the outer surface 78 and cut particles from the segments 201 on the piston 14 being moved axially inwardly in the discharge stroke such that the particles are cut, dislodged and removed and drop down for discharge principally during the discharge stroke during which foamed fluid is being discharged. In another arrangement, the rasp prongs 81 extend radially inwardly and axially inwardly from the outer surface 78 and cut particles from the segments 201 on the piston 14 being moved axially inwardly in the return stroke such that the particles are cut, dislodged and removed and dropped down for discharge principally during the return stroke.

In another embodiment, the particles are discharged during both the discharge and the return stroke with, for example, the rasp prongs extending radially outwardly from the outer surface 78 including some rasp prongs which extend axially inwardly and other rasp prongs which extend axially outwardly. In one preferred manner of operation, a dose of fluid is first dispensed as onto a user's hand following which the solid materials are dispensed to drop downwardly under gravity and be caught and engaged in the fluid already on the user's hand.

The first embodiment this invention illustrates a piston pump in which there is fluid discharge from the fluid discharge outlet 16 during a discharge stroke. This is not necessary, various alternative piston pump arrangements which may be provided in which there is fluid discharge in the return stroke. The rasp member 76 may be provided to dislodge, cut and/or discharge particles during the entirety of discharge stroke or the entirety of the return stroke or merely during portions of each of the strokes by limiting the extent to which the rasp member 76 and the inner ends 207 of each segment 201 are axially located so as to overlap during either stroke.

The first embodiment illustrates a piston assembly 10 provided in a manually operated dispenser 100 in which a user provides the forces to move the piston 14. This is not necessary and other arrangements may be utilized for moving the piston 14 as, for example, through the use of motorized actuators, for example, electrically powered by motors as is known for use with, for example, touchless automated fluid dispensers such as taught by U.S. Pat. No. 7,980,421 to Ophardt et al, issued Jul. 19, 2011, the disclosure of which is incorporated herein by reference. The first embodiment shows one arrangement for coupling the reservoir cartridge 112 to a dispenser housing 114. Various other arrangements for coupling the reservoir cartridge 112 and the piston assembly 10 to housing 114 and the actuator plate 132 may be provided.

Figure 9:
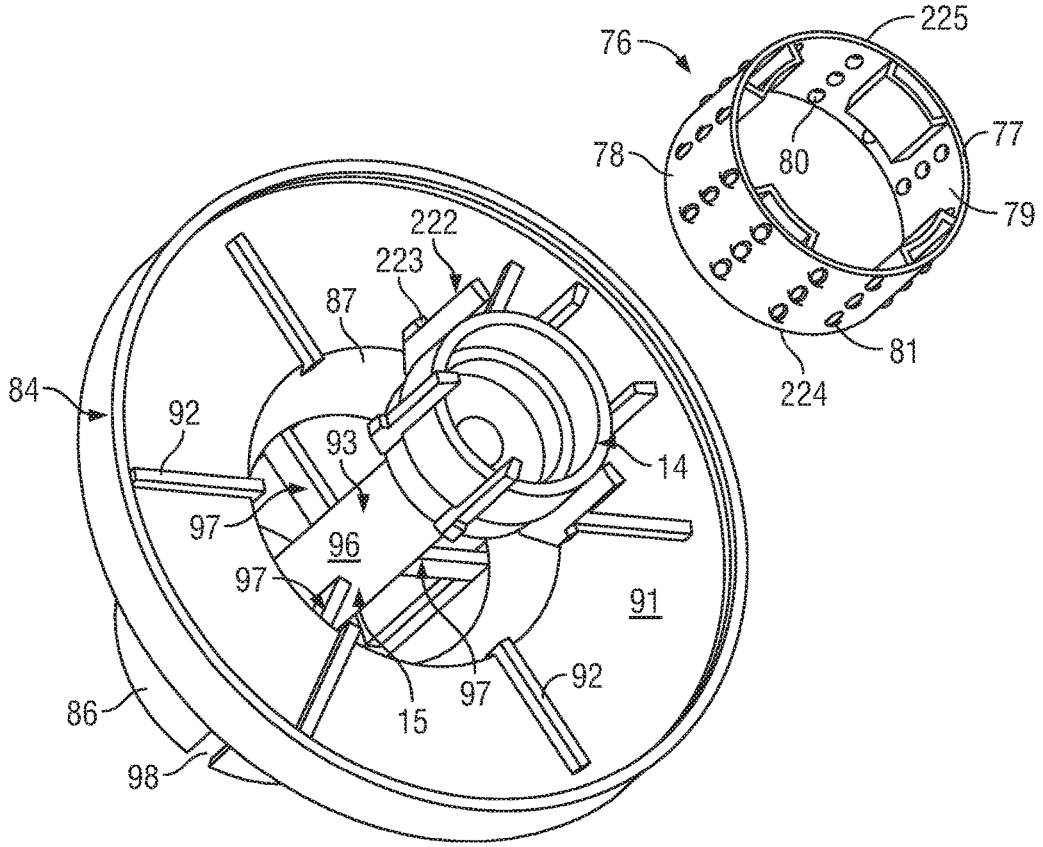
FIG. 9 is an exploded pictorial view showing an outer portion of a piston-forming element coupled on an annular floor member of a solid material cage of the piston assembly of FIG. 3 as viewed looking axially outwardly and a rasp member.
Figure 10:
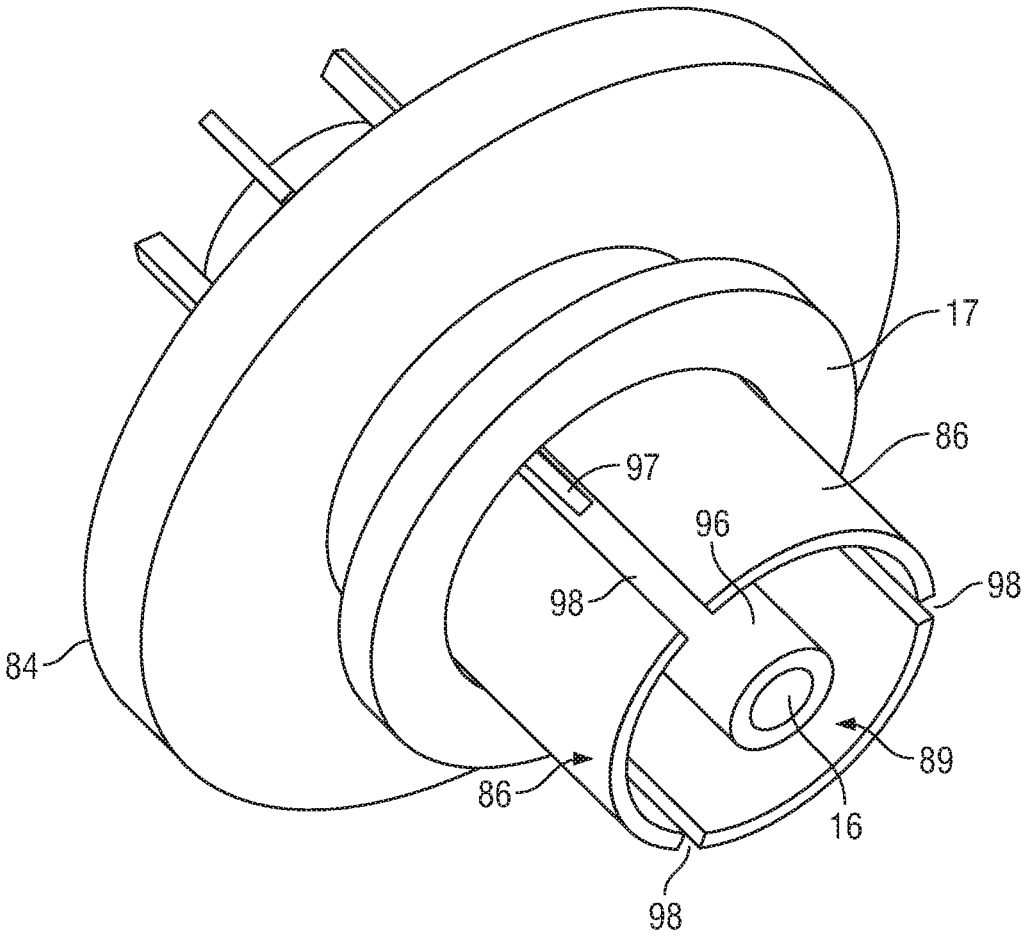
FIG. 10 is a pictorial view of the outer portion and the floor member shown in FIG. 9, however, as viewed looking axially inwardly.

Reference is made to FIGS. 9 and 10 which show the relative position and interaction of a forward portion 93 of the piston 14 and the floor member 84 of the solid material cage 40. As seen in FIG. 5, the piston 14 is conveniently formed from three portions, namely, an outer portion 93, an intermediate portion 94 and an inner portion 95, each of which is preferably injection molded from plastic. FIG. 9 shows the outer portion 93 of the piston 14 as having a discharge tube 96 formed by the piston stem 15. Three radially outwardly extending struts 97 couple the annular engagement flange 17 to the discharge tube 96 of the stem 15. The chute tube 86 of the floor member 84 has three axially extending slots 98 open at an axially outer end enclosed at an inner end. The discharge tube 96 is coaxially received within the chute tube 86 with the struts 97 passing radially through the slots 98 in the chute tube 86 to permit the engagement flange 17 to be located radially outwardly of the chute tube 86. FIG. 10 clearly shows the annular particle discharge outlet 89 annularly about the outer end of the discharge tube 96 with the fluid discharge outlet 16 inside the discharge tube 96.

FIG. 9 best shows the floor member 84 as having the central opening 87 opening to inside the chute tube 86. As can be seen, for example, in FIG. 9 and FIG. 4, the chute tube 86 has a cylindrical lower tubular portion 220 with the axially extending slots 98 therethrough and an upper frustoconical portion 221 bridging the central opening 87 to the lower tubular portion. The upper frustoconical portion 221 is not necessary. The tubular portion 220 preferably is of a diameter marginally greater than the diameter of the rasp member 76. The frustoconical portion 221 and the central opening 87 assist in ensuring that should any particles become dislodged and present on the outer surface 78 of the rasp tube 77, they will drop downwardly into the frustoconical portion 221 and hence downwardly into the tubular portion 220 of the chute tube 86.

FIG. 9 best shows that the outer portion 93 of the piston 14 carries six circumferentially spaced axially extending rasp support ribs 222 with each being provided with an axially inwardly directed support shoulder 223. The rasp tube 77 is of a diameter to closely extend about the support ribs 222 with an axially outer end 224 of the rasp tube 77 engage on the support shoulders 223 and with an axially inner end 225 of the rasp tube 77 engaged by an axially outwardly directed shoulder of the outer flange portion 75 of the air disc 54 carried on the intermediate portion 94 of the piston 14. The rasp member 76 is thus secured radially outwardly of the support ribs 222, is sandwiched between the support shoulders 223 on the support ribs of the outer portion 93 and the outer flange portion 75 of the intermediate portion 94. Each of the outer portion 93, intermediate portion 94 and inner portion 95 of the piston 14 are preferably secured together as in a snap-fit or a welded relation.

Regarding the solid material cage 40, the inner annular roof member 82 and the wall tube 83 are preferably formed as an integral element adapted to be secured to an outer end of the collar 39 as in a snap-fit relation. The floor member 84 is adapted to be secured onto an axially outer end of the wall tube 83 also as in a snap-fit relation.

The piston chamber-forming member 12 is shown in FIG. 4 as formed of a number of elements, namely, an inner chamber-forming portion 230 comprising the center tube 27, the annular end wall 34, the exterior tube 35 and the collar 39; an intermediate portion 231 comprising the roof member 82 and the wall tube 83; and the floor member 84 with its chute tube 86.

The piston assembly 10 may be assembled by assembling the piston 14 to a configuration as shown in FIG. 5, mounting the one-way valve 46 to the body 12, inserting the piston 14 into the liquid chamber 18 and the air chamber 36. The cage 40 may be preassembled by locating the soap cartridge 200 on the floor member 84 with a floor tongue guide 92 received in the floor guide slot 210 of each segment 201. Next, the intermediate portion 231 comprising the roof member 82 and the wall tube 83 may be secured to the floor member 85 sandwiching the soap cartridge 200 therein. The cage 40 is then coupled to the collar 39 by moving the assembled cage 40 axially towards the collar 39 with the discharge tube 96 to extend downwardly inside the inner ends 207 of each soap segment 201. As can be seen in FIG. 6, the radially outwardly directed surfaces of the discharge tube 96 preferably increase in diameter axially inwardly to provide a tapered camming surface 232 which assists in sliding the segments 201 radially outwardly against the bias of the band 202 such that the rasp member 86 may become disposed radially inwardly of the end faces 207 of the segments 201.

Reference is made to FIGS. 11 to 14 illustrating a second embodiment of a piston assembly 10 in accordance with the present invention. In FIGS. 11 to 14, similar reference numerals are used to represent similar elements found in both the first embodiment of FIGS. 1 to 10 and the second embodiment of FIGS. 11 to 14. In the second embodiment, the chute tube 86 is formed as a separate element from the floor member 84. The floor member 84 has an outwardly extending journaling stub axle 240 upon which an axially inner end 241 of the chute tube 86 is journalled for rotation about the axis 13.

Figure 12:
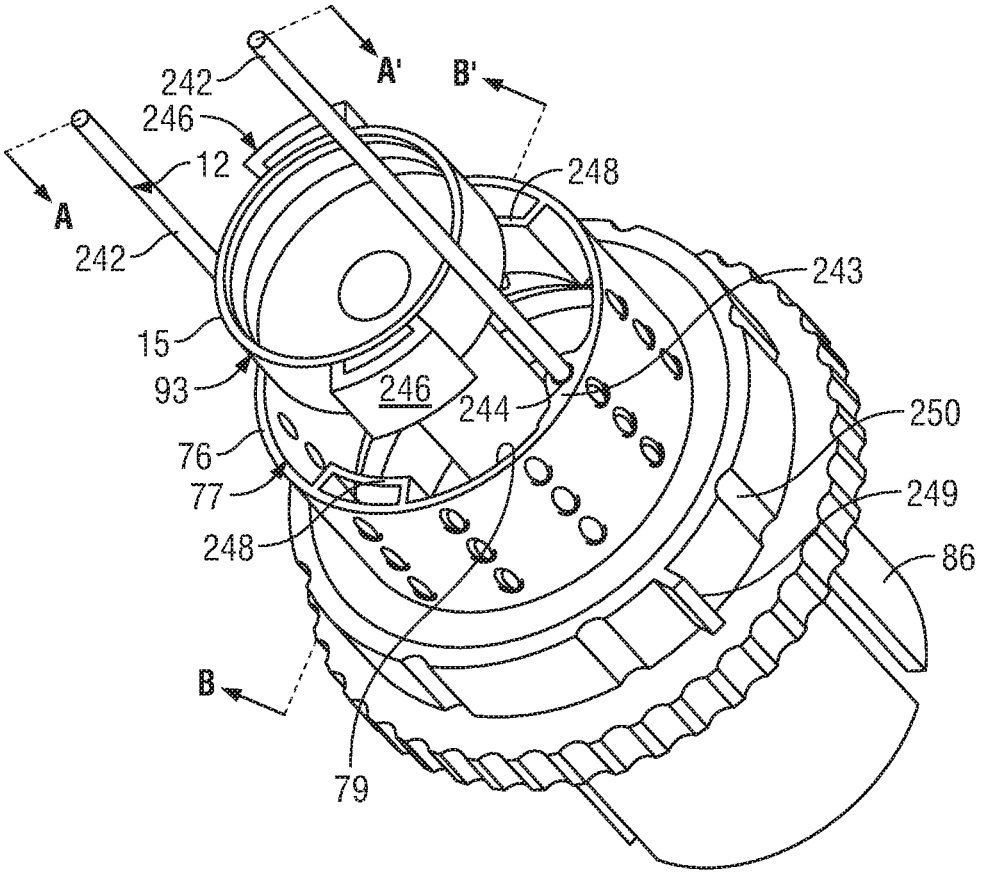
FIG. 12 is a schematic pictorial view showing, as seen looking axially outwardly, a rasp member, the outer portion of the piston-forming element in the chute tube of the piston assembly shown in FIG. 11, and on which section line A-A' is a cross-section represented by FIG. 11.
Figure 13:
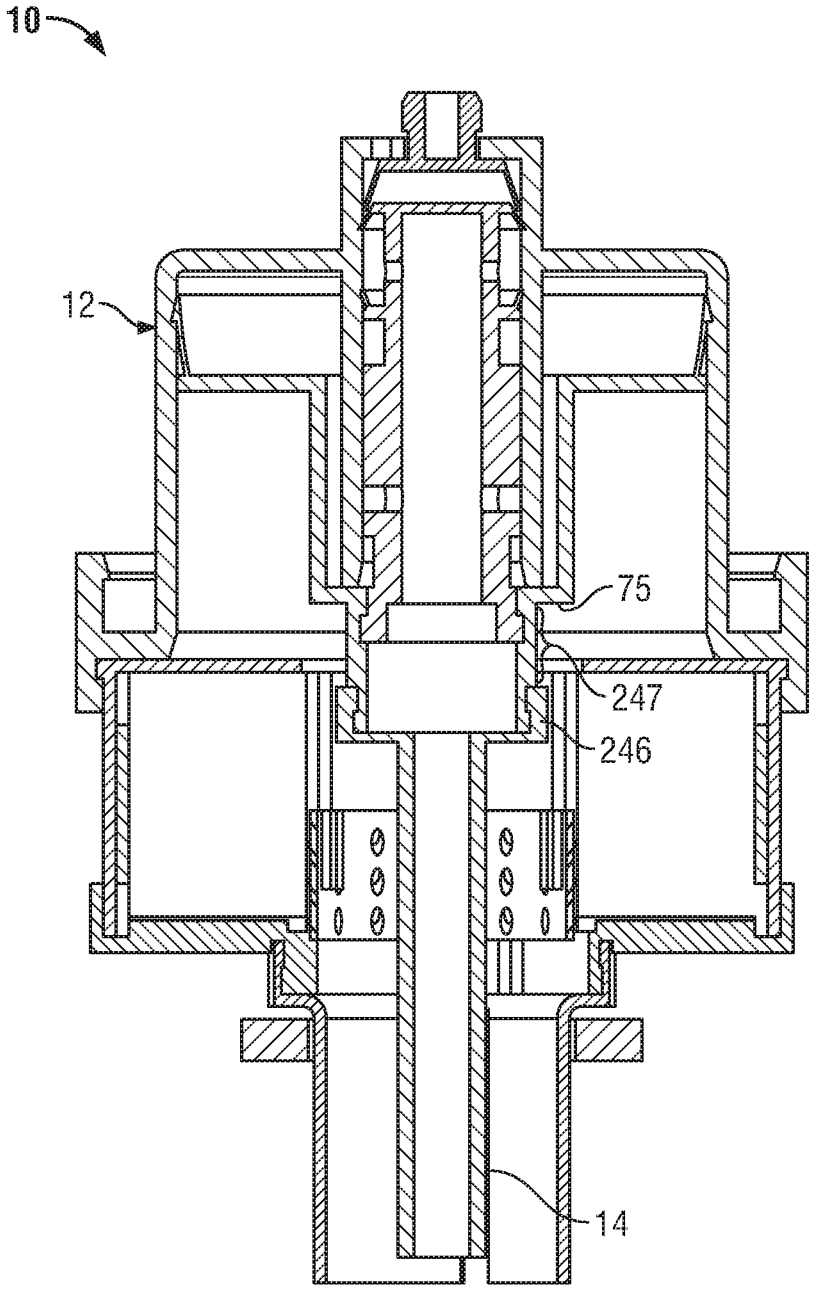
FIG. 13 represents a cross-sectional side view of the pump assembly of FIG. 11, however, along section line B-B' of FIG. 12.

The roof member 82 includes a pair of diametrically opposed axially extending slide rods 242. The rasp member 76 is mounted on the slide rods 242 for axially sliding relative to the roof member 82, however, with the slide rods 242 preventing rotation of the rasp member 76 relative to the roof member 82. As best seen in FIG. 12, the rasp member 76 includes two radially inwardly extending bosses 243, each with a cylindrical bore 244 therethrough which bores 244 are axially slidable on the slide rods 242. While not shown in FIG. 12, the slide rods 242 extend axially inwardly to where they are fixedly coupled to the roof member 82.

The outer portion 93 of the piston 14 carries a pair of outer lugs 246 which extend outwardly at diametrically opposite locations from the stem 15 to approximate the inner surface 79 of the rasp tube 77. The outer lugs 246 are shown in cross-section in FIG. 13 as being axially spaced from the axially outwardly directed shoulder of the outer flange portion 75 of the air disc 54 defining a catch pocket 247 therebetween.

Figure 11:
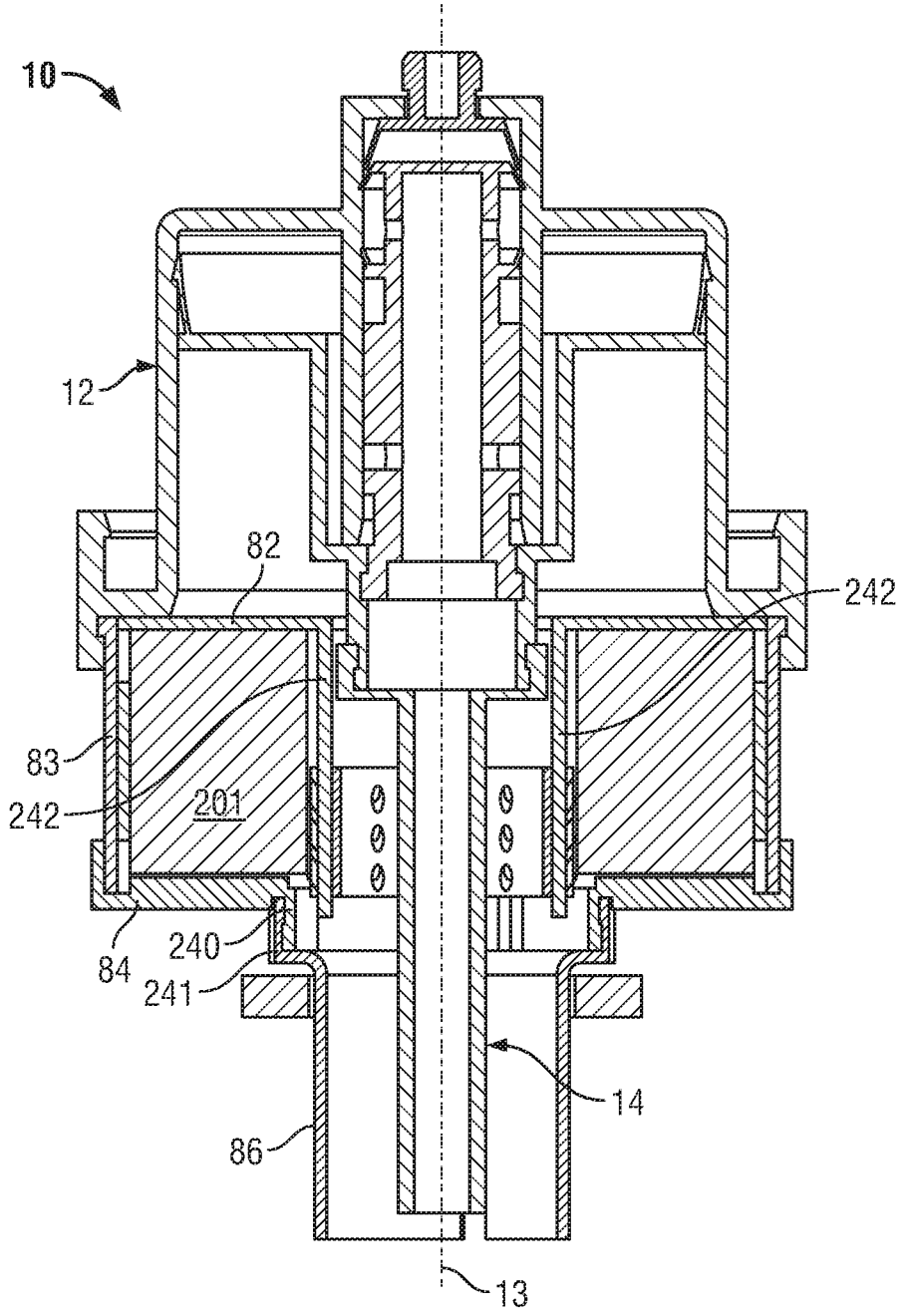
FIG. 11 is a cross-sectional side view similar to FIG. 7 but showing a second embodiment of a piston assembly in accordance with the present invention with the piston-forming element in a retracted position disengaged from a rasp member.

The rasp member 76 carries as protruding radially inwardly from the inner surface 79 of the rasp tube 77 a pair of inner lugs 248. The axial extent of the inner lugs 248 corresponds to the axial extent of the pocket 247. FIG. 12 represents a condition in which the piston 14 is axially slidable relative to the body 12 represented by the slide rods 242 without axial movement of the rasp member 76. As seen in FIG. 11, with the piston 14 in the rotation orientation as shown, the outer lugs 246 on the piston 14 slide axially past the inner lugs 248 on the rasp member 76. Axial movement of the piston 14 relative to the body 12 will serve to dispense fluid from the fluid discharge outlet 16, however, the rasp member 76 will not move with the piston 14 and thus the rasp member 76 will not move relative the solid soap segments 201 which will not be abraded and soap particles will not be discharged.

Figure 14:
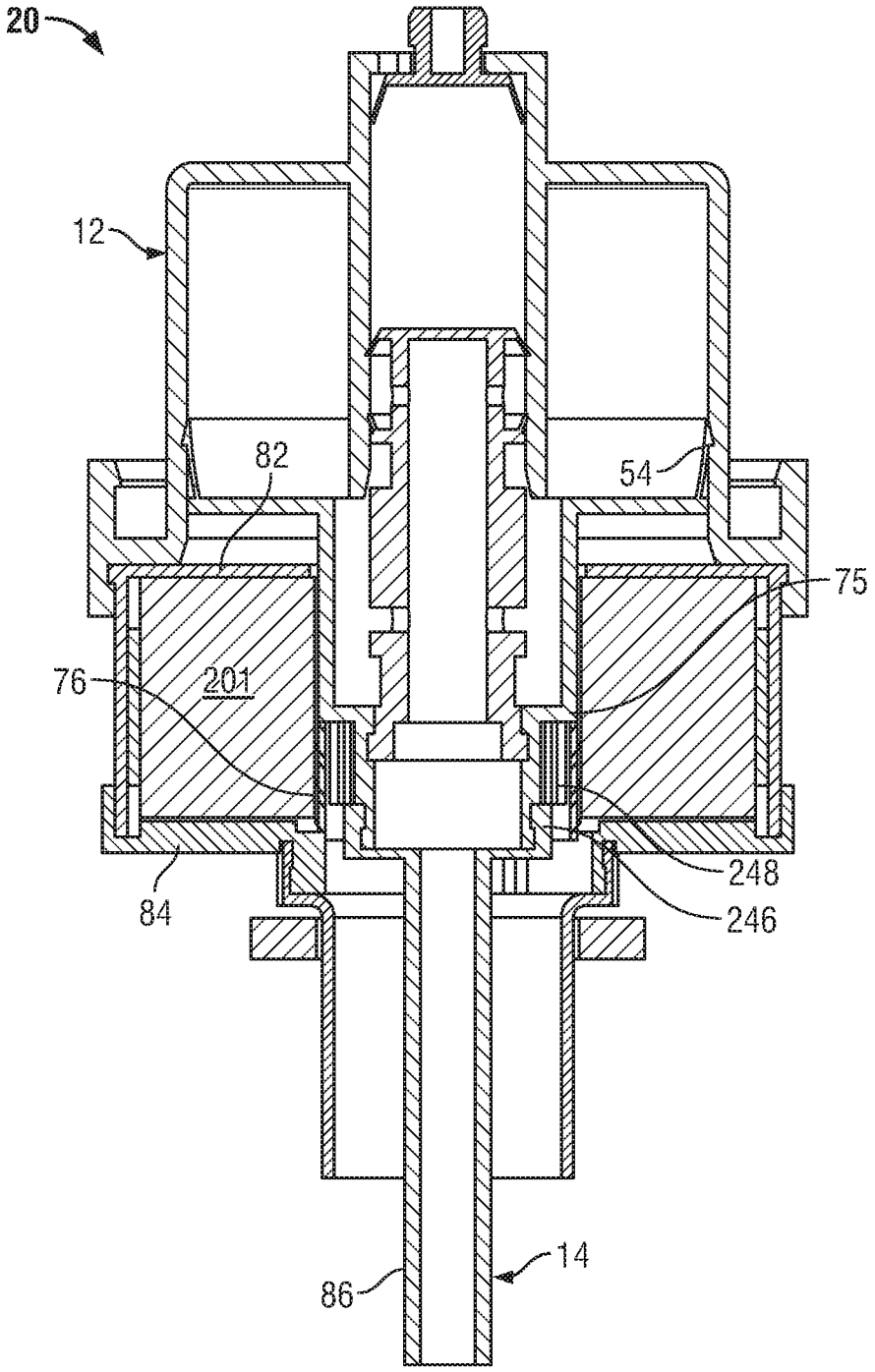
FIG. 14 is a cross-sectional side view similar to that shown in FIG. 13, but with the piston-forming element in an extended position coupled to the rasp member for sliding of the rasp member with the piston.
Figure 15:
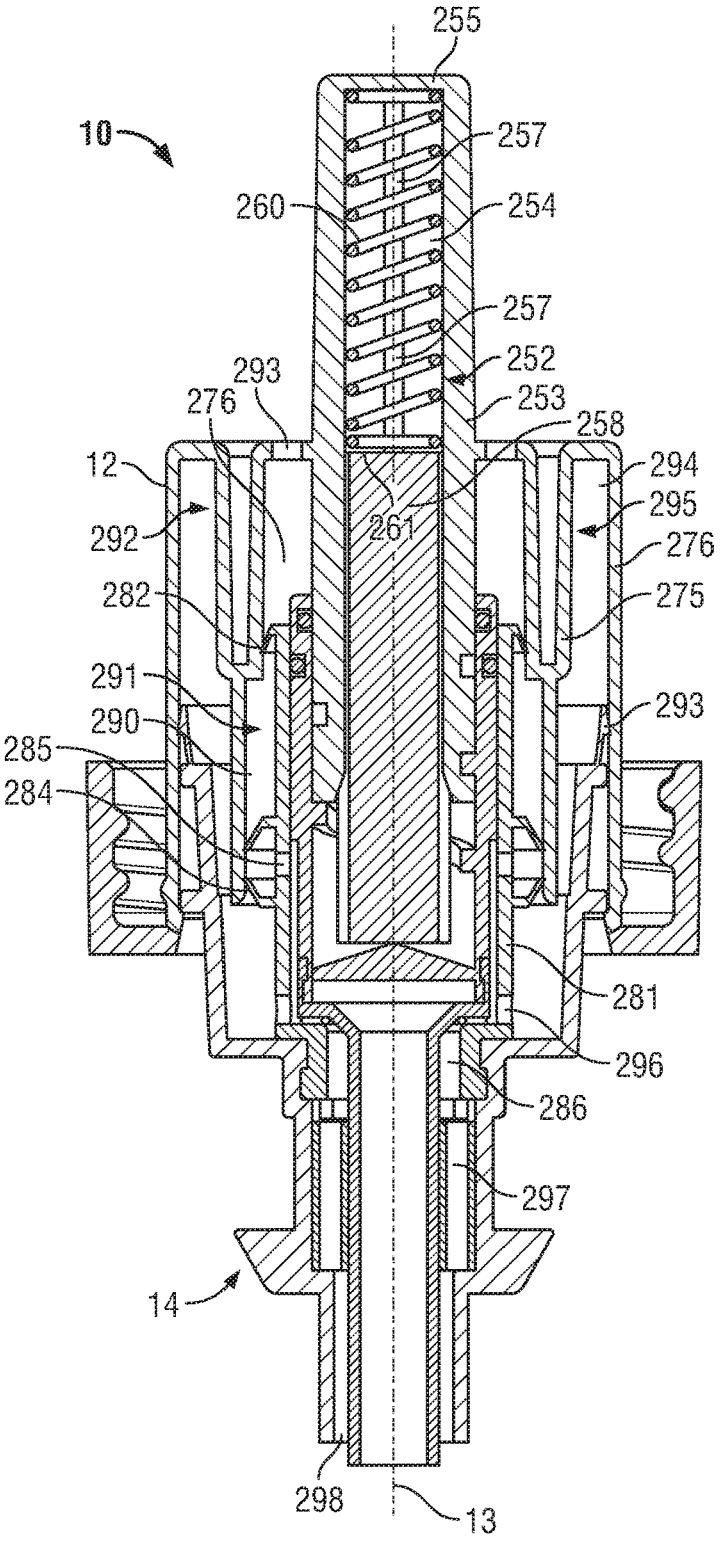
FIG. 15 illustrates a third embodiment of a piston assembly in accordance with the present invention with the piston-forming element in an extended position.

Reference is made to FIG. 14 which illustrates a condition in which the piston 14 has been moved from the retracted position of FIG. 12 to an extended position and the piston 14 has been rotated 45 degrees clockwise looking downwardly in FIG. 12 such that the inner lug 246 on the piston 14 has been rotated to be axially in line with the outer lug 248 on the rasp member 76 such that the inner lug 246 is received in the pocket 247 between the outer lug 248 and the outer flange portion 75 of the air disc 54. In the position as shown in FIG. 14, the rasp member 76 is coupled to the piston 14 for axially movement in unison and with the movement of the piston 14 to dispense foam, the rasp member 76 moves axially in engagement with the soap segments 201 to discharge soap particles.

The chute tube 86 may be rotated 45 degrees relative the floor member 84 between a rasp engaged position as shown in FIG. 14 and a rasp unengaged position as shown in FIG. 12 to select whether the rasp member 76 will move axially with the piston 14 or the rasp member 76 will not move axially with the piston 14.

As can be seen in FIG. 12, preferably a stop member 249 may be provided to limit the relative rotation of the chute tube 86 on the floor member 84 merely 45 degrees between the rasp member engaging position and the rasp member disengaging position. Preferably, complementary indents 250 on the chute tube 86 and stop lugs (not shown) on the floor member 84 will be provided interacting between the chute tube 86 and the floor member 84 to effectively locate and resiliently secure the chute tube 86 relative to the floor member 84 in either of these two desired positions.

The second embodiment illustrates a modification of the first embodiment with an additional mechanism provided for a configuration of the piston assembly 10 in which solid soap particles are dispensed while liquid foam is dispensed and in a configuration in which soap particles are not dispensed while foam liquid is dispensed.

The preferred embodiments of FIGS. 1 to 14 illustrate arrangements in which the piston assembly 10 includes both a liquid pump 68 and an air pump 70 to simultaneously dispense liquid and air and produce a foam. This is not necessary. For example, the air pump 70 could be eliminated and the piston assembly 10 could merely dispense liquid without foaming. Similarly, the air pump 70 could be replaced by a secondary liquid pump for dispensing of a second liquid.

Reference is made to FIGS. 15 to 18 showing a third embodiment of a piston assembly 10 in accordance with the present invention. The piston assembly 10 includes a piston chamber-forming member or body 12 and a piston 14 which are coaxially slidable along an axis 13. The body 12 is provided with a center tube 252 having a cylindrical wall 253 forming a material chamber 254 closed at an inner end 255 and open at an outer end 256. An axially extending key 257 extends radially inwardly from the wall 253 of the center tube 252 along its length. An elongate rod 258 of solid material to be dispensed is coaxially slidable within the material chamber 254 with the rod 258 having an axially and radially extending keyway 259 shown in FIG. 17 to receive the key 257 and prevent relative rotation of the rod 258 relative the center tube 252. A spring 260 is received within the center tube 252 between the inner end 255 of the center tube 252 and an inner end 261 of the rod 258 which serves to bias the rod 258 axially outwardly through the open outer end 256 of the center tube 252. A chute tube 264 is coupled between the body 12 and the piston 14. The chute tube 264 is coaxially received within the piston 14 journalled to the piston for rotation about the axis 13 relative to the piston 14 with the chute tube 264 axially slidable inwardly and outwardly with the piston 14. The chute tube 264 has an open axially inner end 265 and a tubular wall 266 which carries on an inner surface 267 radially inwardly extending helical threads 268. The helical threads 268 are adapted to be engaged and mate with complimentary helical grooves 269 in a radially outwardly directed surface 270 of the center tube 252 of the body 12. As the piston 14 is slid axially relative to the body 12, the threads 268 and grooves 269 interact to rotate the chute tube 264 relative to the body 12 in one direction during an extension stroke and in the opposite direction during a return stroke. The chute tube 264 has a central passageway 271 axially therethrough. A rasp member 272 is provided within the passageway 271 of the chute tube 264 with a rasp surface 273 directed axially upwardly and with axially openings 511 between the rasp member 272 and the surface 270 of the center tube 252. As can best be seen in FIG. 18, the rasp member 272 extends diametrically across the central passageway 271 of the center tube 252 as a spoke-like member with the openings 511 on either side.

Figure 16:
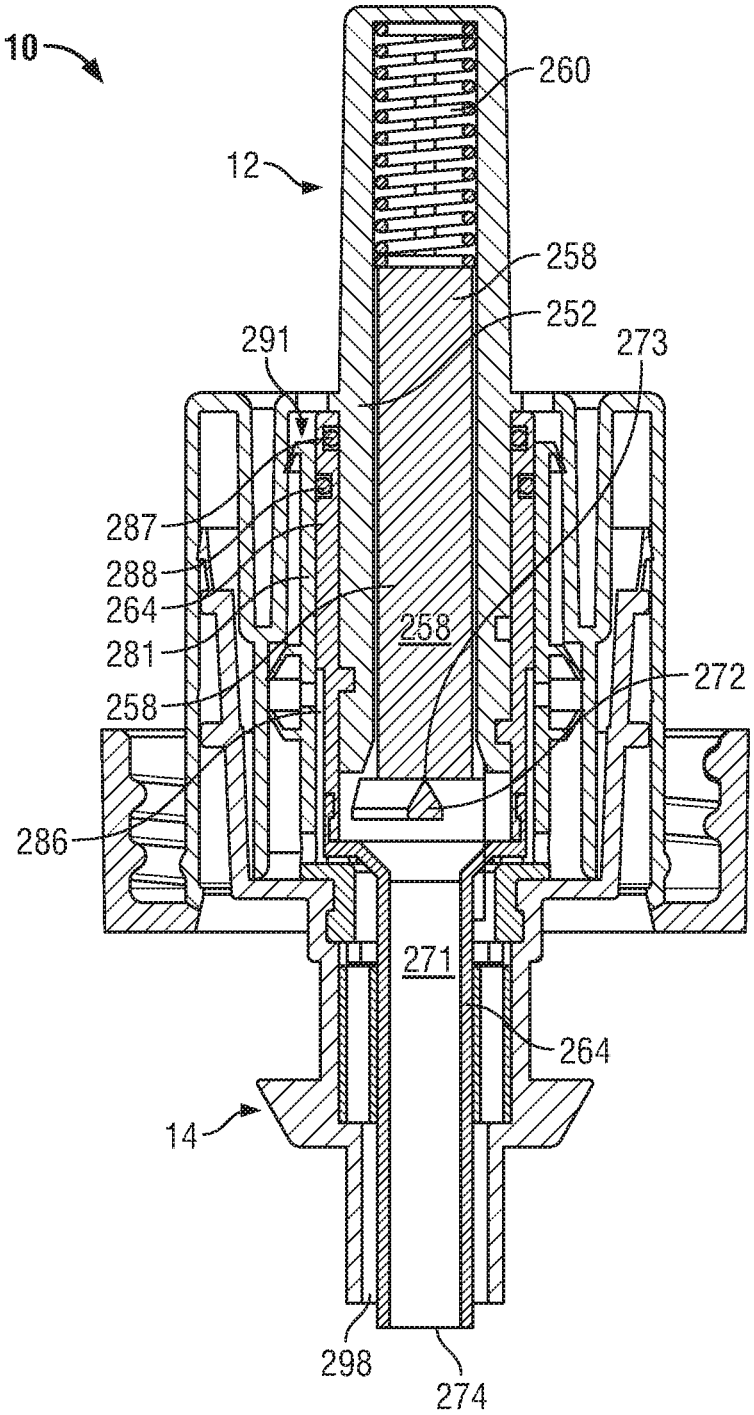
FIG. 16 is a cross-sectional side view the same as FIG. 15, but with the piston-forming element in a retracted condition.
Figure 17:
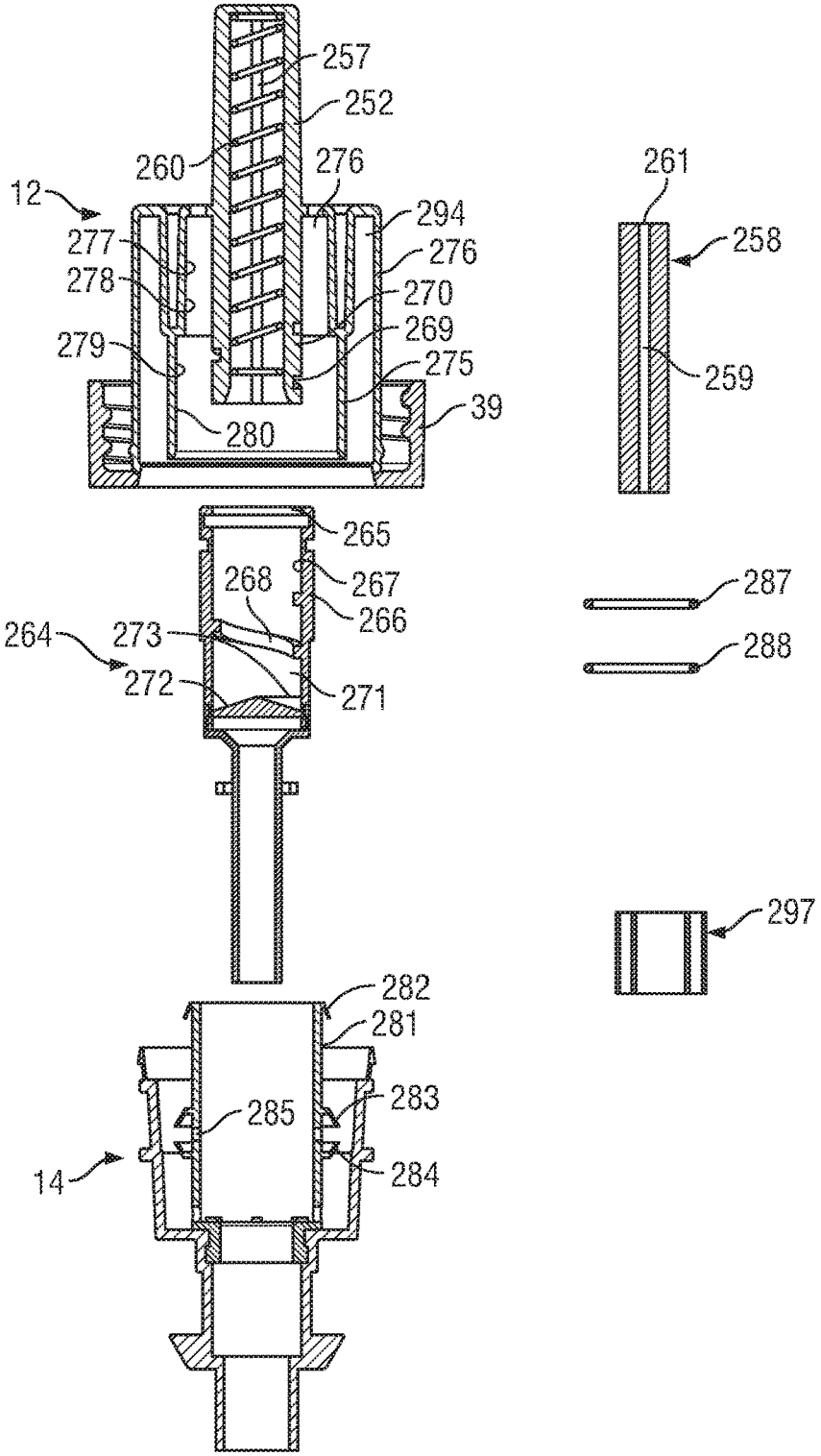
FIG. 17 is an exploded view of the third embodiment of the pump assembly shown in FIG. 15.
Figure 18:
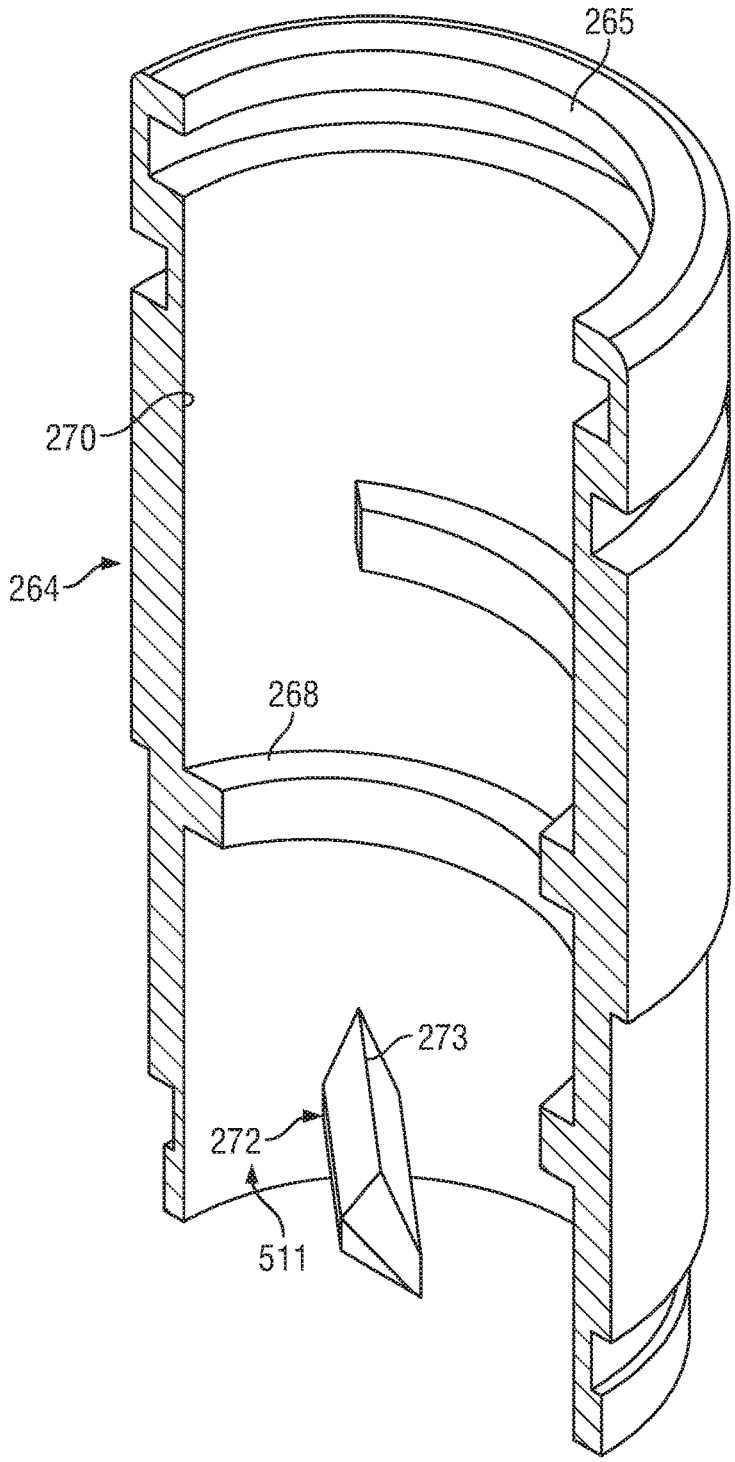
FIG. 18 is a pictorial view of the rasp member of the pump assembly of FIG. 15.

In the assembled piston assembly 10, as seen in FIGS. 16 and 17, the soap rod 258 is biased axially outwardly into engagement with the axially inwardly directed rasp surface 273 of the rasp member 272. With axial sliding of the piston 14 inwardly and outwardly relative to the body 12, the chute tube 264 and its rasp member 272 are rotated and the rotating rasp member 272 which is in engagement with the soap rod 258 under the bias of the spring 260, rotates to cut, sever and/or dislodge particles of the rod 258 which particles under gravity fall downwardly within the passageway 271 of the chute tube 264 past the rasp member 272 and out a material discharge outlet 274 at the axial outer end of the chute tube 264.

Inwardly about the center tube 252, the body 12 includes an annular dividing wall 275 which defines an inner annular liquid chamber 276 between the center tube 252 and the dividing wall 275 and an outer annular air chamber 294 between the dividing wall 275 and a radially outer wall 276 of the body 12. The outer wall 276 carries in its axially outer end, a threaded collar 39 for engagement of the body 12 onto the neck of a fluid containing bottle.

The dividing wall 275 has a radially inwardly directed surface 277 of a first diameter over an inner portion 278 of the dividing wall 275 and a radially inwardly directed surface 279 of a second larger diameter over an outer portion 280 of the dividing wall. The piston 14 has an inner tube 281 with central opening sized to dispose coaxially about the chute tube 264. The inner tube 281 carries a liquid inner disc 282, a liquid intermediate disc 283 and a liquid outer disc 284. The inner disc 281 engages the inner portion 278 of the dividing wall 275 in a manner to prevent fluid flow inwardly therepast yet to deflect to permit fluid flow outwardly therepast as in the manner of a one-way valve. The intermediate disc 283 engages the outer portion 280 of the dividing wall 275 to permit fluid flow axially outwardly therepast but to prevent fluid flow axially inwardly therepast. The outer disc 284 engages the outer portion 280 to prevent fluid flow axially inwardly therepast. A liquid port 285 is provided through the inner tube 281 into communication with a passageway 286 best seen in FIG. 16 in between the chute tube 264 and the piston 14 radially outwardly of the chute tube 264 to an annular fluid discharge outlet 298 coaxially about the chute tube 264 at an outer end of the piston 14. A first sealing O-ring 287 is provided between the radially inwardly directed surface of the chute tube 264 and the radially outwardly directed surface of the center tube 252 to provide a fluid seal therebetween with sliding and rotational movement of the chute tube 264 relative to the inner tube 281. A second O-ring 288 is provided between a radially outwardly directed surface of the chute tube 264 and radially inwardly directed surface of the inner tube 281 of the piston 14 to provide a fluid seal with relative rotation of the chute tube 264 inside the inner tube 281 of the piston 14.

A stepped liquid pump 291 is provided inside the liquid chamber 276 with an annular liquid compartment 290 defined between the dividing wall 275 and the inner tube 281 axially between the liquid inner disc 282 and the liquid outer disc 284 which liquid compartment 290 varies in volume as the piston 14 is moved axially to the body 12. The fluid chamber 276 is in communication with fluid in the bottle via an inlet opening 293 at an inner end of the liquid chamber 276. In movement of the piston 14 inwardly, the volume of the liquid compartment 290 reduces discharging fluid through the liquid port 285 to the fluid discharge outlet 298. In a withdrawal stroke, the volume of the liquid compartment 290 increases drawing liquid from the bottle into the liquid compartment 290.

Radially outwardly of the liquid pump 291, an air pump 292 is provided. The piston 14 carries an air disc 293 which engages the radially inwardly directed surface of the outer wall 276 of the body 12 within the air chamber 294 so as to form an air compartment 295 between the outer wall 276 and the dividing wall 275 and axially between a closed inner end of the air chamber 294, the air disc 293 and the liquid outer disc 284. The volume of the air compartment 295 changes as the piston 14 is moved axially relative to the body 12. An air port 296 is provided through the inner tube 281 from the air compartment 295 to the passageway 286. With movement of the piston 14 in a return stroke, the volume of the air compartment 295 reduces and air is forced through the air port 296 for discharge simultaneously with the liquid through an annular foam generator 297 to generate foam which is dispensed out the annular fluid discharge outlet 298. In a return stroke, the volume of the air compartment 295 increases and air is drawn via the discharge outlet 298 and the passageway 286 to the air port into the air compartment.

In the third embodiment, the particles of solid material drop down under gravity through the solid material discharge outlet 274 centered about the axis 13 and the foamed liquid is discharged from an annular liquid discharge outlet 298 about the solid material outlet 274. The spring 260 biases the soap rod 258 into the rotating rasp member 272 at all times. However, the force with which the soap rod 258 is biased into the rasp member 272 will increase as the spring 260 is compressed on the piston 14 being moved closer to the retracted position. As the soap rod 258 is abraded by the rotating rasp member 272, the axial length of the soap rod 258 will decrease and the spring 260 needs to provide forces biasing the rod 258 outwardly even when the rod 260 is substantially reduced in axial length due to abrasion.

Figure 19:
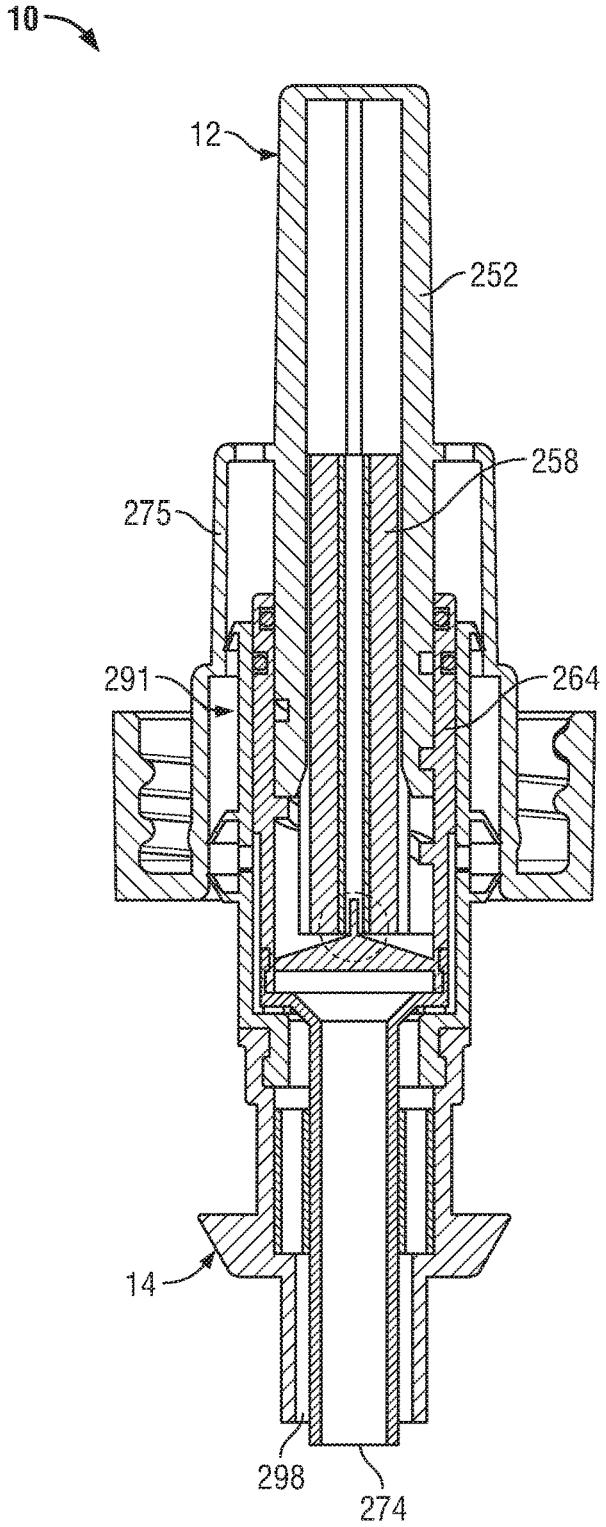
FIG. 19 is a cross-sectional side view of a fourth embodiment of a piston assembly in accordance with the present invention.
Figure 20:
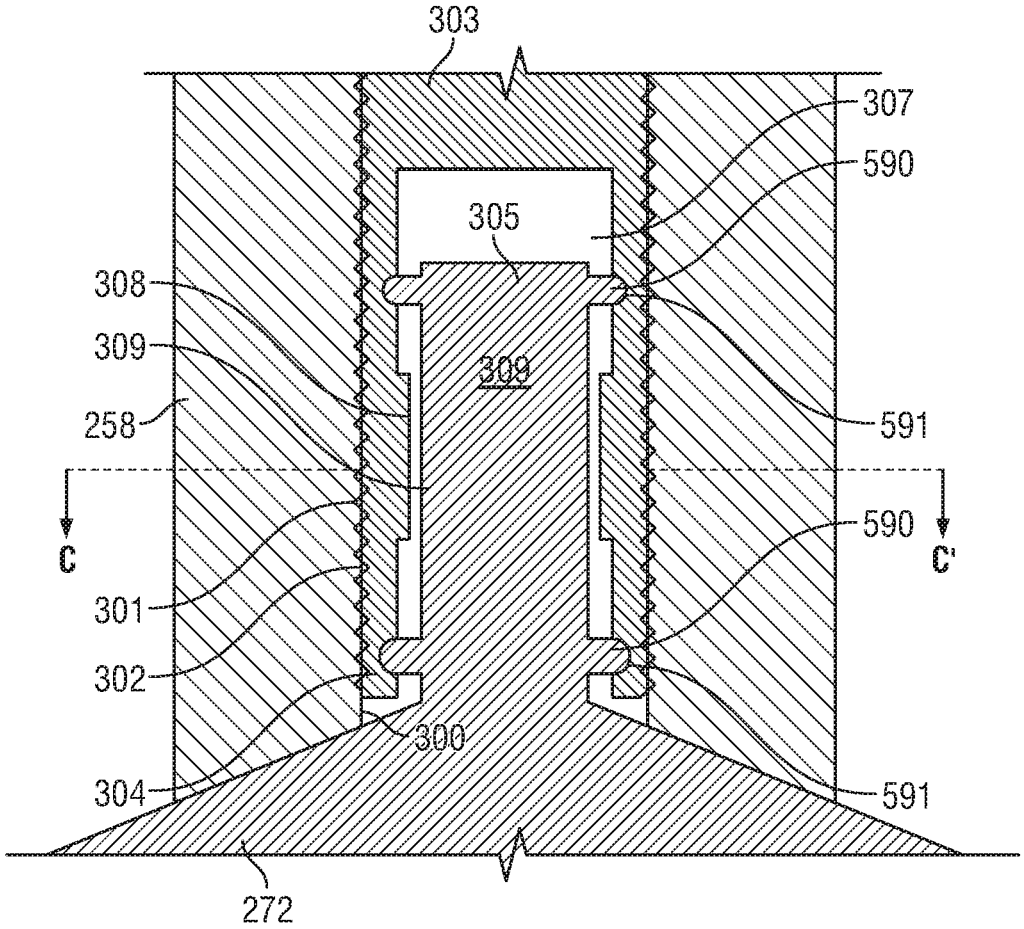
FIG. 20 is an enlarged view of a portion of FIG. 19 within the circle shown dashed lines in FIG. 19.
Figure 21:
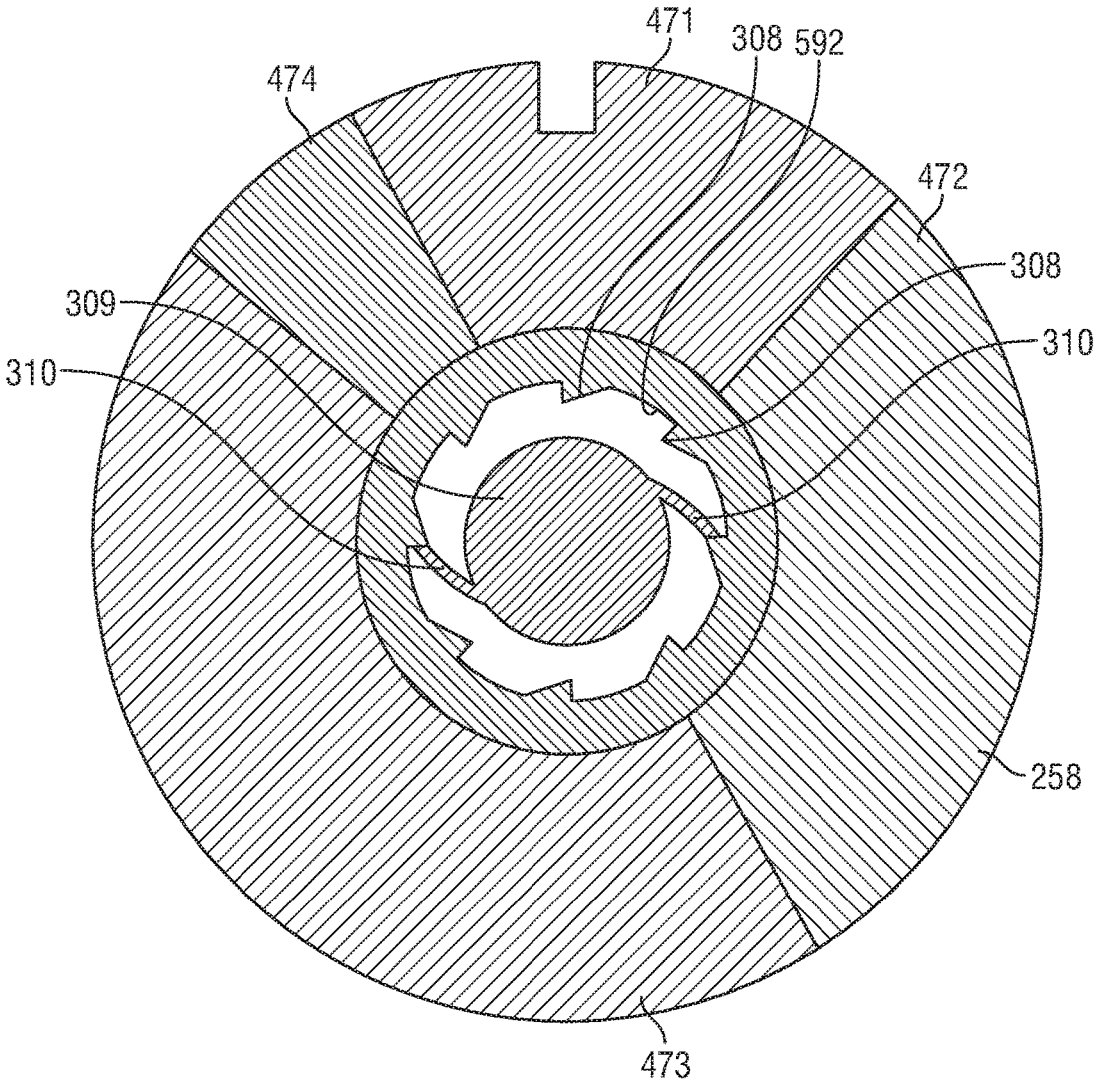
FIG. 21 is a cross-sectional side view along section line C-C' in FIG. 20.
Figure 22:
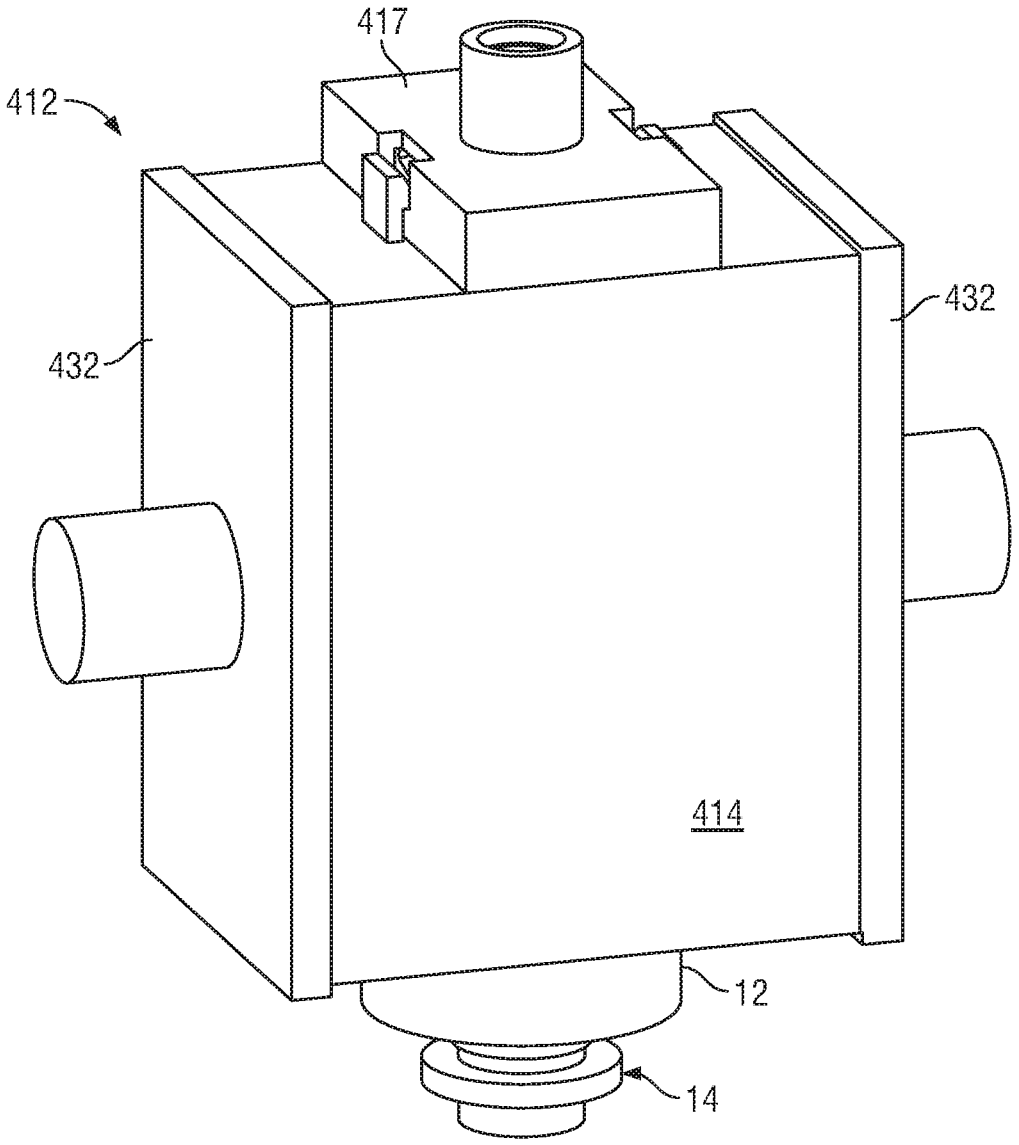
FIG. 22 is a pictorial view of a reservoir cartridge in accordance with a fifth embodiment of the present invention.
Figure 23:
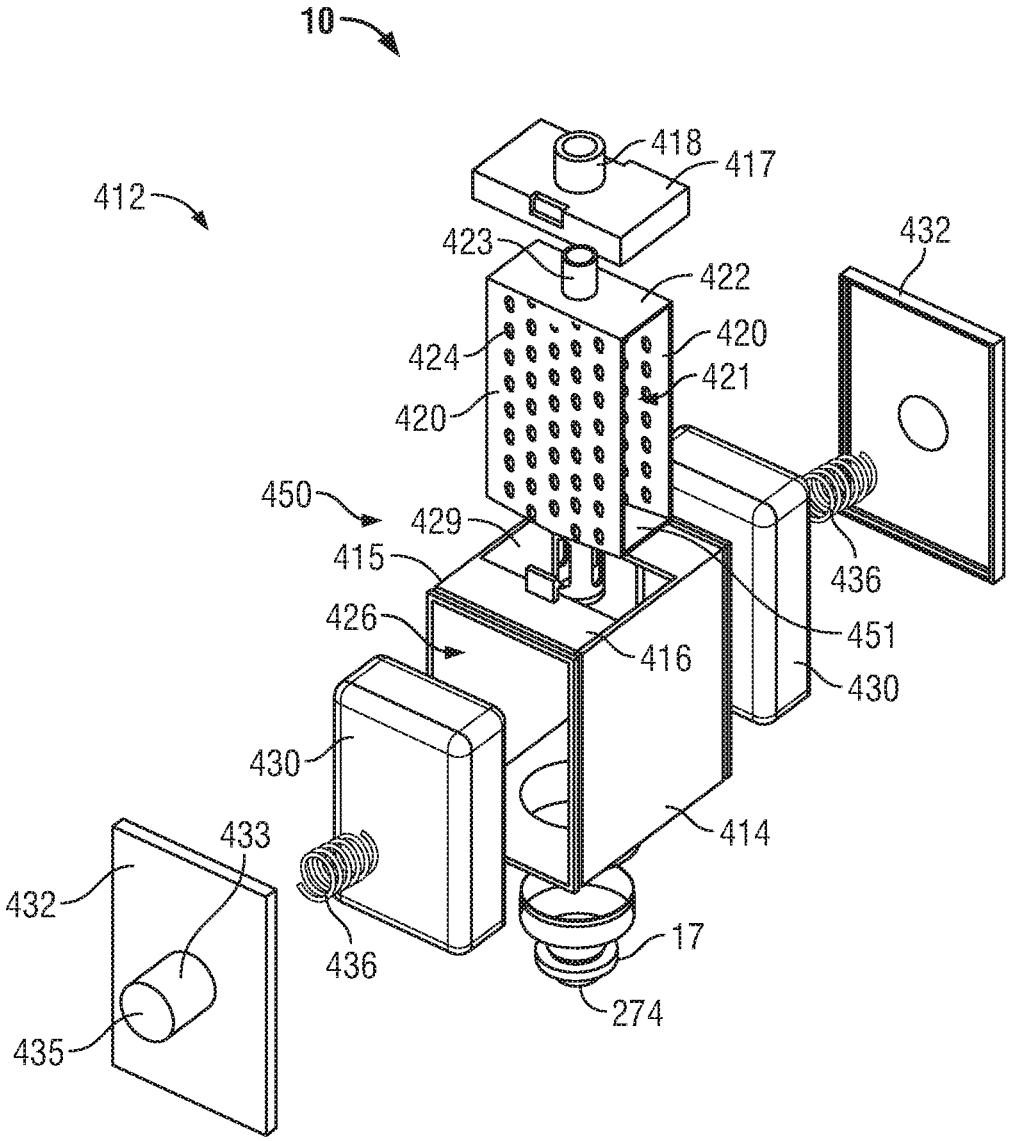
FIG. 23 is an exploded pictorial view of the reservoir cartridge of FIG. 22.

Reference is made to FIGS. 19 to 21 which illustrate a fourth embodiment of a piston assembly 10 in accordance with the present invention. The fourth embodiment has many similarities to the piston assembly of the third embodiment in FIGS. 15 to 18. In the piston assembly of the fourth embodiment, the air pump has been eliminated and merely a liquid pump 291 is provided with effectively the stepped dividing wall 275 in the third embodiment being moved outwardly to form an outermost wall of the body 12. The liquid pump 291 operates in an analogous manner in FIG. 19 to draw fluid in from the bottle and discharge it out through an annular liquid discharge outlet 298. In FIGS. 19 to 21, the chute tube 264 and the center tube 252 are unchanged over the third embodiment. The soap rod 258 is provided as a tubular member with a central bore 300 axially therethrough. The center bore 300 has a threaded interior face 301 adapted to engage with external threads 302 on a central post 303 which extends longitudinally through the soap rod 258. The soap rod 258 continues to be keyed to the center tube 252 against relative rotation. As can be seen in FIG. 21, the central post 303 has at its outer end 304 an internal axially outwardly opening socket 307 with a cylindrical side wall 592 carrying a plurality of radially inwardly extending teeth 308. The rasp member 272 includes a stub axle 309 which extends upwardly from the rasp member 272 to be coaxially journalled within the socket 307. The stub axle 309 carries a number of one-way cam pawls 310. The central post 303 is journalled at its axially outer end 304 to the axially inner end 305 of the rasp member 272 by annular journaling flanges 590 on the stub axle 309 received in journaling slots inside the central post 303 so that the central post 303 is coupled to the rasp member 272 such that the central post 303 slides axially with the rasp member 272 as part of the piston 14. A one-way clutch mechanism 306 provides engagement between the central post 303 and the rasp member 272 as best illustrated in FIG. 21. On movement of the piston 14 inwardly, the rasp member 272 is rotated clockwise with the result that the pawls 310 engage the teeth 308 to rotate the central post 303 clockwise relative to the soap rod 258. As the soap rod 258 is keyed to the center tube 252 against rotation, rotation of the threaded central post 303 relative to the soap rod 258 results in the soap rod 258 being drawn axially outwardly on the central post 303 into engagement with the rasp member 272 with the rasp member 272 rotating relative to the soap rod 258 to abrade the soap rod. In a return stroke, the rasp member 272 rotates counterclockwise with the result that the flexible pawls 310 deflect to rotate counterclockwise past the teeth 308 and the central post 303 is not rotated. In this manner, the operation of the one-way clutch mechanism 306 serves to advance the soap rod 258 axially outwardly into the rasp member 272 a small amount on each cycle of operation. The relative advance of the soap rod 258 on each cycle of operation is selected to be a suitable amount to provide a desired dosage of particles of the soap rod 258 to be discharged in a cycle of operation. The axial amount which the soap rod 258 may advance in any cycle of operation is suitably selected having regard for example to the pitch of the threads causing rotation of the chute tube 264 relative the center tube 252, the angular extent that the chute tube is rotated, and the pitch of the threads between the central post 303 and the soap rod 258. The particles of the solid soap material are dispensed downwardly under gravity past the rasp member 272 to the material discharge outlet 274.

Reference is made to FIGS. 22 to 25 which illustrate a reservoir cartridge 412 in accordance with a fifth embodiment of the present invention. The reservoir cartridge 412 of FIGS. 22 to 25 is adapted to replace the reservoir cartridge 112 shown in FIG. 1 and to be similarly removably coupled to a dispenser housing 114 such as shown in FIG. 1.

Figure 24:
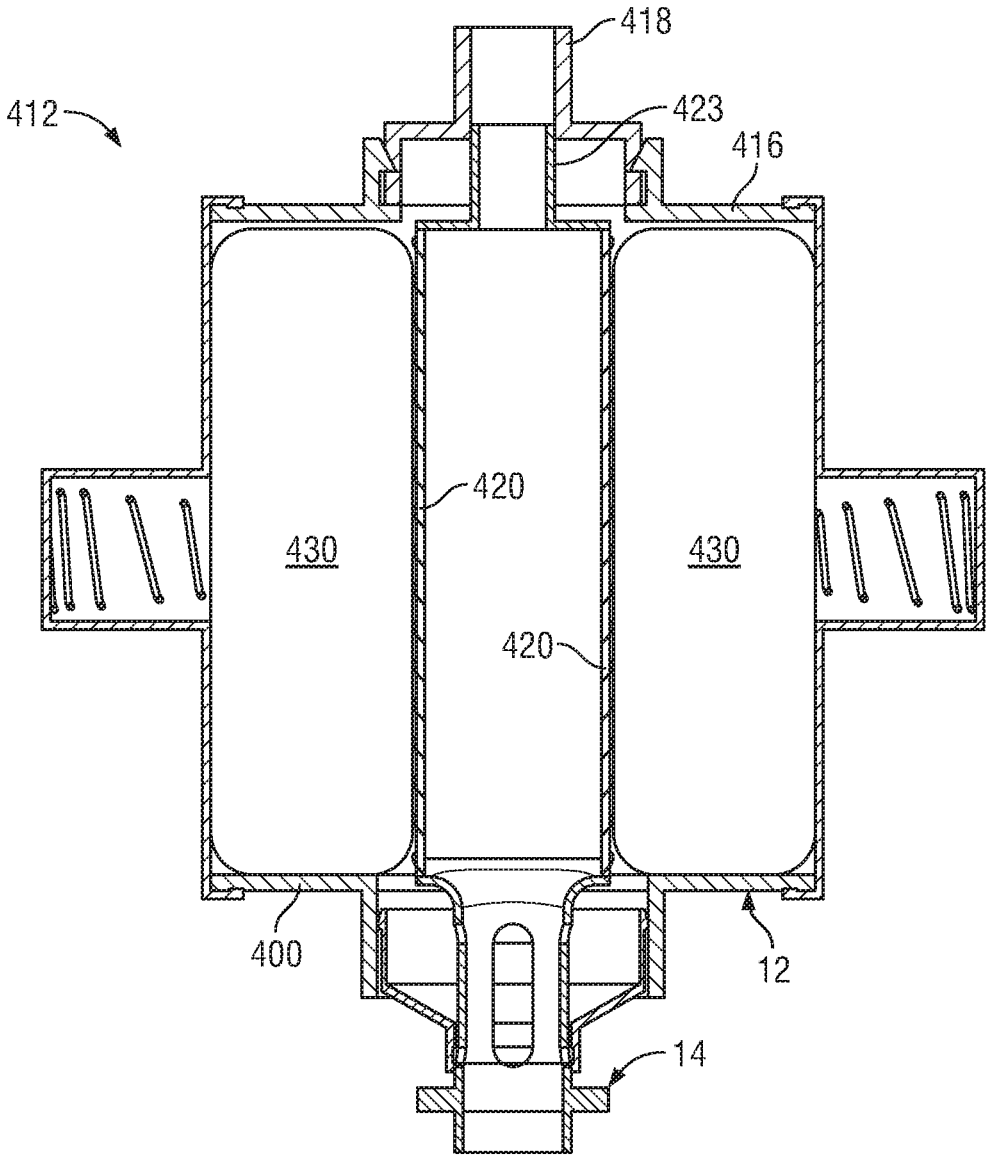
FIG. 24 is a cross-sectional front view of the reservoir cartridge of FIG. 20 with the piston-forming element in an extended position.
Figure 25:
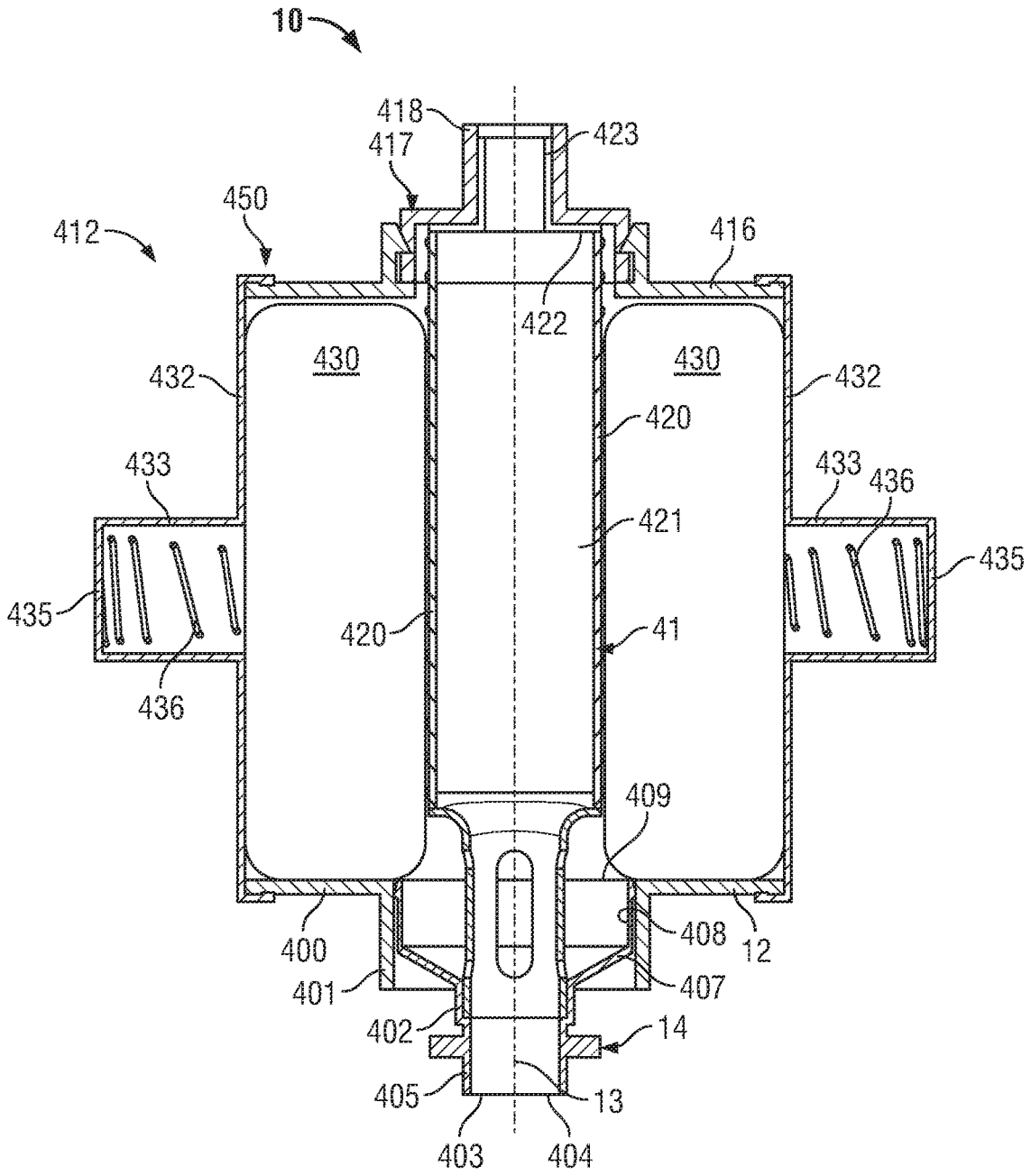
FIG. 25 is a front cross-sectional view as in FIG. 24 but with the piston-forming element in a retracted condition.
Figure 26:
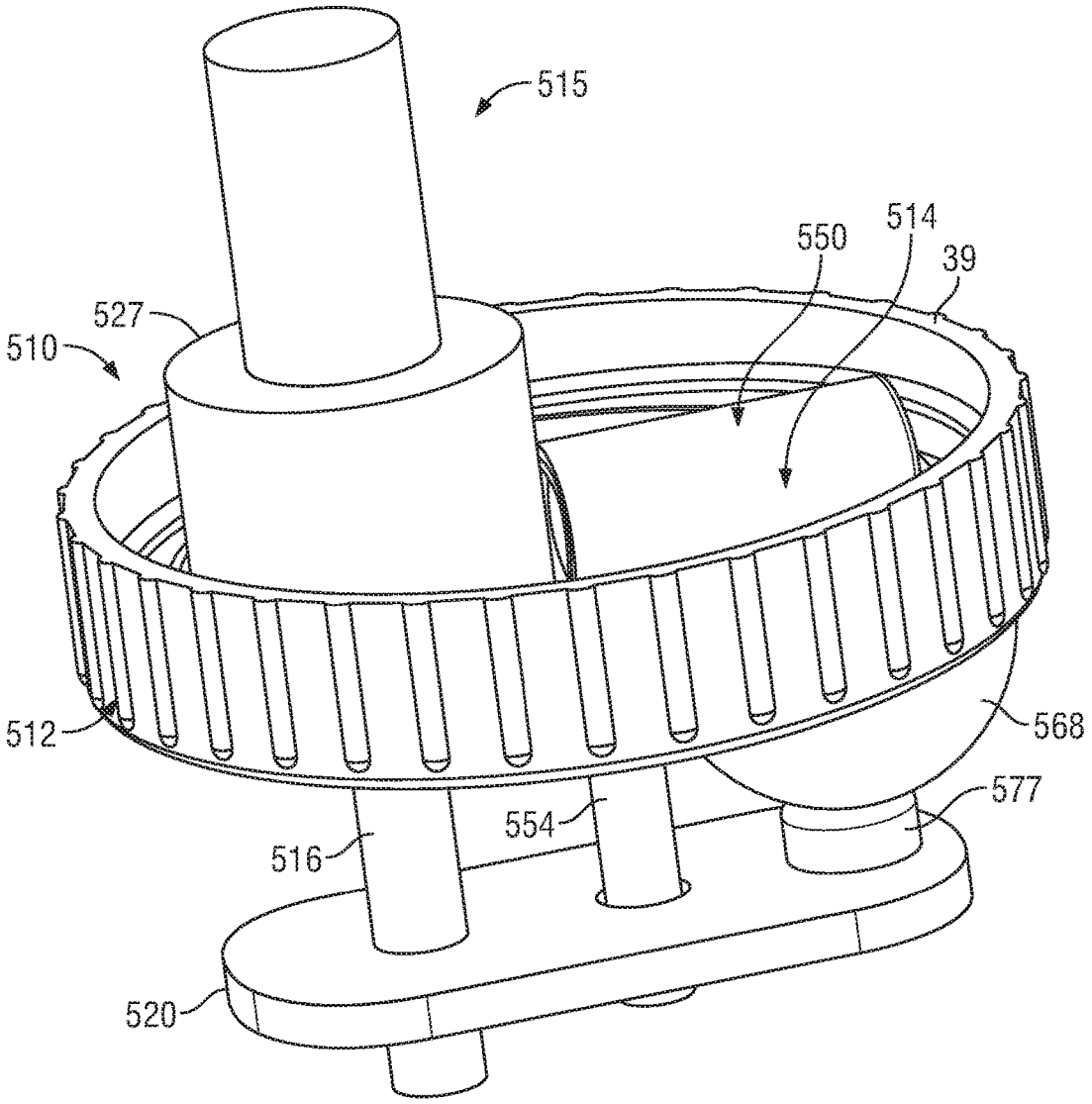
FIG. 26 is a pictorial view showing the top of a pump assembly in accordance with a sixth embodiment of the present invention.
Figure 27:
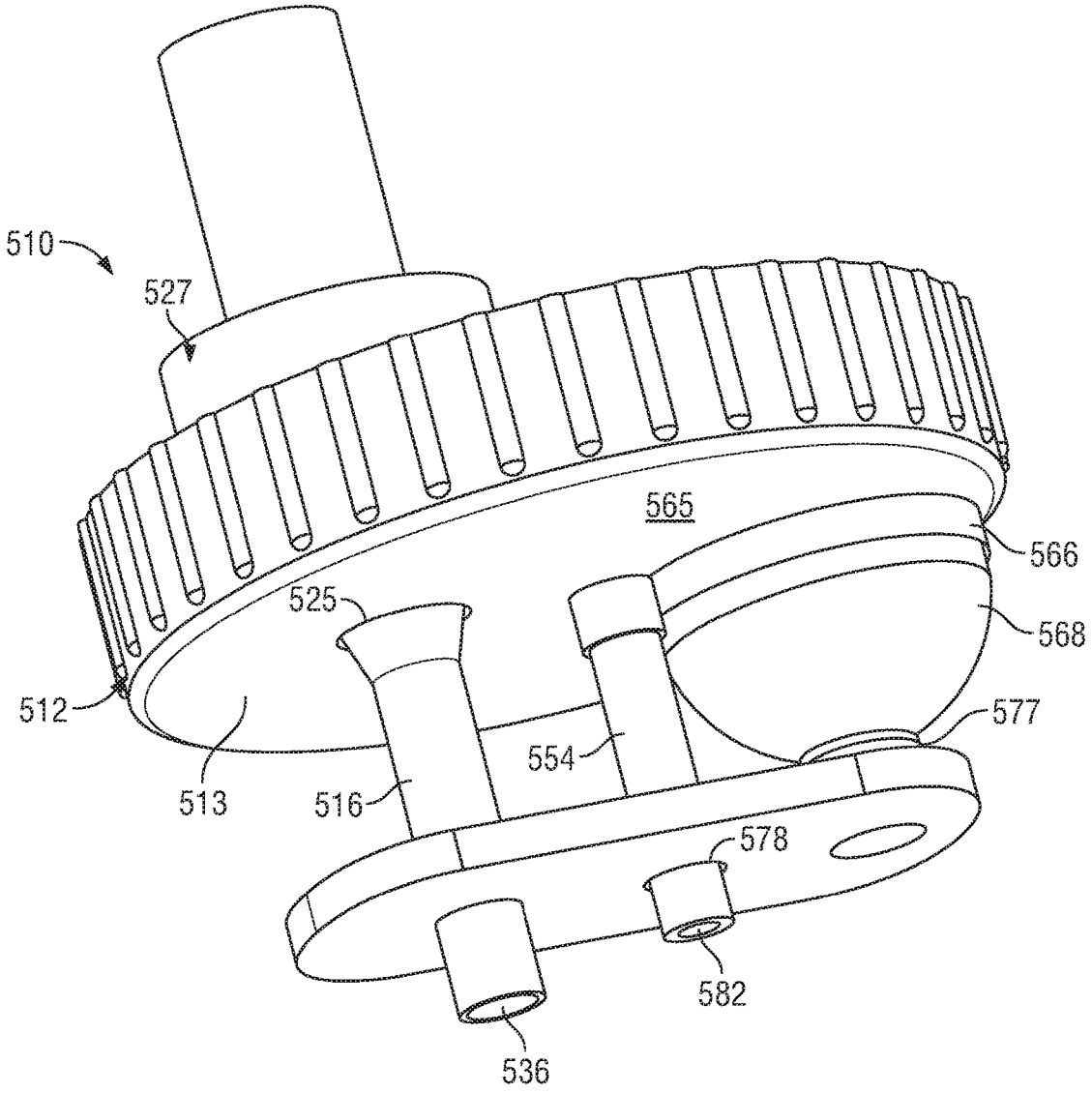
FIG. 27 is a pictorial view showing the bottom of the pump assembly shown in FIG. 26.

As seen in FIGS. 24 and 25, the reservoir cartridge 412 includes a piston assembly 10 having a body 12 and a piston 14 coaxially slidable relative to the body 12. The body 12 has a rectangular support plate 400 from which a guide tube 401 extends downwardly coaxially about an axis 13. The piston 14 comprises a hollow stem 402 open at an axially outer end 403 as a material discharge outlet 404. The hollow stem 402 forms a cylindrical discharge tube 405 as a lower portion which extends axially upwardly and outwardly as a frustoconical funnel portion 407 which extends axially inwardly as a cylindrical guide portion 408 opening axially inwardly to an inner open end 409 of the stem 402. The guide portion 408 of the stem 402 is coaxially slidable within the guide tube 401 of the body 12. A rasp member 411 is secured to the piston 14 for axial sliding movement with the piston 14.

A soap cage 450 is coupled to the body 12. The soap cage 450 includes a U-shaped housing 413 having a front wall 414, a rear wall 415 and a top wall 416 with a rectangular opening 429. A cage lid 417 is secured to the top wall 415 to close the rectangular opening 429 and to provide a cylindrical guide tube 418 coaxially about the axis 13.

The rasp member 411 is secured at its lower end to the piston 14 and extends upwardly as a pair of parallel rasp plates 420 spaced from each other to provide a central cavity 421 joined at an upper end by a top plate 422 from which a guide tube 423 extends axially upwardly into sliding engagement within the guide tube 418 carried on the cage lid 417. The guide tube 418 on the rasp member 411 serves to guide the rasp member 411 in coaxial sliding about along the axis 13 with the piston 14. A plurality of openings 424 are provided through each of the rasp plates 420 and suitable rasping mechanisms such as prongs extend radially outwardly for engagement of solid material to abrade the same on relative movement of the rasp plates 420.

The rasp member 411 carries approximate the bottom of each of the rasp plates 420, a joining bottom plate 451 which preferably is angled inwardly towards the axis 13 to assist in directing any particles to move under gravity downwardly into the discharge tube 405.

A rectangular channelway 426 is defined within the cage 450 on either side of the rasp plates 420 as defined between the support plate 400 of the body 12, the front 414, top 416 and side 415 of the cage 450. A rectangular soap bar 430 having dimensions corresponding to the channelway 426 is received within the channelway 426 and slidable therein. A cover plate 432 is secured to the cage 450 on an outer side of the channelway 426 outwardly of the soap bar 430. The cover plate 432 includes a cylindrical tube member 433 open radially inwardly and provided with a closed outer end 435. A spring member 436 is provided within each tube member 433 biased between the outer end 435 of the tube member 433 and the soap bar 430 so as to urge the soap bar 430 into engagement with a respective rasp plate 420.

The soap bars 430 are thus biased into the rasp plates 420 at all times. With reciprocal movement of the piston 14 relative to the body 12, the rasp plates 420 move relative the soap bars 430 in engagement with the soap bars 430 to cut, abrade and/or dislodge solid particles of the soap bars 430 which particles pass through the opening 424 in the rasp plate 420 into the cavity 421 between the rasp plates 420 and fall under gravity downwardly where they are channeled into the discharge tube 405 and out the material discharge outlet 274.

The reservoir cartridge 412 of the fifth embodiment is adapted to be received within a dispenser housing 114 such as that shown in FIG. 1. In this regard, the guide tube 423 of the body 12 is to carry a slotway to be engaged by the plate 24 and an engagement flange 17 on the piston 14 is adapted to be engaged by the actuator plate 132 in the same manner as described with the first embodiment.

The reservoir cartridge 412 of the fifth embodiment serves merely to dispense material from the soap bars 430 and not liquid. The reservoir cartridge 412 of the fifth embodiment may be useful, for example, in an environment where merely solid materials are to be dispensed as, for example, including environments in which, for example, the temperature might be so low that liquid soap would freeze. In accordance with the present invention, a dispenser kit is provided including a housing 114 as shown in FIG. 1 and a plurality of modular reservoir cartridges including (1) at least one of: (a) a reservoir cartridge which is merely adapted for dispensing fluid such as taught, for example, by earlier referenced U.S. Pat. No. 8,272,540, and (b) a reservoir cartridge 112 which is adapted for dispensing fluid and solid materials, such as described in the embodiment of FIGS. 2 to 5, and (2) a reservoir cartridge 412 which is adapted merely for dispensing solid materials, such as shown in the fifth embodiment of FIGS. 22 to 25. Preferably, the housing is adapted to receive and dispense fluid and/or solid material from each of the modular cartridges by simple removal and replacement of any of the cartridges. In the context of a housing 114 as in FIGS. 1 and 2, the kit may include adaptors to replace or modify the actuator plate 132 to permit coupling of different engagement flanges 17 as may be carried by each of the cartridges, however, it is preferred if no such modification or replacement of the actuator plate 132 is necessary.

The relative configuration of the solid material reservoir cartridge 412 of the type shown in the fifth embodiment may be optimized so as to fit within the cavity provided in a dispenser housing 114 such as shown in FIG. 1. For example, while the fifth embodiment illustrates the use of helical coil springs 436 to bias the soap bars 430 into the rasp plates 420, relatively flat springs may be provided in substitution to reduce the overall width of the cage 450. The rasp plates 420 are shown to be parallel flat plates, however, this is not necessary and the rasp plates may, for example, be flat plates which are disposed at an angle to taper upwardly to meet at the upper end near the guide tube 418. The soap bars 430 are then preferably provided with a corresponding angled inner surface.

In the preferred embodiment shown in FIGS. 22 to 25, the soap bars 430 are provided to be of a configuration of a commercially available bar of hand soap, however, the soap bars may be of any desired shape or configuration and need not be rectilinear as shown in the fifth embodiment.

Figure 28:
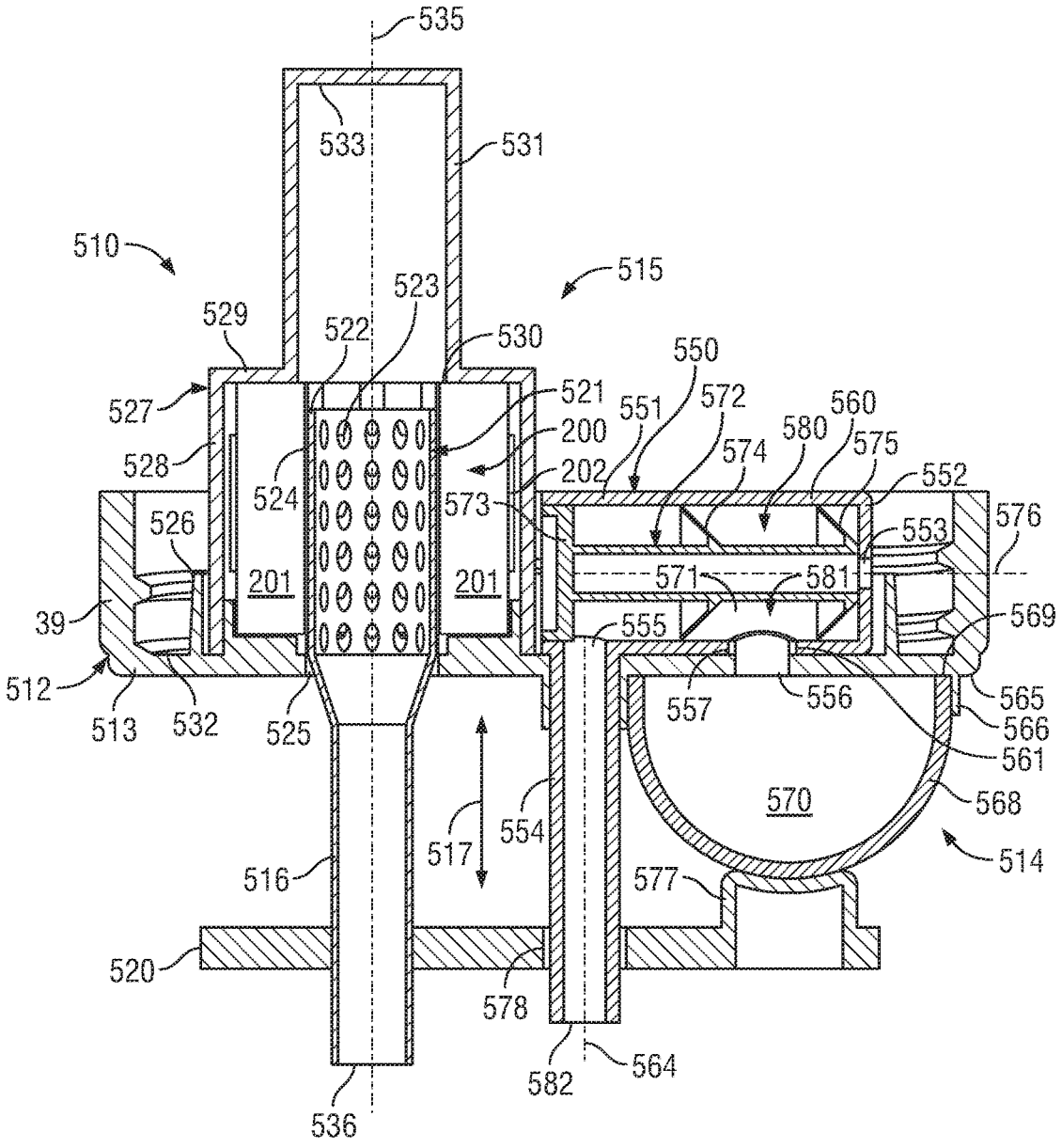
FIG. 28 is a cross-sectional side view of the pump assembly of FIG. 26 in an extended position.
Figure 29:
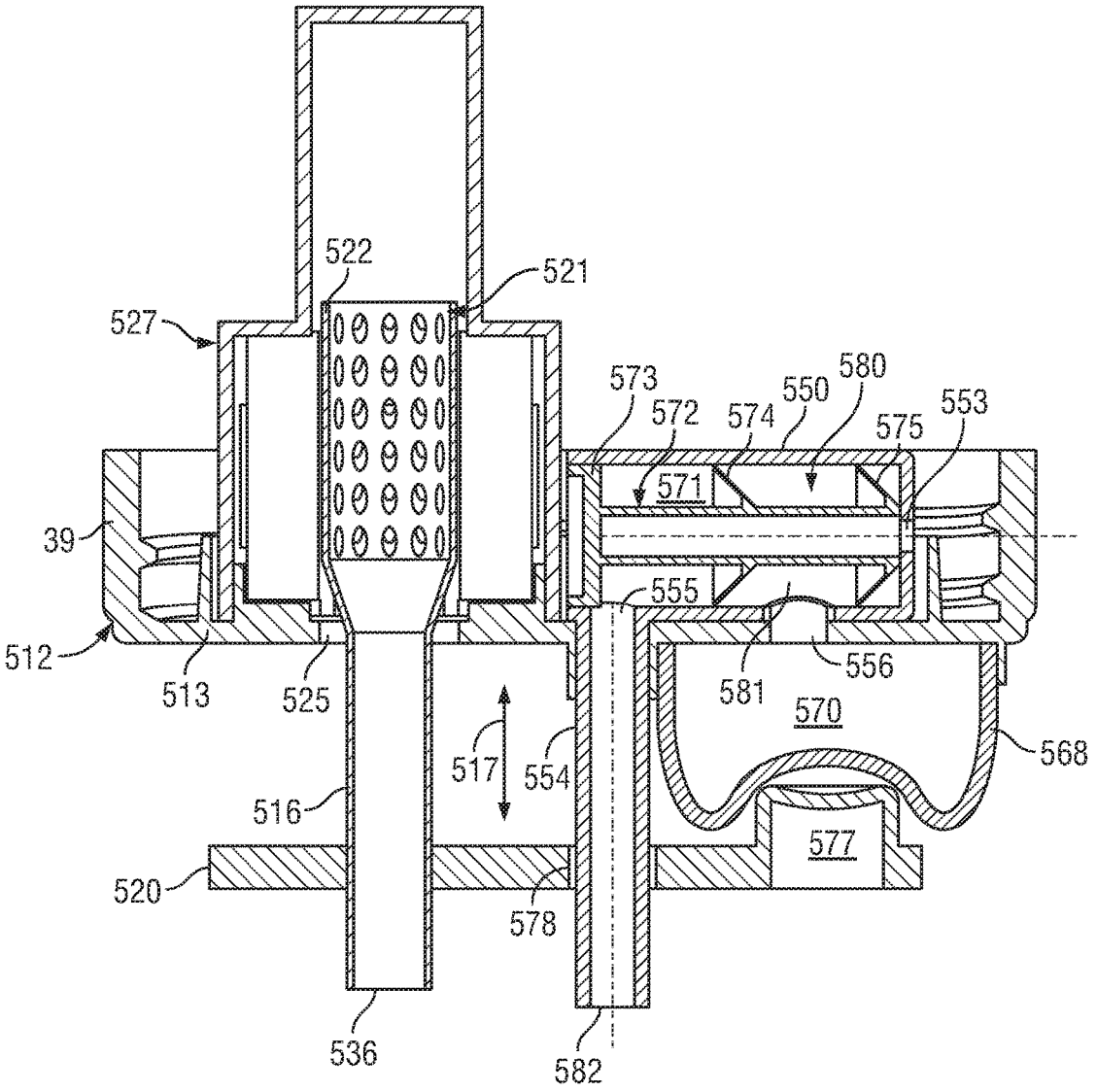
FIG. 29 is a cross-sectional view the same as FIG. 28 but showing a retracted condition.

Reference is made to FIGS. 26, 27, 28 and 29 which illustrate a sixth embodiment of a pump assembly 510 in accordance with the present invention. The pump assembly 510 includes a body 512 with a radially extending base 513 from which an annular collar 39 extends axially inwardly and presents interior threaded surfaces for threaded sealed engagement as with a neck of a bottle in the first embodiment. The body 512 carries a diaphragm liquid pump 514 as well as a solid material particle generator 515. An engagement or driven member 520 is slidably movable relative to the body 512 for movement in a direction of the arrows 517 shown on FIGS. 28 and 29 between an extended position as shown in FIG. 28 and a retracted position as shown in FIG. 29.

A solid material discharge tube 516 is fixedly mounted to the driven member 520 for movement therewith relative to the body 512. The discharge tube 516 carries at its inner end a rasp member 521 in the form of a cylindrical rasp tube 522 having openings 523 therethrough and rasp prongs 524 extending radially outwardly therefrom. The discharge tube 516 and its rasp tube 522 extend coaxially of a rasp axis 535 parallel the arrows 517 through a rasp opening 525 in the base 513 of the body 512. An axially inner surface 532 of the base 513 carries a cylindrical flange 526 coaxially about the rasp opening 525. A cage housing 527 is secured to the flange 526 and has a cylindrical side wall 528. The side wall 528 ends inwardly at an annular radially extending cage end shoulder 529 having a rasp guide opening 530 coaxial with the rasp opening 525. The cage housing 527 extends axially inwardly as a cylindrical rasp guide tube 531 closed at an inner end 533.

Disposed within the cage housing 527 is a soap cartridge 200 substantially the same as the soap cartridge 200 in the first embodiment and having a plurality of segments 201 of solid soap disposed about the rasp axis 535 and encircled by a circumferential elastic band 202. Each segment 201 is engaged and guided to slide radially relative the rasp axis 535 by engagement with floor guide tongues on the base 513 engaging guide slots in each of the segments 201 as the segments are directed towards the rasp axis by the circumferential elastic band 202 such that the segments 201 are biased radially inwardly into the rasp tube 522. With movement of the driven member 520 between the extended and the retracted positions, the rasp member 521 is moved coaxially along the rasp axis 535 in engagement with the soap segments 201 to abrade solid particles from the solid soap segments 201 for passage of the particles through the rasp openings 523 axially into the discharge tube 516 to fall under gravity down through the discharge tube 516 and out a solid material discharge outlet 536.

The diaphragm liquid pump 514 includes a cylindrical tubular casing 550 which is open at a first end 551 and closed at a second end 552 but for a liquid inlet opening 553. The tubular casing 550 has a liquid discharge tube 554 attached to it. The discharge tube 554 is a cylindrical tube which extends radially from an outlet opening 555 inside the tubular casing 550 proximate the first end 551 of the tubular casing 550 to a liquid discharge outlet 582.

The base 513 has a pump transfer opening 556 therethrough including a short stub transfer tube 557 which extends axially inwardly from the base 513. A circular transfer port 558 is provided through a cylindrical side wall 560 of the tubular casing 550. The transfer port 558 is sealably engaged upon the transfer tube 557. A discharge tube opening 561 is provided axially through the base 513. The tubular casing 550 is fixedly secured to the base 513 with the liquid discharge tube 554 extending outwardly from the base 513 parallel to the rasp axis 535 about a discharge tube axis 564.

An axially outer face 565 of the base 513 carries an axially outwardly extending cylindrical flange 566. A substantially semi-spherical diaphragm member 568 has an open end 569 sealably engaged within the cylindrical flange 566 axially outwardly of the base 513 so as to define a variable volume diaphragm chamber 570 open through the pump transfer opening 556 to a pump chamber 571 inside the tubular casing 550.

Within the tubular casing 550, a valve member is provided which has a central axially extending stem 572 upon which three discs are mounted. On a first end of the valve member, a sealing disc 573 is provided which is located in sealed engagement within the first end 551 of the tubular casing 550 to close the same against fluid flow inwardly to or outwardly from the pump chamber 571. A first radially outwardly extending annular outlet disc 574 is provided on the valve stem 572 axially between the sealing disc 573 and the pump transfer port 556. Axially spaced from the outlet disc 574 away from the sealing disc 573, a radially outwardly extending annular inlet disc 575 is provided on the valve stem 542 axially between the pump transfer port 556 liquid inlet opening 553 in and the second end 552 of the tubular casing 550. Each of the outlet disc 574 and the inlet disc 575 have their radial distal ends in engagement with the cylindrical side wall 560 of the tubular casing 550 biased to prevent fluid flow axially of an axis 576 of the tubular casing 550 inwardly toward the liquid inlet opening 553, that is, to the right as seen in FIG. 28. The driven member 520 carries a presser member 577 with a frusto-spherical recession engaged with a center of the diaphragm member 568.

The driven member 520 has a central opening 578 therethrough coaxially about the liquid discharge tube 554 for axial movement of the driven member 520 relative to the base 513 and the liquid discharge tube 554 fixed to the base 513 with movement of the driven member 520 between the extended position and the retracted position.

A liquid compartment 580 is defined within the diaphragm liquid pump 514 including as its volume the volume of the diaphragm chamber 570, the transfer tube 557 and an annular chamber 581 within the tubular casing 550 about the valve stem 572 in between the outlet disc 574 and the inlet disc 575. In movement of the driven member 520 from the extended position to the retracted position, the volume of the liquid compartment 580 decreases thus creating pressure therein which acts on the inlet disc 575 to prevent liquid flow axially therepast to the inlet opening 553 and acts on the outlet disc 574 to deflect the outlet disc 574 to permit liquid flow from the liquid compartment 580 outwardly through the outlet opening 553 to the liquid discharge tube 554 and out the liquid discharge outlet 582. In a retraction stroke in moving from the retracted position of FIG. 29 to the extended position of FIG. 28, due to the inherent resiliency of the diaphragm member 568, the volume of the diaphragm chamber 570 increases as does the volume of the liquid compartment 580 thus creating a vacuum condition which acts on the outlet disc 574 to prevent fluid flow outwardly therepast and acts on the inlet disc 575 to permit liquid to be drawn past the inlet disc 575 through the liquid inlet opening 553 from inside a bottle into the liquid compartment 580.

In the cycle of operation, in a retraction stroke, liquid is discharged from the liquid compartment 580 through the discharge outlet 582 and in an extension stroke, liquid is drawn into the liquid compartment 580 through the liquid inlet opening 553. The discharge of solid material particles from the solid material discharge outlet 536 can occur in one or both of the extension stroke and the retraction stroke. The solid material discharge outlet 536 is proximate the liquid discharge outlet 582.

The combination of the tubular casing 550 and the valve member provides a preferred construction of a one-way inlet valve and a one-way outlet valve which can be manufactured easily and at low cost, preferably from two elements which are injection molded from plastic. The tubular casing 550 is shown to be a cylindrical tube with a cylindrical side wall presenting a cylindrical inner surface about the valve member inner disc 575 and the outer disc 574. The side wall need not be cylindrical or of a constant diameter but, for example, needs to have a cross-sectional shape which is circular where it is to be engaged by each of the inlet disc 575 or the outlet disc 574. The tubular casing 550 is shown as effectively closed at the second end 552 and open at the first end 551 which his advantageous to permit the valve member to be inserted axially through the first end 551 with the valve member to carry the sealing disc 573 to close the inner end 551. The tubular casing 550 may be open at the second end 552 with the valve member to carry another sealing disc to seal the second end 552. The valve member is shown as constrained within the tubular casing 550 against axial movement. The valve member preferably need only carry the inlet disc 575 and the outlet disc 574 and other arrangements can be provided for closing the ends of the tubular casing 550.

Figure 2:
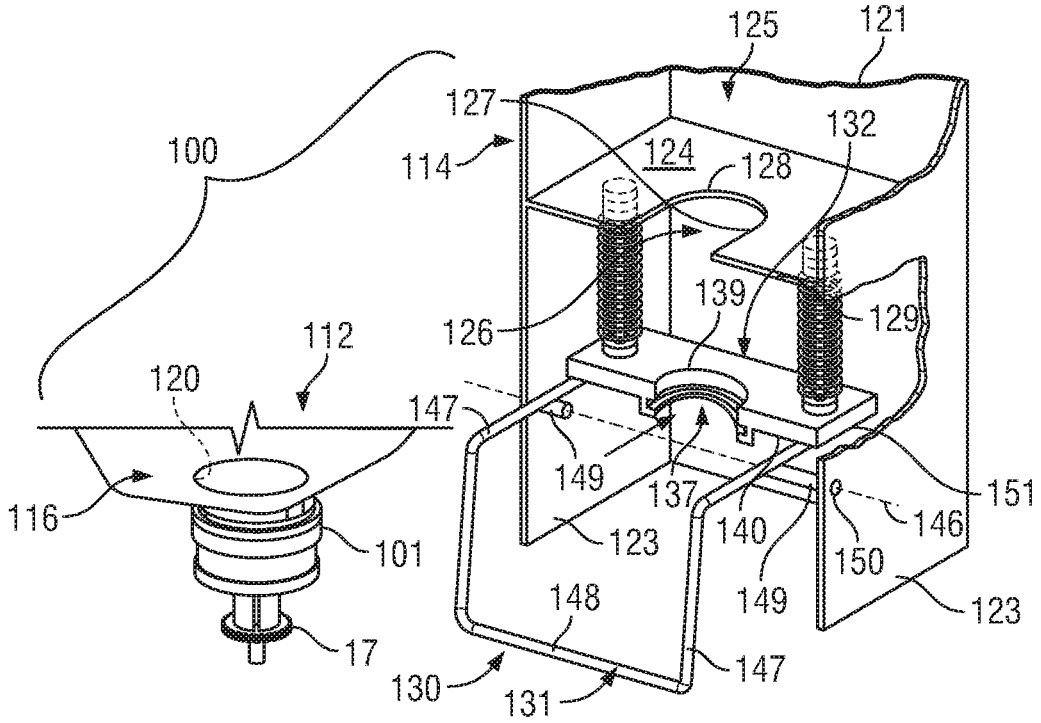
FIG. 2 is an exploded partial perspective view of the housing and reservoir of the dispenser of FIG. 1 illustrating the reservoir ready for insertion by relative horizontal movement.

In the embodiment of FIGS. 26 to 29, the particular manner by which the driven plate 520 is moved between the extended and retracted positions is not limited. In one simple arrangement, as illustrated in the first embodiment, the driven member 520 may be configured to have the shape of the engagement flange 17 in FIG. 2 such that the driven member 520 may be coupled to an actuator plate in a similar manner that the engagement flange 17 in FIG. 2 is engaged with the activator plate 132. However, many other arrangements may be provided for coupling to transfer mechanical manual movement by a user and/or movement of an electric motor to move the driven member 520 between the extended and retracted positions.

Reference is made to FIGS. 30, 31, 32 and 33 which illustrate a seventh embodiment of a pump assembly 610 in accordance with the present invention.

Figure 32:
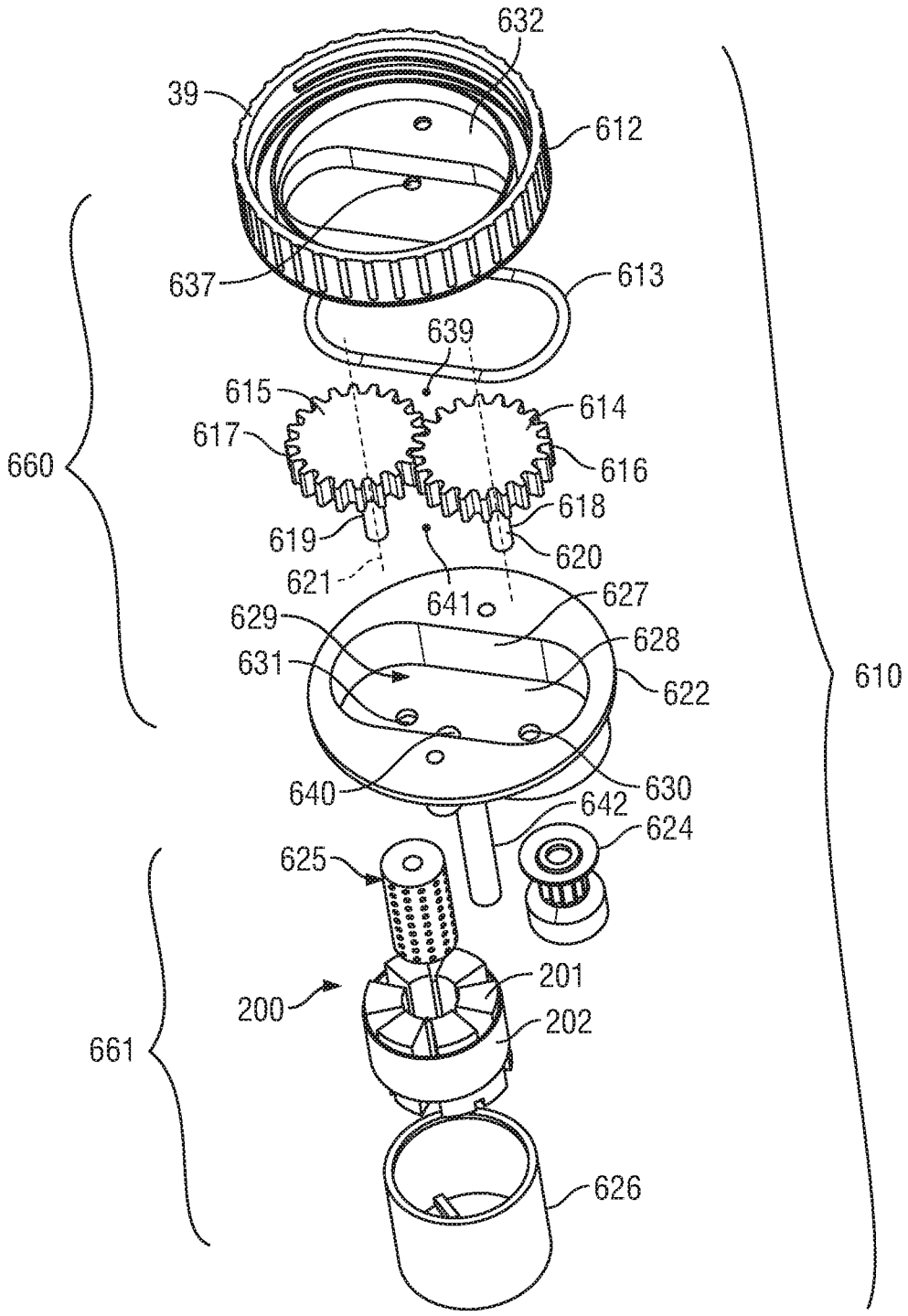
FIG. 32 is a schematic exploded view showing the top of components of the pump assembly shown in FIG. 31.
Figure 33:
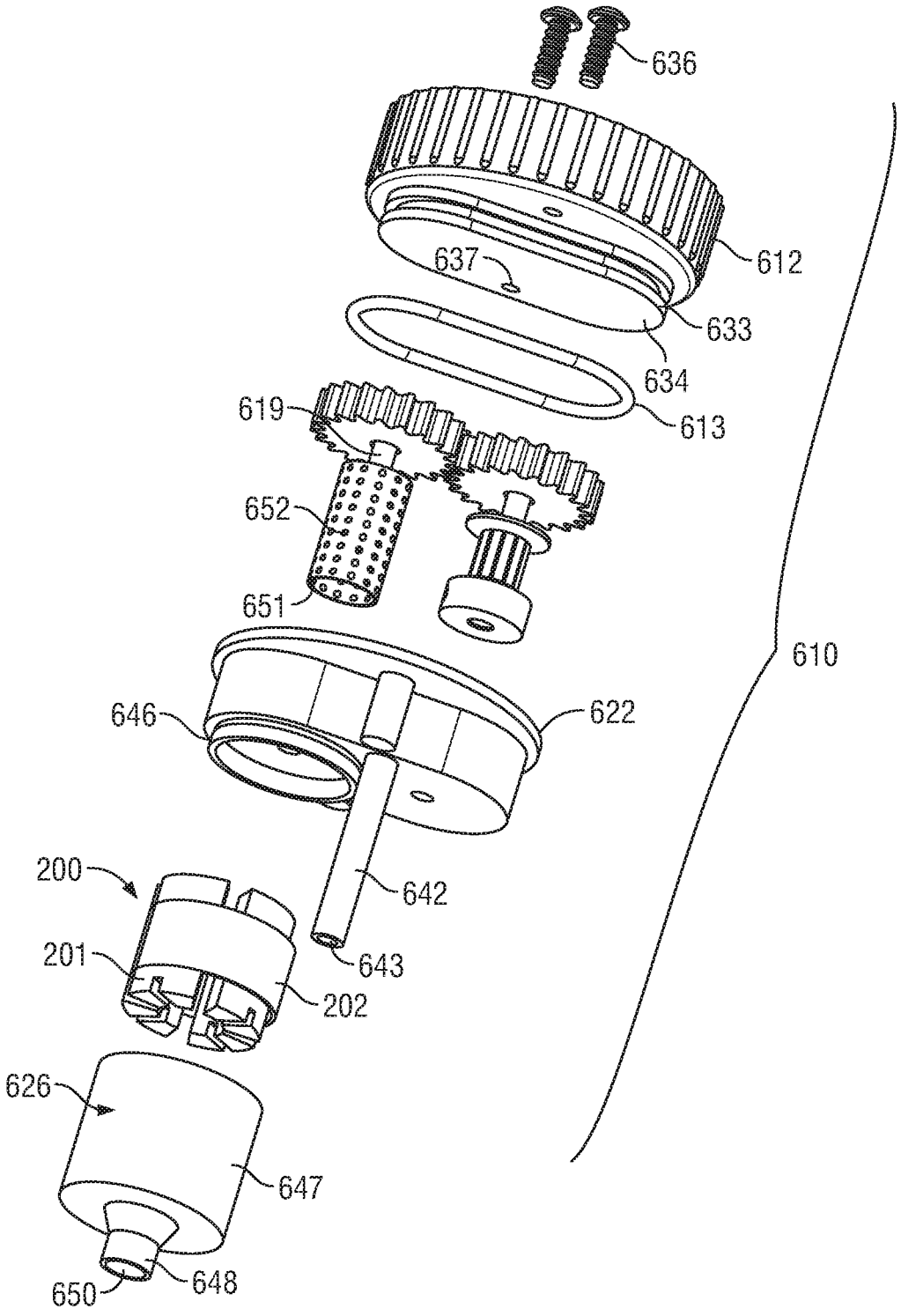
FIG. 33 is an exploded view showing the bottom of the components of the pump assembly as in FIG. 32, however, with some of the components assembled.
Figure 34:
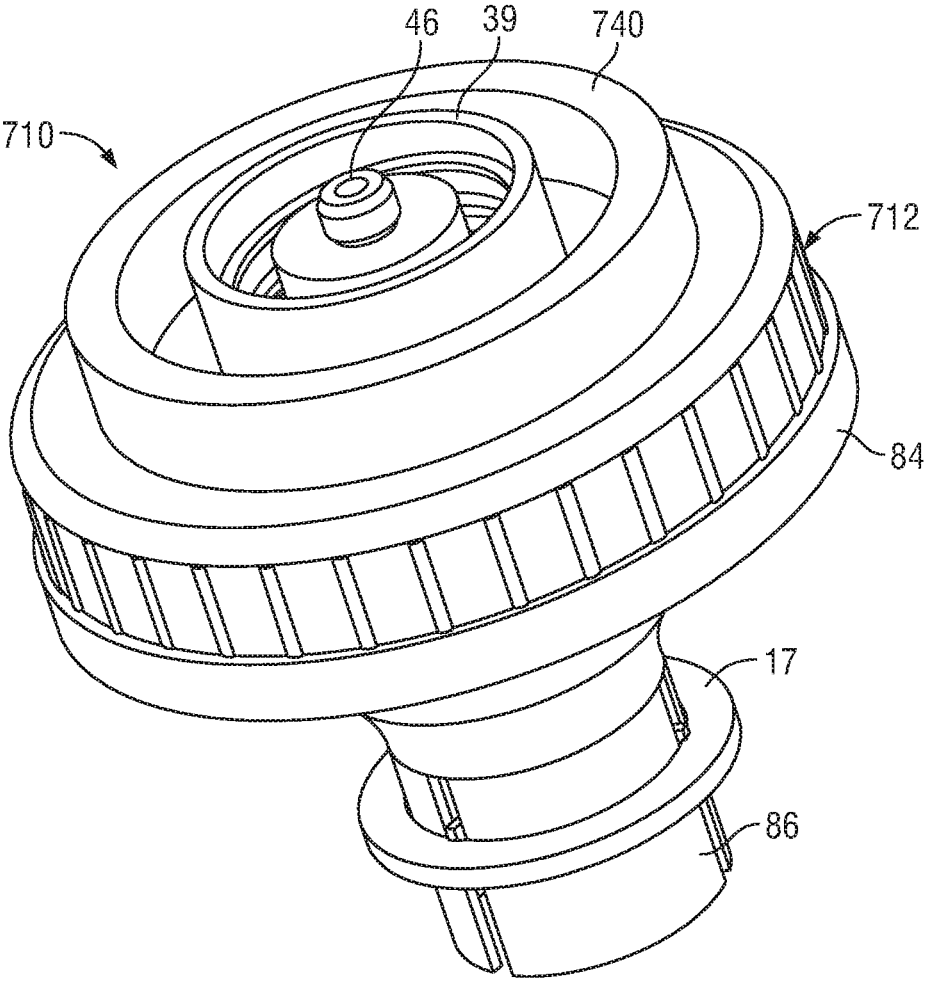
FIG. 34 is a pictorial view of the top of an eighth embodiment of a pump assembly in accordance with the present invention in a retracted condition.
Figure 35:
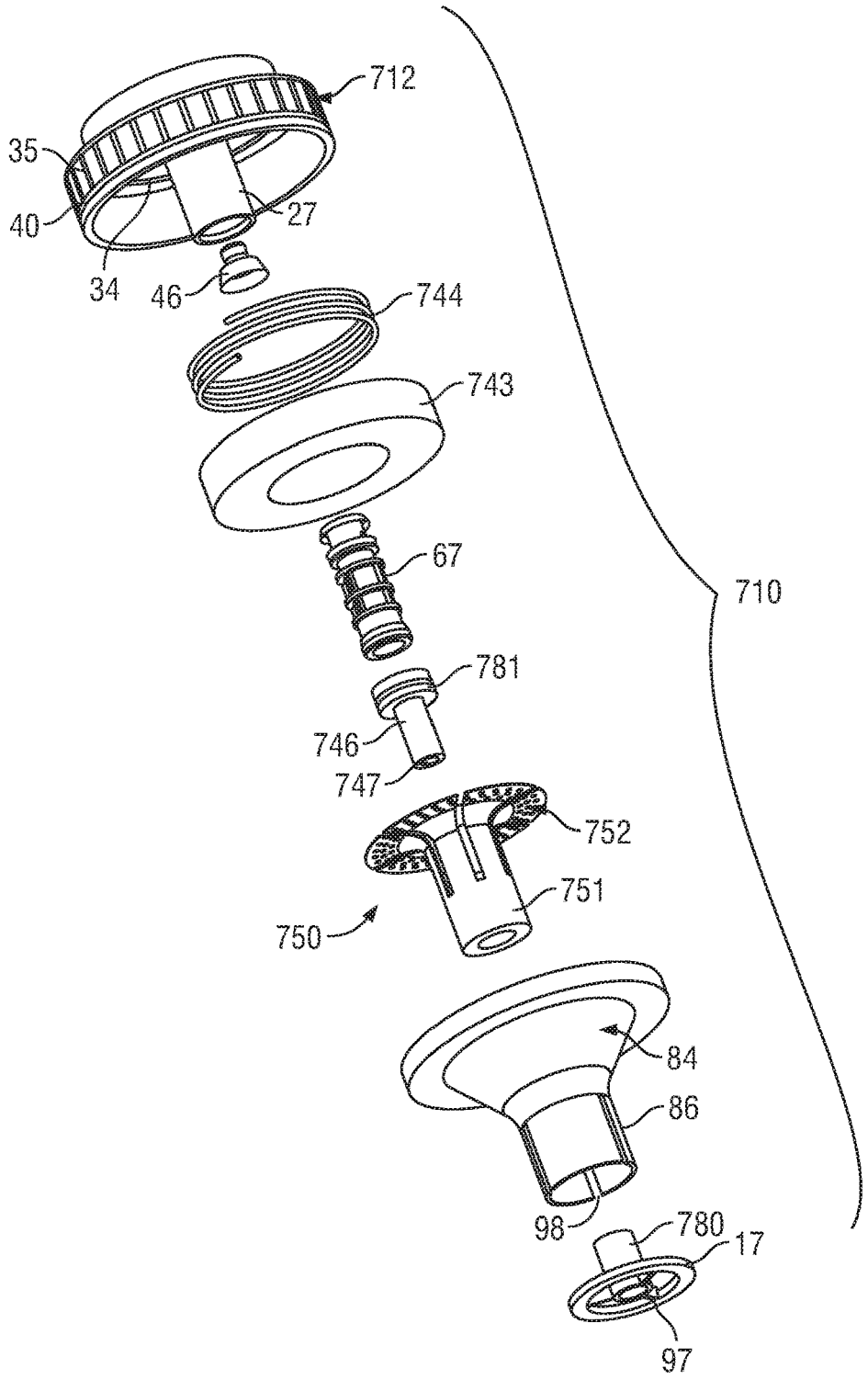
FIG. 35 is an exploded pictorial view showing the bottoms of the components of the pump assembly of FIG. 34.

Reference is made to FIG. 32 showing an exploded view of the pump assembly 610. The pump assembly 610 includes a body 612, a sealing ring 613, a drive gear 614 and a driven gear 615. The drive gear 614 has drive teeth 616 and a drive axle 618 which extends axially outwardly from the drive gear 614 about a drive axle 620. Driven gear 615 has teeth 617 and a driven axle 619 which extends axially outwardly from the driven gear 615 about a driven axis 621 parallel the drive axis 620.

The pump assembly 610 also includes a pump casing 622, a drive spindle 624, a rasp member 625, a soap cartridge 200 and a soap cage 626. The soap cartridge 200 includes four soap segments 201 encircled by an elastic band 202. The pump casing 622 defines side walls 627 and an outer end wall 628 of a racetrack shaped oval pump chamber 629. A drive opening 630 extends axially outwardly through the pump casing outer end wall 628 and a driven opening 631 similarly extends spaced from the drive opening 630 through the pump casing outer end wall 628.

The drive gear 614 and the driven gear 615 are located to have the drive axle 618 extend through the drive opening 630 and the driven axle 617 extend through the driven opening 631 with the drive teeth on the two gears meshing. The body 612 has a radially extending base 632 bordered by an axially inwardly extending annular collar 39. The collar 39 carries internal threads and is adapted to be secured as to a neck of a bottle as in the first embodiment. The base 632 carries an oval protuberance 633 on its axially outer side which engages the pump casing 622 forming an inner end wall 634 of the pump chamber 629 and enclosing the pump chamber 629 between the pump casing 622 and the body 612 with the sealing ring 613 disposed therebetween forming a liquid seal. The body 612 and the pump casing 622 are drawn together compressing the sealing ring 613 therebetween by two screws 636 shown only in FIGS. 31 and 33.

A fluid inlet opening 637 extends through the base 632 of the body 612 opening into the pump chamber 629 in an inlet bight 639 between the gear teeth on a first side of the meshed gears. A fluid outlet opening 640 extends outwardly through the pump casing 622 from the pump chamber 629 at an opposite outlet bight 641 between the meshed gears. The fluid outlet opening 640 opens into a liquid discharge tube 642 which extends outwardly from the pump casing 622 to a liquid discharge outlet 643. Outwardly of the pump casing 622, the drive spindle 624 is coupled to the drive axle 618 for rotation therewith. Outwardly of the pump casing 622, the rasp member 625 is engaged on the driven axle 619 for rotation therewith. The rasp member 625 includes a cylindrical rasp tube 651 with openings 652 radially therethrough and rasp prongs extending radially outwardly. On an axially outer face 645 of the pump casing 622, a cylindrical flange 646 is provided disposed coaxially about the driven axle 619. The soap cage 626 is engaged on the cylindrical flange 646. The soap cage 626 includes a cylindrical tube 647 which opens at an axially outer end into a solid material discharge tube 648 with a downwardly directed solid material discharge outlet 650. Disposed within the cage tube 647 is the soap cartridge 200 formed by four soap segments 201 biased radially inwardly into the rasp tube 651 by reason of a resilient circumferential band 202.

Figure 30:
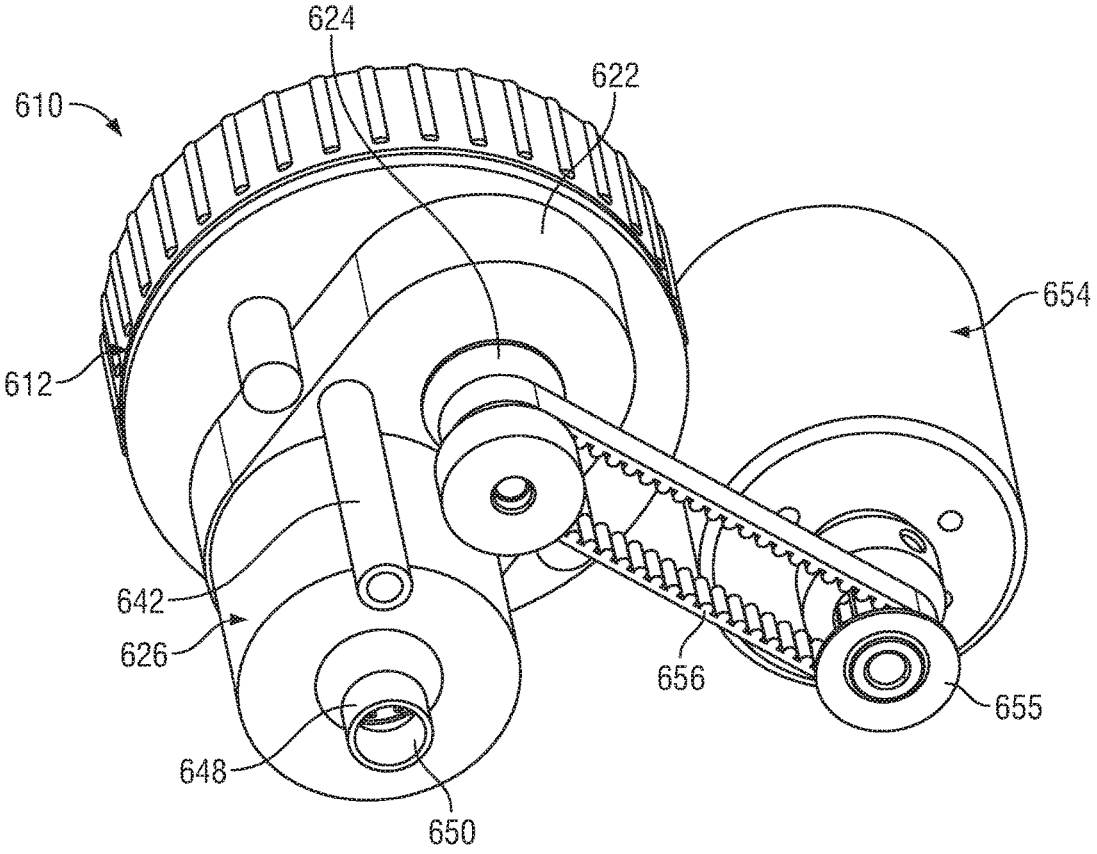
FIG. 30 is a pictorial view showing the bottom of a seventh embodiment of a pump assembly as schematically illustrated as coupled to an electric motor.
Figure 31:
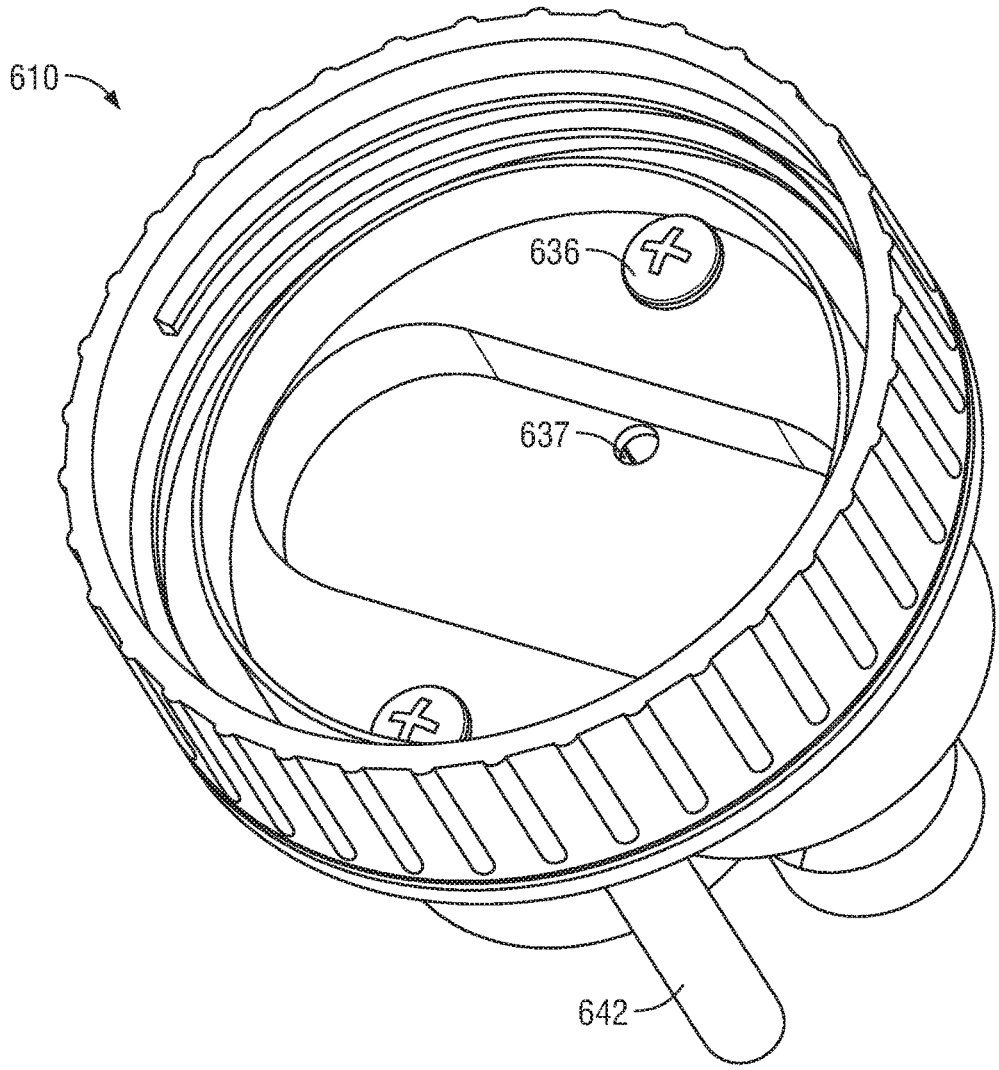
FIG. 31 is a pictorial view showing the top of pump assembly of FIG. 30.

FIG. 30 shows a schematic view of the assembled pump assembly 610 which is adapted to be engaged about a bottle, not shown, and coupled with the bottle to a housing, not shown, of a dispenser. FIG. 30 shows an electric motor 654 adapted to rotate a motor spindle 655 which is to drive a drive belt 656 also engaged about the drive spindle 624. The motor 654 is adapted to be carried by the housing of the dispenser (not shown) at a suitable location relative to the pump assembly 610. With rotation of the motor 654, the drive gear 624 is rotated which rotates the driven gear 615. Rotation of the drive gear 614 and the driven gear 615 provide a gear-type liquid pump 660 which draws fluid through the fluid inlet opening 637 into the pump chamber 629 through the nips between the gears and out the fluid outlet opening 640 to discharge liquid out the fluid outlet discharge outlet 643. With rotation of the driven gear 615, the rasp member 625 and its rasp tube 651 are rotated. The soap cartridges 201 are urged into the rasp tube 651 by the band 202 such that with rotation of the rasp member 625, the rasp member 625 removes particles of the solid soap which particles drop down into the soap cage 626 and the discharge tube 648, hence, downwardly under gravity out the solid material outlet 650. The rotating rasp member 525, the soap cartridge 200 and the soap cage 626 form a solid particle generator 661. With rotation of the drive gear 614, the liquid pump 660 dispenses liquid out the liquid discharge outlet 643 and the rotating rasp member 625 disengages solid material particles from the soap segments 201 which are discharged out the solid material discharge outlet 650 proximate the liquid discharge outlet 643.

In the embodiment of FIGS. 30 to 33, the pump assembly 610 is adapted to be engaged on bottle which is preferably adapted for removal and replacement inside a dispenser with the insertion and removal of the bottle carrying the pump assembly 610 accommodating engagement and disengagement of the electric motor 654 with the drive gear 614.

While the embodiment of FIGS. 30 to 33 shows one mechanism for coupling of an electric motor to drive gear 614, many other coupling mechanisms may be provided.

Reference is made to FIGS. 34 to 39 to illustrate an eighth embodiment of a pump assembly 710 in accordance with the present invention.

In the eighth embodiment, elements of the pump assembly 710 have very similar elements to elements of the first embodiment of the pump assembly illustrated in FIGS. 3 to 7 with similar reference numerals used to refer to similar elements. The pump assembly 710 includes a body 712 and a piston 714. The body 712 has an annular end wall 34 from which a cylindrical soap cage exterior tube 35 extends axially outwardly. The annular end wall 34 of the body 712 carries a center tube 27 defining a cylindrical liquid chamber 28 having a cylindrical inner chamber wall 31, an inner end 32 and an open outer end 33. The exterior tube 35 has an axially outer end 36 to which there is secured an axially outer annular floor member 84 which extends radially inwardly and axially downwardly to merge at a lower end into a tubular chute tube 86. A central opening 87 through the floor member 84 opens into the inside of the chute tube 86. The annular end wall 34 supports a radially inwardly extending annular collar 39 with threaded interior surfaces adapted to sealably engage a neck of a bottle, not shown. The annular end wall 34 also is provided with an annular raceway 740 coaxially about the collar 39 closed at an axially inner end 741 and open at an axially outer end 742 into the solid material cage 40. An annular soap ring 743 is located within an annular cavity 739 radially between the cage exterior tube 35 and the inner tube 27. A helical coil spring 744 located within the annular raceway 740 biases the soap ring 743 axially outwardly.

An inlet opening 42 to the liquid chamber 28 is provided in the inner end 32 of the liquid chamber 28. A flange 43 extends across the inner end having a central opening 44 and the inlet 42 therethrough. A one-way valve 46 is disposed across the inlet opening 42. The inlet opening 42 provides communication through the flange 43 with fluid in a bottle. The one-way valve 46 permits fluid flow from the bottle into the liquid chamber 28 but prevents fluid flow from the liquid chamber 28 to the bottle. The one-way valve 46 and its interaction with the liquid chamber 28 is substantially identical to that in the first embodiment.

The piston 714 is slidably received in the body 712 for reciprocal sliding motion inwardly and outwardly therein coaxially along a central axis 13. The piston 714 has a hollow stem 15 extending along a central axis 13. The piston 714 includes a liquid piston portion 67 of the stem 15 carrying an inner disc 50 and outer disc 52 in the liquid chamber 28 of the center tube 27 forming therewith a liquid pump 68 by an interaction between the liquid piston portion 67 and the interior center tube 27 identical to that disclosed with the first embodiment, however, in which liquid discharged is passed outwardly through a liquid discharge tube 746 to a liquid discharge outlet 747 with the discharge tube 746 having a passageway 748 therethrough comprising an extension of a central passageway 56 through the liquid piston portion 67. The interaction of the liquid piston portion 67 of the stem 15 of the piston 714 and the center tube 27 forms the liquid pump 68 for drawing fluid past the one-way inlet valve 46 in a withdrawal stroke and in discharging fluid out the fluid discharge outlet 747 in a retraction stroke.

An annular tube 780 is fixed to the liquid discharge tube 746 coaxially thereabout. The annular tube 780 carries three radially outwardly extending struts 97 to couple an annular engagement flange 17 to the discharge tube 746. The chute tube 86 of the floor member 84 has three axially extending slots 98 open at an axially outer end and closed at an inner end. The discharge tube 746 and the annular tube 780 are coaxially received within the chute tube 86 with the struts 97 passing radially through the slots 98 of the chute tube 86 to permit the engagement flange 17 to be located radially outwardly of the chute tube 86 in substantially the same manner as described in FIGS. 9 and 10.

A rasp member 750 is supported on the stem 15. The rasp member 750 includes at its axially outer end an annular rasp collar 751 by which the rasp member 750 is secured to the stem 15 by engagement of an enlarged annular portion 781 at an axial inner end of the liquid discharge tube 746. The rasp collar 751 merges axially inwardly into six rasp fingers 752 spaced circumferentially with a slotway 753 between each of the adjacent rasp fingers 752. The rasp fingers 752 are spaced radially outwardly from the stem 15 sufficiently that the rasp fingers 752 are radially outwardly of the center tube 27. Each rasp finger 752 is a resilient member which extends axially inwardly and is deflected to extend radially outwardly in engagement with an axially outwardly directed surface 754 of the annular soap disc 743 as can best be seen in the pictorial views of FIGS. 38 and 39. Each rasp finger 752 is shown as comprising a relative thin sheet member which is resilient and capable of being bent from a cylindrical configuration proximate the rasp collar 751 into a relatively flat configuration proximate a distal end 756 of the rasp finger 752. Over a rasping portion 757 proximate the distal end 756 of each rasp finger 752, a plurality of rasp openings 758 are provided through the rasp finger and a plurality of rasp prongs 760 are provided on each rasp finger 752 over the rasping portion 757 directed at least in part axially inwardly for engagement with the soap ring 743.

Figure 36:
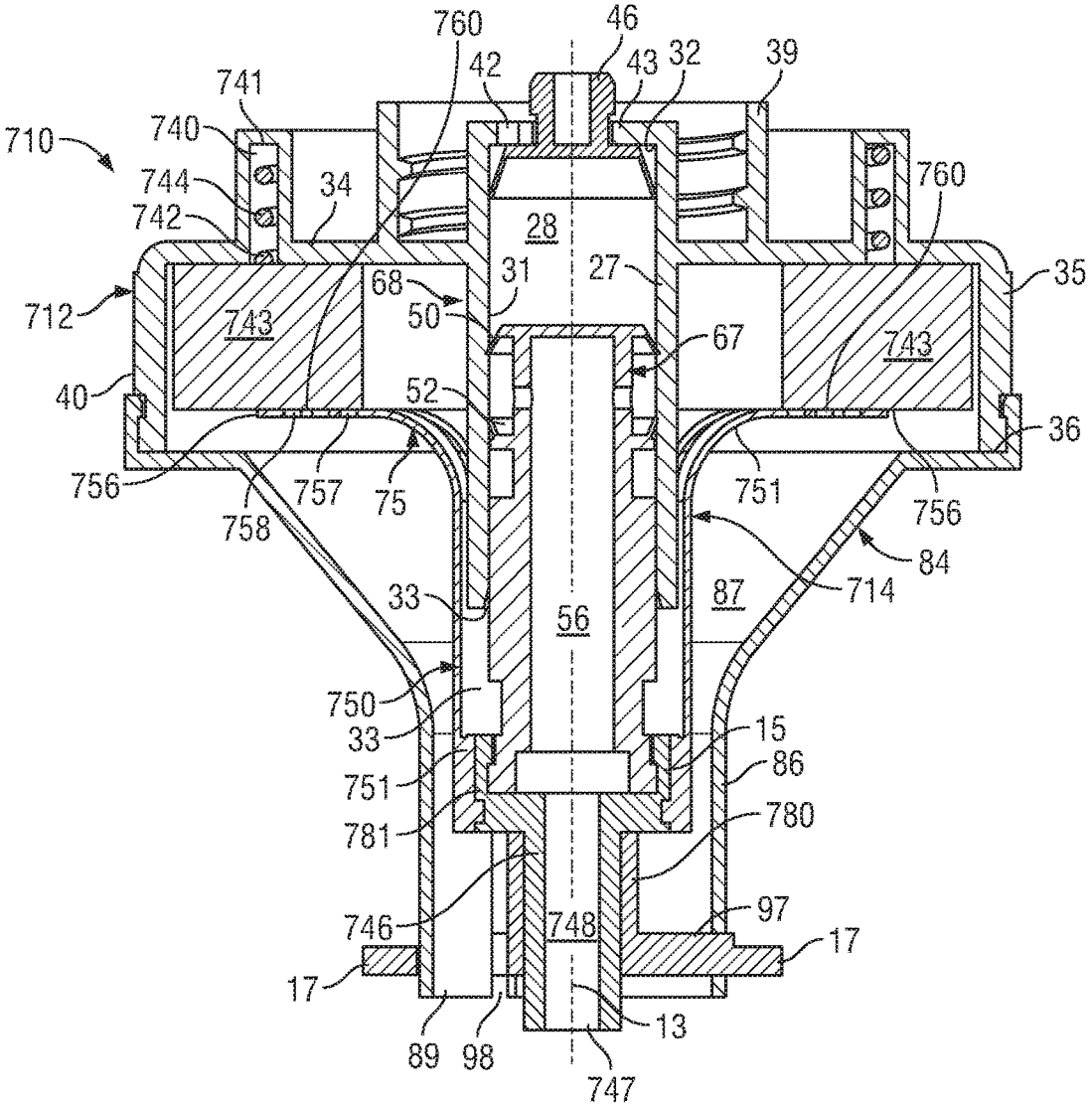
FIG. 36 is a cross-sectional side view of the pump assembly of FIG. 34 but in an extended condition.
Figure 37:
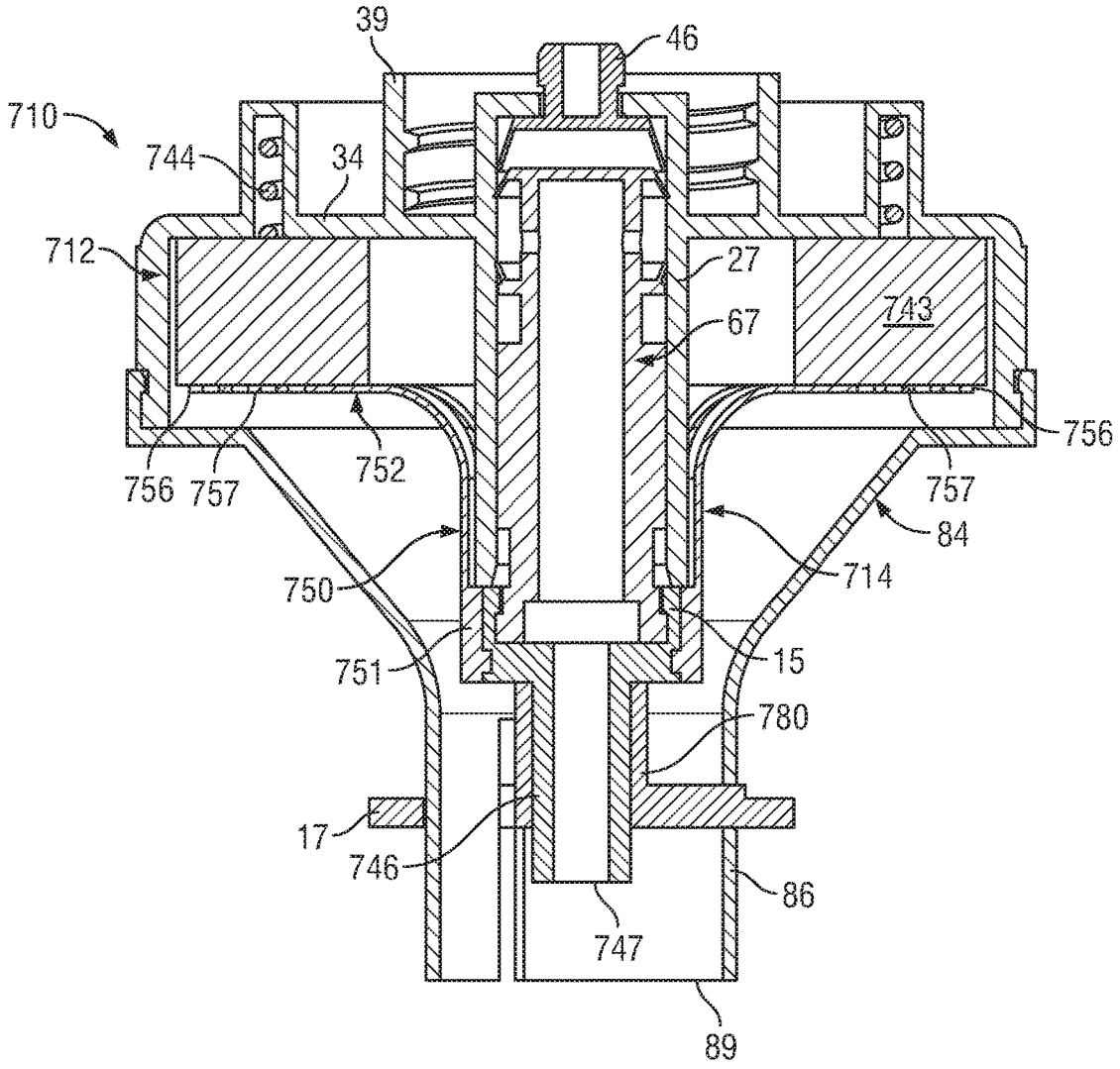
FIG. 37 is a cross-sectional side view the same as FIG. 36 but showing a retracted condition as in FIG. 34.
Figure 38:
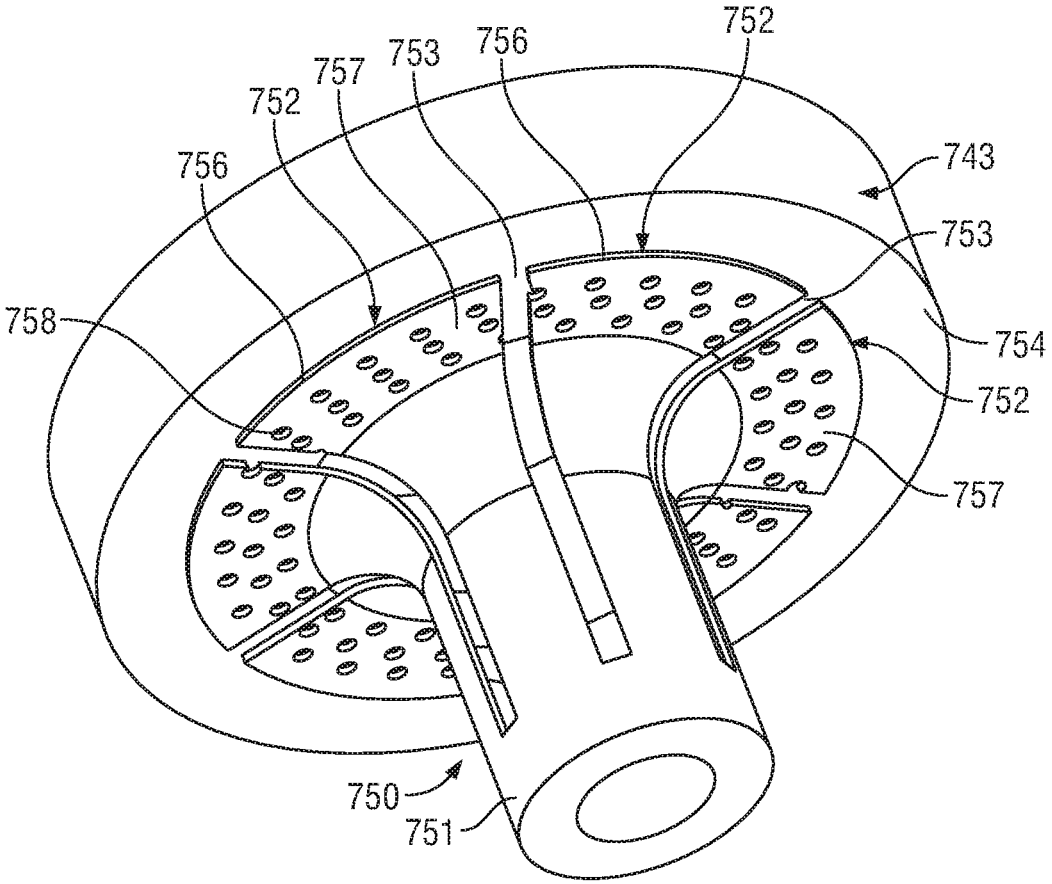
FIG. 38 is a pictorial view showing selected components of the pump assembly of FIG. 34 in the extended condition.
Figure 39:
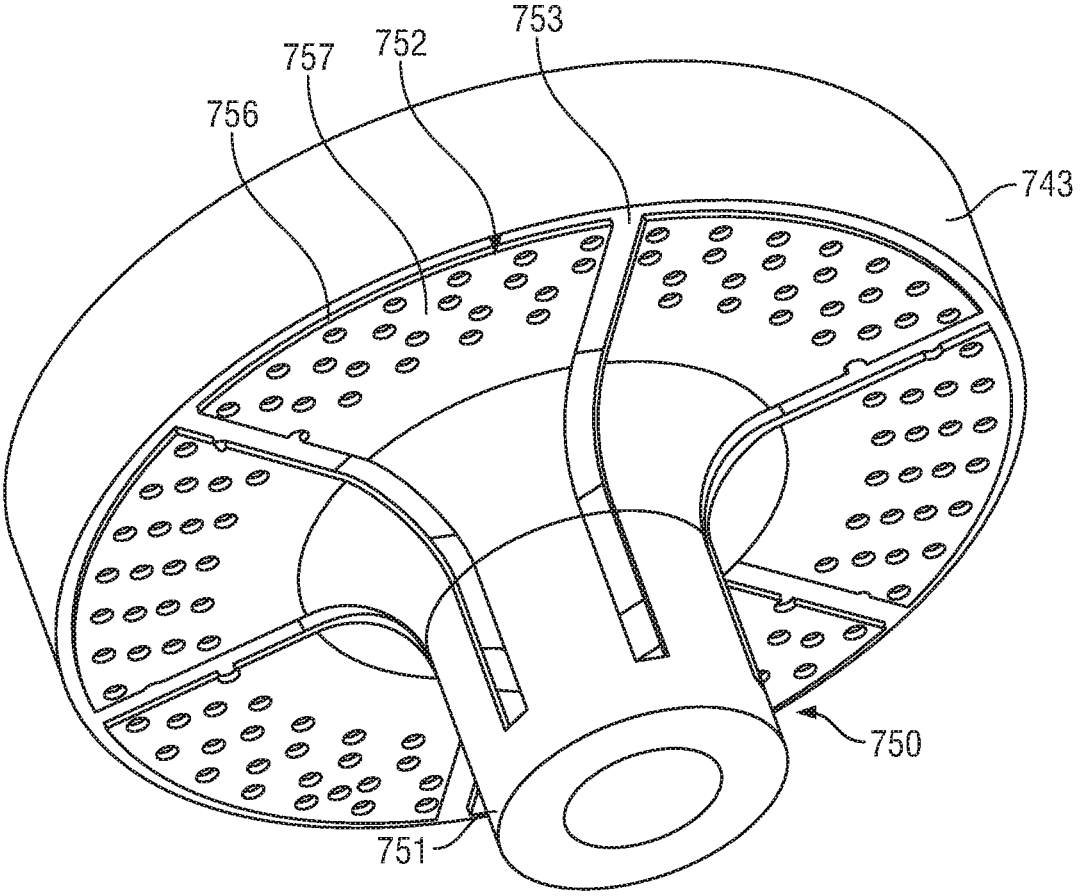
FIG. 39 is a pictorial view the same as FIG. 38 but in the retracted condition.

In a retraction stroke, in movement of the piston 714 from the extended position of FIGS. 36 and 38 to the retracted position of FIGS. 37 and 39, as the liquid piston portion 67 of the stem 15 is moved axially inwardly, the distal end 756 of each rasp finger 752 is moved radially outwardly. In a withdrawal stroke, as the liquid piston portion 67 of the stem 15 of the piston 714 is moved axially outwardly from the position of FIG. 37 to the position of FIG. 36, the distal end 756 of the rasp finger 752 is moved radially inwardly. The spring 744 at all times biases the soap ring 743 axially outwardly into engagement with the rasping portions 757 of the rasp fingers 752. The rasp fingers 752 preferably are resilient and have an inherent bias to assume an inherent configuration in which the rasp fingers 752 are biased axially upwardly into the soap ring 743.

In a cycle of operation in movement of the rasp portions 757 of the rasp fingers 752 radially in engagement with the soap ring 743, solid soap particles are torn by the rasp portions 757 from the soap ring 743, pass through the rasp openings and drop under gravity down into the inside of the floor member 84 down into the chute tube 86 and out an annular particle discharge outlet 89 of the chute tube 86 coaxially about the discharge tube 746 and the liquid discharge outlet 747 of the piston 714. Thus, the embodiment shown in FIGS. 34 to 39 provides for the generation of solid particles by the radial movement of the distal ends 756 of the rasp fingers 752 radially relative to an axis about which a liquid piston portion 67 of a liquid pump 68 moves axially.

In each of the embodiments, a solid material particle generator and dispenser is provided by a rasp member engaging a solid material segment, rod or bar to disengage particles of the solid material which are to drop under gravity to a solid material discharge outlet. The particular nature of the material which is to form the solid material is not limited. The material when engaged by the rasp member will provide particles which will be disengaged and drop under gravity. One preferred material is a solid soap of the type commercially sold as hand soap and is useful as a hand cleaner. Such soaps may generally be considered to be a homogeneous material. The material, however, need not be homogeneous and may, for example, comprise a matrix of pellets and/or granular material which are bonded or compressed together and which, when abraded, the pellets and/or granular material may become disassociated from each other or dislodged from a binding matrix and dropped downwardly. The material may thus, for example, comprise compressed pumice or other abrasive cleaning materials which may be held together merely by compression or with some binder which permits the pumice particles when engaged by the rasp to be removed and dropped downwardly.

The solid material can, for example, include particles comprising solid iodine or coated with iodine which, when rubbed onto the surface of a user's hands, provide a disinfecting feature and may remain on the surface of the hand for a period of time after rubbing.

Dispensers in accordance with the present invention have a preferred use for dispensing hand cleaning fluids and materials onto the hand of the user. The dispensers are, however, not so limited. The liquid foam and solid material particles dispensed by the dispensers may be for any manner of uses. For example, rather than cleaning a person's hand, the matter dispensed may be useful for other purposes such as providing conditioning creams or other treatment for application to a person including treatments in which, for example, a liquid to be dispensed must not be brought into contact with the solid particles until shortly before the desired application. The dispenser for dispensing both liquid and solid material are useful for many industrial applications, such as in dispensing foods and confectionaries as, for example, in dispensing liquid chocolate and solid peanut particles onto ice cream products, such as ice cream sundaes and the like.

A dispenser in accordance with the present application is useful in the context of automated biological growth and dispensing systems, such as those described in U.S. Pat. No. 8,206,973, issued Jun. 26, 2012, the disclosure of which is incorporated herein by reference. In the context of systems and methods for growing bacteria, the bacteria and/or nutrients are often in powder form and suffer the disadvantage that moisture can cause the powder to solidify and prevent ease of handling and dispensing. According to the present invention, the solid materials desired to be dispensed, for example, bacteria in an inactive state may be incorporated into a solid material bar in a manner to be protected from atmospheric moisture with the bacteria, for example, to only be exposed to the elements after the bacteria has been removed from the bar in particulate form and discharged. The bacteria, for example, could be encased as a pellet in a moisture resistant or moisture impermeable coating and the pellets compressed to coalesce together with or without a binder into the solid material for the bar. The particles will be dispensed into a vessel in which the coating dissolves such that the bacteria may first become active in the vessel. The active ingredient which may be protected within the solid material prior to being abraded by the rasp is not limited to bacteria and may comprise other organic or inorganic materials which need to be constrained from activation or engagement with other matter until dispensed. Nevertheless, one particular use of the dispenser according to the present invention is to provide for the delivery of bacteria or other microorganisms into environments in which they grow including those particularly in which microorganisms are grown and then discharged into drains for digesting of grease and drains as from restaurants and the like. Preferably, a dispenser in accordance with this invention would discharge not only the microorganisms in solid particles but also a liquid useful as a nutrient for growth of the microorganism.

In accordance with the present invention, each of the rasp members are illustrated as having a first surface and a second surface and openings through between the surfaces and rasp prongs on one of the surfaces to be engaged with the solid material. The provisions of the openings is not essential and a rasp member, in accordance with the present invention, can operate merely by providing an abrasive surface on one surface of the rasp member which is to engage with the solid material. Particles cut or dislodged from the solid material may be maintained between the rasp member and the solid material until, for example, the rasp member may move axially outwardly to a location below the sold material where the particles may then be free to fall downwardly from the surface of the rasp member without the need to pass through openings in the rasp member.

The particular nature of the rasp member and the mechanical manner by which the rasp member engages and abrades, cuts or and/or dislodges particles of the solid material is not limited. Many different shapes and forms of rasp members and configurations for the rasp member engaging the solid material for discharge of particles will be appreciated by a person skilled in the art. In each of the embodiments, however, the rasp member and the solid material are in engagement during at least a portion and cycle of operation of the piston assembly and the relative movement of the piston and the body provide for relative movement of the rasp member and the solid material, preferably relative sliding or rotational movement, however, without being limited to such movement.

In the first embodiment of the present invention, a number of different segments 201 of solid material are provided. It is not necessary that each of the segments 201 be of the same solid material. For example, at least one of the segments 201 may be of a different material than other of the segments 201 and all of the segments may be of different material than the materials of the other segments. Thus, for example, an arrangement is provided in which a number of different segments of different solid materials are kept separate from each other with particles of each of the solid materials to be simultaneously dispensed, for example, one of the segments 201 could comprise a compressed block or pumice, a second segment 201 may comprise a compressed block of iodine, coated or containing particles and a third segment 201 may comprise conventional solid hand soap. Similarly, FIG. 21 shows an embodiment of a rod in which the rod 258 contains different axially extending segments 471, 472, 473 and 474 of material which will be discharged simultaneously as the rod 258 is advanced axially into the rasp member.

In addition, the composition of each solid material, bar or segment may vary through the segment or bar. For example, as seen in FIG. 8, one segment 201 is provided in layers of different compositions, for example, with a first layer 461 initially to be discharged, a second layer 462 to subsequently discharge and a third layer 463 to finally be discharged as the segment 201 is advanced radially into the rasp member. The different layers may have different physical characteristics. For example, to facilitate the rasp member in removing particles from the segment 201 as the relative force that the segment 201 is urged into the rasp member may decrease as the segment 201 is reduced the second layer 462 may be easier to abrade than the first layer 461 and the third layer 463 may be easier to abrade then the second layer 462. The composition of the different layers may be different and/or provide different functions. For example, in the context of a bio generator, the first layer 461 might comprise microorganisms desired to be grown in a first or first number of batches in a bio generator. However, after the passing of time in a bio generator, undesirable microorganisms may come to dominate. The second layer 462 could be a disinfecting layer such as chlorine or the like which would kill all the microorganisms in the generator. Subsequently, after discharging the entirety of the disinfecting second layer 462 and flushing the generator, the third layer 463 may contain additional microorganisms which are subsequently grown in the generator.

While the invention has been described with reference to preferred embodiments, many variations and modifications will occur to a person skilled in the art. For definition of the invention, reference is made to the following claims.

We claim:

1. A pump assembly for dispensing of a fluid and of particles of a solid material comprising:

a fluid pump which in a cycle of operation draws the fluid through a fluid inlet and dispenses the fluid out a fluid outlet, a block of the solid material, a pump housing body, the fluid pump including a movable member mounted to the body for reciprocal movement relative the body parallel to an axis in the cycle of operation to draw and dispense the fluid, the block received axially between the body and the movable member presenting a first axially directed surface directed toward the movable member, a rasp member comprising a resilient finger member having a first end and a distal end, the first end of the finger member coupled to the movable member to move axially relative the axis with the movable member, the finger member extending from the first end axially away from the first end and radially outwardly from the axis to the distal end which carries an axially directed rasp surface directed axially toward the first axially directed surface of the block in opposition to the first axially directed surface of the block, the axially directed rasp surface and the first axially directed surface of the block biased axially into engagement with each other, in the cycle of operation, when the body and the movable member move axially toward each other, the finger member is axially compressed between the first axially directed surface of the block and the movable member and the finger member resiliently deflects between the first end and the distal end against an inherent bias of the finger member reducing the axial length between the first end and the distal end and moving the distal end radially outwardly, in the cycle of operation, when the body and the movable member move axially away each other, under the inherent bias of the finger member, the finger member deflects between the first end and the distal end increasing the axial length between the first end and the distal end and moving the distal end radially inwardly, wherein during the cycle of operation the rasp surface in engagement with the first axially directed surface of the block moves radially relative the first axially directed surface of the block disengaging particles of the solid material from the block at a location that the particles drop under gravity downwardly adjacent the fluid outlet.

2. A pump assembly as claimed in claim 1 wherein the body carries a collar for securing the pump assembly to an opening to a container comprising a reservoir for the fluid.

3. A pump assembly as claimed in claim 2 wherein a fluid inlet of the fluid pump is in communication through the collar with the fluid in the reservoir.

4. A pump assembly as claimed in claim 3 wherein the fluid pump is selected from a piston pump and a diaphragm pump.

5. A pump assembly as claimed in claim 1 wherein the body carrying a solid material cage enclosing the block separated from the fluid, the cage including a solid material discharge tube guiding the particles discharged from the block by the rasp member to a solid material discharge outlet proximate the fluid outlet while maintaining the particles separated from the fluid until exiting from the solid material discharge outlet.

6. A pump assembly as claimed in claim 1 wherein the fluid pump is a piston pump, the body carries a chamber-forming center tube coaxially about the axis defining a fluid chamber therein, the fluid chamber having a closed axially inner end and an open outer end, the movable member comprising a piston coaxially slidable received in the fluid chamber with an outer end of the piston extending outwardly of the open outer end of the fluid chamber to the discharge outlet at the outer end of the piston, the piston coaxially slidable along the axis within the fluid chamber between an extended position and a retracted position and movable in the cycle of operation between the extended position and the retracted position to draw the fluid into the fluid chamber and to discharge the fluid out the discharge outlet.

7. A pump assembly as claimed in claim 6 wherein:

the block is an annular member with a central opening therethrough, the block disposed coaxially about the axis annularly and radially outwardly about the chamber-forming tube with the first axially directed surface of the block directed axially outwardly, the first end of the finger member fixedly coupled to the piston proximate the outer end of the piston with the finger member extending from the first end axially away from the first end and radially outwardly of the chamber-forming tube to the distal end placing the axially directed rasp surface in engagement with the first axially directed surface of the block.

8. A pump assembly as claimed in claim 7 wherein:

the body has an annular end wall coaxial about the axis that carries a chamber-forming center tube, the end wall extending radially outwardly from the center tube, the block disposed axially outwardly of the end wall.

9. A pump assembly as claimed in claim 8 wherein:

the block having a second axially directed surface directed axially inwardly, a spring member disposed between the end wall and the second axially directed surface of the block biasing the block axially outwardly into engagement with the axially directed rasp surface on the distal end of the finger member.

10. A pump assembly as claimed in claim 8 wherein:

the annular end wall extending radially outwardly from the center tube to a circumferential outer end of the annular end wall, a chute tube extending coaxially from the circumferential outer end of the annular end wall axially outwardly to an open annular particle discharge outlet coaxially about the discharge outlet at the outer end of the piston, an annular compartment defined radially between the chute tube and the chamber-forming center tube within which the annular block is coaxially received.

11. A pump assembly as claimed in claim 10 wherein:

the axially directed rasp surface is directed axially inwardly in engagement with the first axially directed surface of the block, openings through the finger member over the distal end of the finger member sized to permit particles of the of the solid material disengaged by the rasp surface to pass through the finger member into the annular compartment radially outwardly of the finger member, the chute tube guiding particles of the solid material in the annular compartment radially outwardly of the finger member to pass under gravity outwardly in the chute tube to the annular particle discharge outlet annularly outwardly of the finger member and the piston.

12. A pump assembly as claimed in claim 7 including a plurality of said finger members secured spaced from each circumferentially about the piston.

13. A pump assembly as claimed in claim 11 including a plurality of said finger members secured spaced from each circumferentially about the piston, each finger member providing the rasp surface over a partial circumferential segment of the first axially directed surface of the block.

14. A pump assembly as claimed in claim 1 in combination with a container containing the fluid, wherein the body is secured to an opening to the container providing for communication of the fluid in the container to the fluid pump.

15. A pump assembly as claimed in claim 1 including a particle discharge chute receiving the particles disengaged from the block and directing the particles under gravity downwardly to a particle exitway adjacent the discharge outlet.

16. A dispenser as claimed in claim 1 including a biasing mechanism to urge the rasp and the block axially into engagement.

17. A dispenser as claimed in claim 16 wherein the biasing mechanism comprises a resilient spring member disposed between the body and the block engaging a second axially directed surface of the block opposite to the first axially directed surface of the block to urge the block axially toward the rasp.

18. A dispenser for dispensing of a fluid and particles of a solid material comprising a pump assembly as claimed in claim 1 in combination with:

a reservoir containing the fluid in which the fluid pump in the cycle of operation draws the fluid from the reservoir and dispenses the fluid out the discharge outlet.

19. A dispenser as claimed in claim 18 including:

a dispenser housing;

a pump actuator movable relative the housing in the cycle of operation to activate the pump to draw and dispense the fluid, a driven member for movement relative the housing in the cycle of operation either manually or by a motor, the driven member mechanically coupled to the pump actuator whereby movement of the driven member in the cycle of operation moves the pump actuator relative the housing to displace the fluid and to move the rasp member relative the body to disengage the particles.

20. An assembly for dispensing particles of a solid material comprising:

a body, a movable member mounted to the body for reciprocal movement relative the body parallel to an axis in a cycle of operation, a block of the solid material coalesced together, the block received axially between the body and the movable member presenting a first axially directed surface directed toward the movable member, a rasp member mounted to the movable member body for movement with the movable member relative the body in the cycle of operation, the rasp member comprising a resilient finger member having a first end and a distal end, the first end of the finger member coupled to the movable member to move axially relative the axis with the movable member, the finger member extending from the first end axially away from the first end and radially outwardly from the axis to the distal end which carries an axially directed rasp surface directed axially toward the first axially directed surface of the block in opposition to the axially directed surface of the block, the axially directed rasp surface and the axially directed surface of the block biased axially into engagement with each other, in the cycle of operation, when the body and the movable member move axially toward each other, the finger member is axially compressed between the axially directed surface of the block and movable member and the finger member resiliently deflects between the first end and the distal end against an inherent bias of the finger member reducing the axial length between the first end and the distal end and moving the distal end radially outwardly, in the cycle of operation, when the body and the movable member move axially away each other, under the inherent bias of the finger member the finger member deflects between the first end and the distal end increasing the axial length between the first end and the distal end and moving the distal end radially inwardly, wherein during the cycle of operation the rasp surface in engagement with the axially directed surface of the block moves radially relative the axially directed surface of the block disengaging particles of the solid material from the block.

* * * * *